US010062973B2

(12) United States Patent
Andujar Linares et al.

(10) Patent No.: US 10,062,973 B2
(45) Date of Patent: Aug. 28, 2018

(54) SCATTERED VIRTUAL ANTENNA TECHNOLOGY FOR WIRELESS DEVICES

(71) Applicant: Fractus, S.A., Barcelona (ES)

(72) Inventors: Aurora Andujar Linares, Barcelona (ES); Jaume Anguera Pros, Vinaros (ES)

(73) Assignee: Fractus Antennas, S.L., Barcelona (ES)

( * ) Notice: Subject to any disclaimer, the term of this patent is extended or adjusted under 35 U.S.C. 154(b) by 524 days.

(21) Appl. No.: 14/308,175

(22) Filed: Jun. 18, 2014

(65) Prior Publication Data

US 2014/0375521 A1 Dec. 25, 2014

Related U.S. Application Data

(60) Provisional application No. 61/837,265, filed on Jun. 20, 2013.

(51) Int. Cl.
*H01Q 21/30* (2006.01)
*H01Q 1/26* (2006.01)
(Continued)

(52) U.S. Cl.
CPC ..... *H01Q 21/30* (2013.01); *H01Q 1/243* (2013.01); *H01Q 3/2623* (2013.01); *H01Q 5/335* (2015.01)

(58) Field of Classification Search
CPC ..... H01Q 1/243; H01Q 5/50; H01Q 21/30; H01Q 5/335
See application file for complete search history.

(56) References Cited

U.S. PATENT DOCUMENTS 6,281,850 B1 8/2001 Klostermann
6,762,723 B2 7/2004 Nallo
(Continued)

FOREIGN PATENT DOCUMENTS

EP 1280230 A1 1/2003
JP 2002223114 8/2002
(Continued)

OTHER PUBLICATIONS

Andujar, A., et al., "Distributed antenna systems for wireless handheld devices robust to hand loading," IEEE on Antennas and Propagation, vol. 60. No. 10, pp. 4830-4837 (Oct. 2012).
(Continued)

*Primary Examiner* — Jessica Han
*Assistant Examiner* — Amal Patel
(74) *Attorney, Agent, or Firm* — Edell, Shapiro & Finnan LLC

(57) ABSTRACT

A wireless device includes at least one radiating system having a redundancy system and a combining system. The redundancy system includes two or more radiation boosters. The radiating system is characterized by its simplicity that facilitates its integration within the wireless device and achieves enhanced radio-electric performance in at least one frequency region of the electromagnetic spectrum, which may include multiple wireless services. The combining system enables a substantially balanced power distribution among the radiation boosters of the redundancy system, and the radiating system provides an increased robustness to human loading effects in at least one frequency region of operation.

6 Claims, 27 Drawing Sheets

(51) Int. Cl.

| | |
|---|---|
| ***H01Q 1/24*** | (2006.01) |
| ***H01Q 3/26*** | (2006.01) |
| ***H01Q 5/335*** | (2015.01) |

(56) References Cited

U.S. PATENT DOCUMENTS

| | | | | |
|---|---|---|---|---|
| 6,795,027 | B2 * | 9/2004 | Boyle | H01Q 1/243 343/702 |
| 6,873,299 | B2 | 3/2005 | Dakeya | |
| 7,274,340 | B2 | 9/2007 | Ozden | |
| 7,421,321 | B2 | 9/2008 | Breed et al. | |
| 9,112,284 | B2 | 8/2015 | Andujar Linares et al. | |
| 9,379,443 | B2 | 6/2016 | Anguera Pros et al. | |
| 2002/0000937 | A1 | 1/2002 | Kozakai | |
| 2003/0063036 | A1 | 4/2003 | Sato et al. | |
| 2004/0198473 | A1 | 10/2004 | Tran | |
| 2005/0001778 | A1 | 1/2005 | Le et al. | |
| 2006/0214856 | A1 | 9/2006 | Nakano et al. | |
| 2007/0146212 | A1 | 6/2007 | Ozden | |
| 2008/0018543 | A1 | 1/2008 | Baliarda | |
| 2009/0318094 | A1 * | 12/2009 | Pros | H01Q 1/245 455/75 |
| 2010/0176999 | A1 * | 7/2010 | Anguera | H01Q 1/243 343/702 |
| 2011/0117976 | A1 | 5/2011 | Nishikido et al. | |
| 2013/0342416 | A1 | 12/2013 | Andujar Linares et al. | |

FOREIGN PATENT DOCUMENTS

| | | | |
|---|---|---|---|
| JP | 2005175846 | | 6/2005 |
| JP | 2006279159 | | 10/2006 |
| WO | 2006024516 | A1 | 9/2006 |
| WO | 2007/128340 | A1 | 11/2007 |
| WO | 2007/141187 | A2 | 12/2007 |
| WO | 2008/045151 | A1 | 4/2008 |
| WO | 2008/119699 | A1 | 10/2008 |
| WO | 2010/015364 | A2 | 2/2010 |
| WO | 2010/015365 | A2 | 2/2010 |
| WO | 2012017013 | | 2/2012 |

OTHER PUBLICATIONS

Andujar, A., et al., "Ground plane boosters to provide multi-band operation in wireless handheld devices," 5th European Conference on Antennas and Propagation (EUCAP 2011), pp. 599-603 (Apr. 11, 2011).

Andujar, A., et al., "Ground plane boosters as a compact antenna technology for wireless handheld devices," IEEE Transactions on Antennas and Propagation, vol. 59. No. 5, pp. 1668-1677 (May 2011).

Andujar, A., "Ground plane booster antenna technology for wireless handheld devices," (PD Thesis), Universitat Politecnica de Catalunya—Fractus. (May 2013).

Andujar, A., et al., "In-phase versus out-of-phase distributed antenna systems for wireless handheld devices," IEEE Transactions on Antennas and Propagation. vol. 61. No. 1, pp. 346-353 (Jan. 2013).

Andujar, A., et al., "Non-resonant elements with a simplified radiofrequency system for handset devices," 7th European Conference on Antennas and Propagation (EUCAP 2013), pp. 1848-1858 (Apr. 1, 2013).

Anguera, J., et al., "Handset antenna array to mitigate the finger loading effect," 5th European Conference on Antennas and Propagation (EUCAP 2011), pp. 635-638 (Apr. 12, 2011).

Anguera, J., et al., "Mitigation of the finger loading effect in handset antennas," 4th European Conference on Antennas and Propagation (EUCAP 2010), pp. 1-4 (Apr. 14, 2010).

Camps, A., "Distributed antenna system for devices mobile / wireless," Universitat Ramon Llull—La Salle (thesis), (Nov. 2007).

Chaudhury, S. K., et al., "Novel MIMO antennas for mobile terminal," 38th European Microwave Conference (EuMC), pp. 1751-1754 (Oct. 27, 2008).

Cobo, Y., "Distributed antenna system robust to the human body for mobile devices," Universitat Ramon Llull (URL)—La Salle (Nov. 2010).

Díaz, V., "Multiband antenna techniques miniature robust proximity to the human body for mobile devices," Universitat Ramon Llull (URL)—La Salle (2010).

Leiva, JL, "Analysis and design of distributed antenna systems robust to the effects of the hand—Analisis y diseño de sistemas distribuidos de antenas robustos a los efectos de la mano," Universitat Ramon LLull (URL)—La Salle (Jan. 2011).

Rahola, J., "Characteristic mode analysis: eigenvalue analysis of antenna structures," Nokia (Oct. 2007).

Rahola, J., and Ollikainen, J., "Optimal antenna placement for mobile terminals using characteristic mode analysis," 1st European Conference on Antennas and Propagation (EUCAP 2006), Nice (Nov. 2006).

Rao, Q. and Wen, G., "Ultra-small cubic folded strip antenna for handset devices," IEEE International Symposium Antennas and Propagation Society (APS), pp: 1-4 (Jul. 11, 2008).

Valkonen, R., et al., "Dual-feed, single-CCE antenna facilitating inter-band carrier aggregation in LTE-A handsets," 7th European Conference on Antennas and Propagation (EUCAP 2013), pp. 3784-3788 (Apr. 2013).

Valkonen, R., et al., "Compensation of finger effect on a mobile terminal antenna by antenna selection," International Conference on Electromagnetics in Advanced Applications (ICEAA), Torino, pp. 364-367 (Sep. 2011).

Chen, Z.N.,a nd K.M. Luk (Eds.), "Antennas for Base Stations in Wireless Communications," Communication engineering, New York: McGraw-Hill (2009).

White Paper: "Overcoming the RF Challenges of Full-Screen Smartphones," www.qorvo.com, pp. 1-7 (Feb. 2018).

* cited by examiner

SCATTERED VIRTUAL ANTENNA TECHNOLOGY FOR WIRELESS DEVICES

CROSS REFERENCE TO RELATED APPLICATIONS

This application claims priority under 35 U.S.C. § 119(e) from U.S. Provisional Patent Application Ser. No. 61/837,265, filed Jun. 20, 2013, and entitled "Scattered Virtual Antenna Technology For Wireless Devices," the entire contents of which are hereby incorporated by reference.

FIELD OF THE INVENTION

The present invention relates to the field of wireless devices, which require the transmission and/or reception of electromagnetic wave signals.

BACKGROUND

Wireless devices typically operate at one or more cellular communication standards, and/or wireless connectivity standards, and/or broadcast standards, each standard being allocated in one or more frequency bands, and said frequency bands being contained within one or more regions of the electromagnetic spectrum.

For that purpose, a typical wireless device must include a radiating system capable of operating in one or more frequency regions with an acceptable radio-electric performance (in terms of for instance input impedance level, impedance bandwidth, gain, efficiency, or radiation pattern). Moreover, the integration of the radiating system within the wireless device must be effective to ensure that the overall wireless device attains a good radio-electric performance (such as for example in terms of radiated power, received power, sensitivity or SAR (Specific Absorption Rate)) when human loading effects are considered.

Additionally, a space within the wireless device is usually limited and the radiating system has to be included in the available space. The radiating system is expected to be small enough to occupy as little space as possible within the device, which then allows for smaller devices, or for the addition of more specific components and functionalities into the device. At the same time, it is sometimes required for the radiating system to be flat since this allows for slim devices. Thus, many of the demands for wireless devices also translate to specific demands for the radiating systems thereof.

This is even more critical in the case in which the wireless device is a multifunctional wireless device. Commonly-owned patent applications WO2008/009391 and US2008/0018543, incorporated herein by reference in their entireties, describe a multifunctional wireless device.

For a good wireless connection, high efficiency is further required. Other more common design demands for radiating systems are the voltage standing wave ratio (VSWR) and the impedance which is supposed to be about 50 ohms.

Other demands for radiating systems for wireless handheld or portable devices are competitive cost and a low SAR.

Furthermore, a radiating system has to be integrated into a device or in other words, a wireless device has to be constructed such that an appropriate radiating system may be integrated therein which puts additional constraints by consideration of the mechanical fit, the electrical fit, and the assembly fit.

Of further importance, usually, is the robustness of the radiating system which means that the radiating system does not change its properties upon smaller shocks to the device and the human loading.

Besides electromagnetic functionality, small size, cost and reduced interaction with the human body (such as for instance SAR), one of the current limitations of the prior-art is that generally the antenna system is customized for every particular wireless handheld device model. The mechanical architecture of each model is different and the volume available for the antenna severely depends on the form factor of the wireless device model together with the arrangement of the multiple components embedded into the device (e.g., displays, keyboards, battery, connectors, cameras, flashes, speakers, chipsets, memory devices, etc.). As a result, the antenna within the device is mostly designed ad hoc for every model, resulting in a higher cost and a delayed time to market.

A radiating system for a wireless handheld or portable device typically includes a radiating structure comprising an antenna element which operates in combination with a ground plane layer providing a determined radioelectric performance in one or more frequency regions of the electromagnetic spectrum. This is illustrated in FIG. 1, in which it is shown a conventional radiating structure 10 comprising an antenna element 11 and a ground plane layer 12. Typically, the antenna element has a dimension close to an integer multiple of a quarter of the wavelength at a frequency of operation of the radiating structure, so that the antenna element is at resonance or substantially close to resonance at said frequency and a radiation mode is excited on said antenna element.

In some cases, the antenna element acting in cooperation with the ground plane does not attain sufficient impedance bandwidth as for covering multiple wireless standards and complex matching network must be added between the antenna element and the input/output port in order to increase said impedance bandwidth.

In addition, antenna elements operating in multiple frequency bands allocated at different regions of the electromagnetic spectrum usually presents a complex mechanical designs and considerable dimensions, mainly due to the fact that antenna performance is highly related to the electrical dimensions of the antenna element.

A further problem associated to the integration of the radiating structure, and in particular to the integration of the antenna element in a wireless device is that the volume dedicated for such an integration has continuously shrunk with the appearance of new smaller and/or thinner form factors for wireless devices, and with the increasing convergence of different functionalities in a same wireless device.

Some techniques to miniaturize and/or optimize the multiband behavior of an antenna element have been described in the prior art. However the radiating structures described therein still rely on exciting a radiation mode on the antenna element for each one of the frequency bands of operation. This fact leads to complex mechanical designs and large antennas that usually are very sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the radiating element, and/or to the human loading. A multiband antenna system is sensitive to any of the above mentioned aspects because they may alter the electromagnetic coupling between the different geometrical portions of the radiating element, which usually translates into detuning effects, degradation of the radio-electric performance of the antenna system and/or the radio-electric performance wireless device, and/or greater interaction with the user (such as an increased level of SAR).

In this sense, a radiating system such as the one described in the present invention not requiring a complex and/or large antenna formed by multiple arms, slots, apertures and/or openings and a complex mechanical design is preferable in order to minimize such undesired external effects and simplify the integration within the wireless device.

Some other attempts have focused on antenna elements not requiring a complex geometry while still providing some degree of miniaturization by using an antenna element that is not resonant in the one or more frequency ranges of operation of the wireless device.

For example, WO2007/128340, incorporated herein by reference in its entirety, discloses a wireless portable device comprising a non-resonant antenna element for receiving broadcast signals (such as, for instance, DVB-H, DMB, T-DMB or FM). The wireless portable device further comprises a ground plane layer that is used in combination with said antenna element. Although the antenna element has a first resonant frequency above the frequency range of operation of the wireless device, the antenna element is still the main responsible for the radiation process and for the electromagnetic performance of the wireless device. This is clear from the fact that no radiation mode can be excited on the ground plane layer because the ground plane layer is electrically short at the frequencies of operation (i.e., its dimensions are much smaller than the wavelength). For this kind of non-resonant antenna elements, a matching circuitry is added for matching the antenna to a level of VSWR in a limited frequency range which in this particular case can be around VSWR≤6. Such level of VSWR together with the limited bandwidth result in antenna elements which are only acceptable for reception of electromagnetic wave signals but not desirable for transmission of electromagnetic wave signals. With such limitations, while the performance of the wireless portable device may be sufficient for reception of electromagnetic wave signals (such as those of a broadcast service), the antenna element could not provide an adequate performance (for example, in terms of input return losses or gain) for a communication standard requiring also the transmission of electromagnetic wave signals.

Commonly-owned patent application WO2008/119699, incorporated herein by reference in its entirety, describes a wireless handheld or portable device comprising a radiating system capable of operating in two frequency regions. The radiating system comprises an antenna element having a resonant frequency outside said two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonant frequency of the antenna element and a resonant frequency of the ground plane layer in order for the radiating system to operate properly in said two frequency regions. Nevertheless, the solution still relies on an antenna element whose size is related to a resonant frequency that is outside of the two frequency regions but it is close to such frequency regions and on a complex matching network including resonators and filters for each frequency region of operation.

Other attempts for covering several frequency bands allocated in a particular frequency region of the electromagnetic spectrum rely on the use of antenna elements distributed along the ground plane of a wireless handheld or portable device as disclosed in a commonly-owned patent application WO2007/141187, incorporated herein by reference in its entirety. Each one of the antenna elements of said distributed antenna system resonates or substantially resonates at a frequency within a first frequency region of the electromagnetic spectrum. The antenna elements are combined by a phase shifting element that provides a phase difference among the radiating elements, which results in a wide bandwidth. According to the invention, the combination of two or more small antenna elements makes it possible to keep small the contribution of the ground-plane, which makes it possible to reduce the overall influence of the hand loading effects. Such combination of the antenna elements may not guaranty a balanced power distribution among the antenna elements and therefore the influence of the hand loading is dependent on its position on the said small antenna elements.

Another limitation of current wireless handheld or portable devices relates to the fact that the design and integration of an antenna element for a radiating structure in a wireless device is typically customized for each device. Different form factors or platforms, or a different distribution of the functional blocks of the device will force to redesign the antenna element and its integration inside the device almost from scratch.

For at least the above reasons, wireless device manufacturers regard the volume dedicated to the integration of the radiating structure, and in particular the antenna element, as being a toll to pay in order to provide wireless capabilities to the handheld or portable device.

In order to reduce as much as possible the volume occupied into the wireless handheld or portable device, recent trends in handset antenna design are oriented to maximize the contribution of the ground plane to the radiation process by using very small non-resonant elements. However, non-resonant elements usually are forced to include a complex radiofrequency system. Thus, the challenge of these techniques mainly relies on said complexity (combination of inductors, capacitors, and transmission lines), which is required to satisfy impedance bandwidth and efficiency specifications.

Commonly owned patent applications, WO2010/015365 and WO2010/015364, incorporated herein by reference in their entireties, are intended for solving some of the aforementioned drawbacks. Namely, they describe a wireless handheld or portable device comprising a radiating system including a radiating structure and a radiofrequency system. The radiating structure is formed by a ground plane layer presenting suitable dimensions as for supporting at least one efficient radiation mode and at least one radiation booster capable of coupling electromagnetic energy to said ground plane layer. The radiation booster is not resonant in any of the frequency regions of operation and consequently a radiofrequency system is used to properly match the radiating structure to the desired frequency bands of operation.

More particularly, in WO2010/015364 each radiation booster is intended for providing operation in a particular frequency region. Thus, the radiofrequency system is designed in such a way that the first internal port associated to the first radiation booster is highly isolated from the second internal port associated to a second radiation booster. Said radiofrequency system usually comprises a matching network including resonators for each one of the frequency regions of operation and a set of filters for each one of the frequency regions of operation. Thus, said radiofrequency system requires multiple stages and the performance of the radiating systems in terms of efficiency may be affected by the additional losses of the components. As each radiation booster is intended for providing operation in a particular frequency region, the bandwidth capabilities may be limited for some applications requiring very wide bandwidth specially at the low frequency region, as for example for wireless devices operating at LTE700, GSM850 and GSM900. Additionally, such radiating systems do not provide a redundancy mechanism for minimizing the human loading effects.

Another technique, as disclosed in U.S. Pat. No. 7,274,340, is based on the use of non-resonant elements where the impedance matching is provided through the addition of two matching circuits. Despite the use of non-resonant elements, the size of the element for the low band is significantly large, being 1/9.3 times the free-space wavelength of the lowest frequency for the low frequency band. Due to such size, the low band element would be a resonant element at the high band. Additionally, the operation of this solution is closely linked to the alignment of the maximum E-field intensity of the ground plane and the coupling element. The size of the low band element undesirably contributes to increase the printed circuit board (PCB) space required by the antenna module. According to the invention, the bandwidth at the low frequency region is 133 MHz (from 824 MHz to 954 MHz) that is insufficient for some applications requiring very wide bandwidth specially at the low frequency region, as for example for wireless devices operating at LTE700, GSM850 and GSM900. Additionally, such radiating systems do not provide a redundancy mechanism for minimizing the human loading effects Therefore, a wireless device not requiring an antenna element and including a redundancy system, comprising several radiation boosters and a simple combining means would be advantageous to make simpler the integration of the radiating structure into the wireless device, increase the robustness to human loading effects and provide enhanced radio-electric operation to operate in more wireless services. The volume freed up by the absence of a large and complex antenna element would enable smaller and/or thinner devices, or even to adopt radically new form factors (such as for instance elastic, stretchable and/or foldable devices) which are not feasible today due to the presence of an antenna element featured by a considerable volume. Furthermore, by eliminating precisely the element that requires customization, a standard solution is obtained which only requires minor adjustments to be implemented in different wireless devices.

SUMMARY

It is an object of the present invention to provide a wireless device (such as for instance but not limited to a mobile phone, a smartphone, a PDA, an MP3 player, a headset, a USB dongle, a laptop computer, a tablet, a gaming device, a GPS system, a digital camera, a PCMCIA, Cardbus 32 card or a sensor, or generally a multifunction wireless device) which attains the transmission and/or reception of electromagnetic wave signals trough the proper combination into a single input/output port of the frequency responses of several radiation boosters strategically arranged along the ground plane of a wireless device.

It is another object of the invention to provide a scattered virtual antenna technology which is included within said wireless device, adds redundancy to the operation and it does not require customization.

Another object of the invention refers to a wireless device configured to operate at multiple frequency regions of the electromagnetic spectrum with enhanced radio-electric performance and increased robustness to human loading effects.

Another object of the invention relates to a method to enable the operation of a wireless device in multiple frequency regions of the electromagnetic spectrum with enhanced radio-electric performance, and increased robustness to human loading effects.

Radiating structures comprising two or more radiation boosters strategically arranged along a ground plane which supports an efficient radiation mode become preferable for reducing the space taken up within the wireless device and not requiring customization. These facts allow and simplify the integration of other components and functionalities inside the wireless device.

In this sense, a further object of the present invention is focused on providing a simple combining means, which in combination with radiation boosters provides operation in multiple frequency regions of the electromagnetic spectrum and guaranties a substantially balanced power distribution among the radiation boosters.

In order to solve aforementioned drawbacks, the present invention provides a wireless device including at least one radiating system; the at least one radiating system comprising a redundancy system and a combining system; the redundancy system including two or more radiation boosters. With the present invention, an enhanced radio-electric performance in at least one frequency region of the electromagnetic spectrum, which may include multiple wireless services, is achieved. Furthermore, said combining system enables a substantially balanced power distribution among the radiation boosters of the redundancy system, and the radiating system contribute to provide an increased robustness to human loading effects in at least one frequency region of operation. In this sense, a radiating system according to the present invention is characterized by its simplicity that facilitates its integration within the wireless device.

A wireless device according to the present invention operates in multiple communication standards, namely multiple cellular communication standards (such as for example LTE700, GSM 850, GSM 900, GSM 1800, GSM 1900, UMTS, HSDPA, CDMA, WCDMA, LTE2100, LTE2300, LTE2500, CDMA2000, TD-SCDMA, etc.), wireless connectivity standards (such as for instance WiFi, IEEE802.11 standards, Bluetooth, ZigBee, UWB, WiMAX, WiBro, or other high-speed standards), and/or broadcast standards (such as for instance FM, DAB, XDARS, SDARS, DVB-H, DMB, T-DMB, or other related digital or analog video and/or audio standards), each standard being allocated in one or more frequency bands, and said frequency bands being contained within at least one frequency region of the electromagnetic spectrum, and provides an increased robustness to human loading effects.

A wireless device according to the present invention comprises at least one radiating system which provides an enhanced radio-electric performance to provide operation in at least one frequency region of the electromagnetic spectrum which includes multiple cellular communication standards, multiple wireless connectivity standards or multiple broadcast standards.

A wireless device according to the present invention provides VSWR and efficiency levels which ensure its operation in multiple standards within at least one frequency region in the presence of human loading.

A wireless device according to the present invention includes at least one radiating system transmitting and receiving electromagnetic wave signals in at least two frequency bands allocated in a frequency region of the electromagnetic spectrum.

A wireless device according to the present invention includes multiple radiating systems operating in multiple frequency regions of the electromagnetic spectrum.

In the context of this document, a frequency band preferably refers to a range of frequencies used by a particular cellular communication standard, a wireless connectivity standard, a broadcast standard or any other wireless service involving the transmission and reception of information between at least two wireless devices; while a frequency region preferably refers to a continuum of frequencies of the electromagnetic spectrum. For example, the GSM 1800 standard is allocated in a frequency band from 1710 MHz to 1880 MHz while the GSM 1900 standard is allocated in a frequency band from 1850 MHz to 1990 MHz. A wireless device operating the GSM 1800 and the GSM 1900 standards must have a radiating system capable of operating in a frequency region from 1710 MHz to 1990 MHz. As another example, a wireless device operating the GSM 1800 standard and the UMTS standard (allocated in a frequency band from 1920 MHz to 2170 MHz), must have a radiating system capable of operating in two separate frequency regions.

The wireless device according to the present invention may have a candy-bar shape, which means that its configuration is given by a single body (e.g. a smartphone). It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated around two or more axes of rotation which are preferably not parallel). Also, the present invention makes it possible for radically new form factors, such as for example devices made of elastic, stretchable and/or foldable materials.

For a wireless device which is slim and/or whose configuration comprises two or more bodies, the requirements on maximum height of the antenna element are very stringent, as the maximum thickness of each of the two or more bodies of the device may be limited to 5, 6, 7, 8, 9, 10, 11, 12, or 15 mm.

The technology disclosed herein makes it possible for a wireless device to feature an enhanced radio-electric performance and increased robustness to human loading effects by properly exciting an effective ground plane radiation mode through a redundancy system without requiring a resonant antenna which may be featured by a complex geometry, a complicated mechanical setup and/or an arduous integration within the wireless device.

The technology disclosed herein provides levels of VSWR and efficiency in the presence of human loading which guaranties the operation of the wireless device in multiple frequency bands while the wireless device keeps an advantageous battery life. Therefore, the battery life is not degraded by the human loading effects. Also, the wireless device according to the present invention minimizes eventual call drops due to human loading effects.

In accordance with the present invention, the wireless device includes a radiating system capable of transmitting and receiving electromagnetic wave signals in at least one frequency region of the electromagnetic spectrum. Said radiating system comprises a redundancy system comprising: at least one ground plane layer capable of supporting at least one radiation mode, the at least one ground plane layer including at least two connection points; at least two radiation boosters to couple electromagnetic energy from/to the at least one ground plane layer and at least two internal ports. A first radiation booster includes a first connection point and a second radiation booster includes a second connection point. A first internal port is defined between the connection point of the first radiation booster and one of the at least two connection points of the at least one ground plane layer. The second internal port is defined between the connection point of the second radiation booster and one of the at least two connection points of the at least one ground plane layer. The radiating system further comprises a combining system that combines the first radiation booster with the second radiation booster and guaranties a substantially balanced power distribution between the first and second radiation boosters. The combining system further comprises a port connected to an external port of the radiating system, namely to an input/output port.

In the context of this document, a radiation booster is defined as an element that presents a first resonant frequency placed substantially above the frequency region of operation. Said first resonant frequency is measured at the internal port of the redundancy system when the combining system is disconnected. Said internal port is defined between a connection point of the radiation booster and a connection point of the ground plane layer. The radiation booster is then a non-resonant element in the frequency region of operation.

In the context of this document, a resonant frequency associated to an internal port of a redundancy system preferably refers to a frequency at which the input impedance measured at said internal port of the redundancy system, when disconnected from the combining system, has an imaginary part substantially equal to zero.

In some further examples, for at least some of, or even all, the internal ports of the redundancy system, the ratio between the first resonant frequency at a given internal port of the redundancy system when disconnected from the combining system and the smallest frequency of said frequency region is preferably larger than a certain minimum ratio. Some possible minimum ratios are 2, 2.5, 3.0, 3.4, 3.8, 4.0, 4.2, 4.4, 4.6, 4.8, 5.0, 5.2, 5.4, 5.6, 5.8, 6.0, 6.2, 6.6 or 7.0.

With each radiation booster being so small, and with the redundancy system including said at least two radiation boosters and the radiating system operating in a frequency range much lower than the first resonant frequency at each internal port associated to each radiation booster, the input impedance of the redundancy system (measured at each internal port when the combining system is disconnected) features an important reactive component (either capacitive or inductive) within the range of frequencies of the frequency region of operation. That is, the input impedance of the redundancy system at each internal port when disconnected from the combining system has an imaginary part not equal to zero for any frequency of the frequency region of operation.

In accordance with a second aspect of the present invention, the wireless device includes two radiating systems capable of transmitting and receiving electromagnetic wave signals in at least two frequency regions of the electromagnetic spectrum: a first frequency region and a second frequency region, wherein preferably the highest frequency of the first frequency region is lower than the lowest frequency of the second frequency region. The first radiating system is associated to the operation of the wireless device in the first frequency region and comprises: a first redundancy system; a first combining system; and a first external port. The second radiating system is associated to the operation of the wireless device at the second frequency region and comprises: a second redundancy system; a second combining system; and a second external port. Each redundancy system comprising: at least one ground plane layer capable of supporting at least one radiation mode, the at least one ground plane layer including at least two connection points; at least two radiation boosters to couple electromagnetic energy from/to the at least one ground plane layer; and at least two internal ports. A first radiation booster includes a first connection point and a second radiation booster includes a second connection point. A first internal port is defined between the connection point of the first radiation booster and one of the at least two connection points of the at least one ground plane layer. The second internal port is defined between the connection point of the second radiation booster and one of the at least two connection points of the at least one ground plane layer. Each combining system combines the first radiation booster with the second radiation booster and guaranties a substantially balanced power distribution between the first and second radiation boosters. The first combining system further comprises a port connected to an external port of the first radiating system, namely to an input/output port. The second combining system further comprises a port connected to an external port of the second radiating system, namely to an input/output port. Although the ground planes of different redundancy systems may be implemented for instance by means of different conducting structures, in some preferred embodiments two redundancy systems share the same conducting structure for a ground plane. For instance, a mobile phone or a handheld device according to the present invention embeds two redundancy systems including four or more radiation boosters that share a same ground plane in the form of a ground plane layer within a printed circuit board (PCB).

In the context of this document operation in at least two frequency regions means that each radiating system operates in at least one frequency band allocated in each one of the frequency regions of operation.

In accordance with a third aspect of the present invention, the wireless device includes multiple radiating systems capable of transmitting and receiving electromagnetic wave signals in multiple frequency regions of the electromagnetic spectrum. Each radiating system is related to the operation of the wireless device in one frequency region and comprises a redundancy system, a combining systems and an external port. Each redundancy and combining systems are characterized as described above for the wireless device including two radiating systems. Although the ground planes of different radiating systems may be implemented for instance by means of different conducting structures, in some preferred embodiments multiple radiating systems share the same conducting structure for a ground plane. For instance, a mobile phone or a handheld device according to the present invention embeds multiple redundancy systems that share a same ground plane in the form of a ground plane layer within a printed circuit board (PCB).

In this text, a port of the redundancy system is referred to as an internal port; while a port of the radiating system is referred to as an external port. In this context, the terms "internal" and "external" when referring to a port are used simply to distinguish a port of the redundancy system from a port of the radiating system, and carry no implication as to whether a port is accessible from the outside or not.

In some examples, a frequency region of operation of a radiating system is preferably one of the following (or contained within one of the following): 80-120 MHz, 180-220 MHz, 470-800 MHz, 690-960 MHz, 1710-2690 MHz, 2.4-2.5 GHz, 3.4-3.6 GHz, 4.9-5.875 GHz, or 3.1-10.6 GHz.

The combining system comprises at least two ports, each one connected to one internal port of the redundancy system (i.e. the redundancy system comprises at least two internal ports), and a port connected to the external port of the radiating system. Said combining system combines the radiation boosters comprised in the redundancy system, guaranties a substantially balanced power distribution among the radiation boosters of the redundancy system, and provides impedance matching to the radiating system in the frequency region of operation of the radiating system. Namely, the combining system allows the operation of the radiating system in at least two frequency bands, which are allocated in one frequency region of the electromagnetic spectrum.

In some cases the combining system comprises a first reactance cancellation element, a second reactance cancellation element, a first delay module, a second delay module, and a fine tuning circuit. The first reactance cancellation element is connected to the first internal port and the second reactance cancellation element is connected to the second internal port. The first delay module is connected to the first reactance cancellation element and the second delay module is connected to the second reactance cancellation element. The fine tuning circuit is interconnected between the first delay module, the second delay module, and a port connected to the external port of the radiating system. The fine tuning circuit helps to fine tune the impedance measured at the external port for matching purposes. In some examples, said fine tuning circuit is not required.

In some examples the combining means comprises a first reactance cancellation element, a second reactance cancellation element, a first broadband matching circuit, a second broadband matching circuit, a first delay module, a second delay module, and a fine tuning circuit. The first reactance cancellation element is connected to the first internal port and the second reactance cancellation element is connected to the second internal port. The first broadband matching circuit is connected to the first reactance cancellation element and the second broadband matching circuit is connected to the second reactance cancellation element. The first delay module is connected to the first broadband matching circuit and the second delay module is connected to the second broadband matching circuit. The fine tuning circuit is interconnected between the first delay module, the second delay module, and a port connected to the external port of the radiating system. In some examples, said fine tuning circuit is not required.

In some cases the combining means comprises a first reactance cancellation element, a second reactance cancellation element, a first delay module, a second delay module, a broadband matching circuit and a fine tuning circuit. The first reactance cancellation element is connected to the first internal port and the second reactance cancellation element is connected to the second internal port. The first delay module is connected to the first reactance cancellation element and the second delay module is connected to the second reactance cancellation element. The broadband matching circuit is interconnected between the first delay module, the second delay module, and a port connected to a port of the fine tuning circuit. The fine tuning circuit is interconnected between the broadband matching circuit and a port connected to the external port of the radiating system.

In some examples, said fine tuning circuit is not required, and the broadband matching circuit is interconnected between the first delay module, the second delay module, and a port connected to the external port of the radiating system.

In some embodiments, the combining system comprises first and second delay modules resulting in a first impedance being out-of-phase of a second impedance. In the present invention such characteristic is referred as an out-of-phase feeding scheme. The first impedance is measured at a port of the first delay module; the second impedance is measured at a port of the second delay module; and such ports being used to interconnect the first and second delay modules to a broadband matching circuit, or to a fine tuning circuit or to a port connected to an external port of the radiating system. Said first and second delay modules are selected to minimize the reflection coefficient measured at the external port of the radiating system in the frequency region of operation when both input impedances are combined into a single input/output port, and to guaranty a substantially balanced power distribution among the radiation boosters of the redundancy system.

In the context of this document, the first impedance is out-of-phase of the second impedance when an out-of-phase difference (absolute value) is between 45° and 315°; and the out-of-phase difference is computed as a phase difference between an average of a first reflection coefficient and an average of a second reflection coefficient. The first reflection coefficient is the reflection coefficient corresponding to the first impedance and the second reflection coefficient is the reflection coefficient of the second impedance. The average of the first reflection coefficient is computed as the average of the first reflection coefficient for three frequencies of the operating frequency region; being the three frequencies the minimum, the central and the maximum frequencies of the operating frequency region. The average of the second reflection coefficient is computed as the average of the second reflection coefficient for three frequencies of the operating frequency region; being these three frequencies the same frequencies used for computing the average of the first reflection coefficient.

In some cases the out-of-phase combining system is also characterized by an average resistance of the first impedance differing from an average resistance of the second impedance by less than 30%. The average resistance of the first impedance is computed as the average of a real part of the first impedance for three frequencies of the operating frequency region; being the three frequencies the minimum, the middle and the maximum frequencies of the operating frequency region. The average resistance of the second impedance is computed as the average of a real part of the second impedance for three frequencies of the operating frequency region; being these three frequencies the same frequencies used for computing the average resistance of the first impedance.

In some cases the combining system comprises a first delay module and a second delay resulting in a first impedance being in-phase of the second impedance. In the present invention, such characteristic is referred as an in-phase feeding scheme. The first impedance is measured at a port of the first delay module; the second impedance is measured at a port of the second delay module; and such ports being used to interconnect the first and second delay modules to a broadband matching circuit, or to a fine tuning circuit or to a port connected to an external port of the radiating system. Said first and second delay modules are selected to minimize the reflection coefficient measured at the external port of the radiating system in the frequency region of operation when both input impedances are combined into a single input/output port, and to guaranty a substantially balanced power distribution among radiation boosters of the redundancy system.

In the context of this document, the first impedance is in-phase of the second impedance when an in-phase difference (absolute value) is smaller than 45°(<45°), or when the in-phase difference (absolute value) is larger than 315° and smaller or equal than 360° (>315°, ≤360°); the in-phase difference is computed as a phase difference between an average of a first reflection coefficient and an average of a second reflection coefficient. The first reflection coefficient is the reflection coefficient corresponding to the first impedance and the second reflection coefficient is the reflection coefficient of the second impedance. The average of the first reflection coefficient is computed as the average of the first reflection coefficient for three frequencies of the operating frequency region; being the minimum, the middle and the maximum frequencies of the operating frequency region. The average of the second reflection coefficient is computed as the average of the second reflection coefficient for three frequencies of the operating frequency region; being these three frequencies the same frequencies used for computing the average of the first reflection coefficient.

In some cases the in-phase combining system is also characterized by an average resistance of the first impedance differing from an average resistance of the second impedance by less than 30%. The average resistance of first impedance is computed as the average of a real part of the first impedance for three frequencies of the operating frequency region; being the minimum, the middle and the maximum frequencies of the operating frequency region. The average resistance of second impedance is computed as the average of the real part of the second impedance for three frequencies of the operating frequency region; being these three frequencies the same frequencies used for computing the average of the first reflection coefficient.

In accordance with an aspect of the invention, the redundancy system comprises at least two radiation boosters for proving the operation of the wireless device in one frequency region of the electromagnetic spectrum, and a combining system to guaranty a substantially balanced power distribution among the radiation boosters in the redundancy system. Said two factors advantageously contribute to increase the robustness of the wireless device to human loading effects. In some cases, the user blocks one of the radiation boosters with a finger, but as the redundancy system comprises two or more radiation boosters, the non-blocked radiation boosters guaranty the operation of the wireless device. Furthermore, as the combining system ensures a substantially balanced power distribution among the radiation boosters of the redundancy system, the operation of the wireless device is independent of which of the radiation booster is blocked by the user. Therefore, the radiation efficiency of the radiating system is not significantly affected by the radiation booster blocked by the user. Further, independently of which of the radiation boosters is blocked by the user, the radiating system is characterized by substantially similar levels of radiation efficiency. Further, the radiating system provides substantially similar levels of radiation efficiency for any blocked radiation booster by the user.

In this sense, the consequences of not having a substantially balanced power distribution between said radiation boosters results in a degradation of the operation of the wireless device, since its operation depends on which one of the said radiation boosters is blocked by the user. Not having a substantially balanced power distribution between the radiation boosters may result in a degradation of the radiation efficiency, which may decrease the battery life and cause call drops.

Said reactance cancellation elements can be either capacitive or inductive as a function of the impedance response measured at each internal port of the redundancy system. In this sense, if the input impedance measured at an internal port of the redundancy system presents an inductive behavior, a capacitive reactive element is preferred to compensate said inductive behavior in the frequency region of operation, whereas if the input impedance measured at an internal port of the redundancy system presents a capacitive behavior, an inductive reactive element is preferred to compensate said capacitive behavior in said frequency region of operation.

In the context of this document, reactance cancellation preferably refers to compensate the imaginary part of the input impedance at an internal port of the redundancy system when disconnected from the combining system so that the input impedance of the radiating system at an external port has an imaginary part substantially close to zero for a frequency preferably within a frequency region of operation. In some less preferred examples, said frequency may also be higher than the highest frequency of said frequency region (although preferably not higher than 1.1, 1.2, 1.3 or 1.4 times said highest frequency) or lower than the lowest frequency of said frequency region (although preferably not lower than 0.9, 0.8 or 0.7 times said lowest frequency). Moreover, the imaginary part of an impedance is considered to be substantially close to zero if it is not larger (in absolute value) than 15 Ohms, and preferably not larger than 10 Ohms, and more preferably not larger than 5 Ohms.

In some embodiments, the redundancy system comprises three, four or more radiation boosters, each of said radiation boosters including a connection point, and each of said connection points defining, together with a connection point of the at least one ground plane layer, an internal port of the redundancy system. Therefore, in some embodiments the redundancy system comprises two, three, four or more radiation boosters, and correspondingly two, three, four or more internal ports.

In a preferred example, the combining system comprises as many reactance cancellation elements as there are radiation boosters (and, consequently, internal ports) in the redundancy system, and each radiation booster is connected to a reactance cancellation element.

In a preferred example, the combining system comprises as many delay modules as there are radiation boosters (and, consequently, internal ports) in the redundancy system, and each delay module is related to a radiation booster.

In a preferred example, the combining system comprises as many broadband matching circuits as there are radiation boosters (and, consequently, internal ports) in the redundancy system, and each broadband module is related to a radiation booster.

In a preferred example, the combining system comprises a single broadband matching circuit.

In this sense and in accordance with an advantageous aspect of the present invention, the proposed combining system provides operation in at least two frequency bands, which are allocated in a frequency region of the electromagnetic spectrum, and/or increases the number of operating frequency bands in at least one frequency region of the electromagnetic spectrum, and/or increases the number of operating frequency bands in at least two frequency regions of the electromagnetic spectrum.

In this text, the expression impedance bandwidth is to be interpreted as referring to a frequency region over which a wireless device and a radiating system comply with certain specifications, depending on the service for which the wireless device is adapted. For example, for a device adapted to transmit and receive signals of cellular communication standards, a radiating system having a relative impedance bandwidth capable of covering the frequency bands associated to the cellular communication standards (for instance an impedance bandwidth around 15% is required to properly cover the cellular communication standards GSM850/900) together with an efficiency of not less than 20% (advantageously not less than 30%, more advantageously not less than 40%) are preferred. Also, an input return loss of 4.4 dB (equivalent to a VSWR=4) or better within the corresponding frequency region is preferred.

According to an aspect of the present invention, the first radiation booster is connected to a first reactance cancellation element to compensate its reactive behavior in a frequency region of operation, whereas the second radiation booster is connected to a second reactance cancellation element to compensate its reactive behavior in said frequency region of operation. A combing system is used to minimize the reflection coefficient measured at the external port of the radiating system in the frequency region of operation. After the addition of the combining system to the redundancy system, the radiating system operates in at least two frequency bands, which are allocated in a frequency region of the electromagnetic spectrum, and provides an increased robustness to human loading effects.

In some cases, the impedance bandwidth of a particular radiation booster measured after the addition of a reactance cancellation element is substantially smaller than the operating impedance bandwidth required for a communication standard allocated in a particular frequency band. When the internal ports are connected to a combining system according to the present invention, the radiating system enhances the operating impedance bandwidth in the frequency region of operation of the electromagnetic spectrum, thus allowing the operation of the radiating system in multiple frequency bands within the frequency region of the electromagnetic spectrum.

Distributed elements as well as lumped components can be used to implement the delay module. According to an aspect of the present invention, distributed elements such as transmission lines (such as for instance, coaxial line, micro-coaxial line, microstrip, stripline, coplanar, ground coplanar . . . ) or alternatively lumped components formed by different stages alternating series inductors and parallel capacitors are preferred. In some other configurations, different stages of series capacitors and shunt inductors are provided.

In a preferred example, the delay module comprises a transmission line. Said transmission line presents a characteristic impedance of 50Ω. In some other embodiments, said characteristic impedance can be optimized to increase the impedance bandwidth at the external port of the radiating system. In these cases, said characteristic impedance is larger than 5Ω, 10Ω, 20Ω, 30Ω, or 40Ω and smaller than 300Ω, 200Ω, 150Ω, 100Ω, or 75Ω.

In some examples, the delay module comprises a combination of lumped elements and transmissions lines. For example, a transmission line using a micro-coaxial cable is cascaded with a series inductor and shunt capacitor. This configuration is suitable for adding design flexibility and for allowing the miniaturization of the transmission line. In some situations, these combinations of transmission lines and lumped elements provide a compact solution having a smaller size than other architectures where only a transmission line is used.

In some other preferred examples, the use of lumped elements or the combination of a transmission line with lumped elements is used to modify the characteristic impedance of the delay module. In such embodiments, a characteristic impedance different of 50Ω is preferable for increasing the impedance bandwidth in the frequency region of operation of the electromagnetic spectrum.

In some preferred examples the phase difference in introduced by the delay modules is substantially close to 90° at the central frequency of the frequency region of operation to enable out-of-phase impedances. The phase difference can be adjusted to create an impedance loop at the external port of the radiating system. If said impedance loop associated to the frequency region of operation is not centered at the center of the Smith chart, a further stage (fine tuning circuit) is added to locate said impedance loop at the center of the Smith chart in order to provide enough impedance bandwidth as for covering multiple frequency bands within the frequency region of operation.

In some examples the modulus of the phase provided by the delay module is larger than 30°, 40°, 50°, 60°, 70°, or 80° at the central frequency of the frequency region of operation. In some other examples the modulus of the phase provided by the delay means is lower than 150°, 140°, 130°, 120°, 110°, or 100° at the central frequency of the frequency region of operation.

In some embodiments, the combining system further comprises a fine tuning circuit, namely a reactive matching network interconnected between a port for each one of the delay modules and the external port of the radiating system. Said fine tuning circuit is used to transform the input impedance of the redundancy system, providing impedance matching to the radiating system in the frequency region of operation of the radiating system.

The fine tuning circuit is preferred when the delay modules does not substantially minimize the sum of reflection coefficients at the external port of the radiating system but provide a compact impedance loop in the frequency region of operation. In this case, a fine tuning circuit is used to center said compact impedance loop and satisfy the particular specifications of the radiating system, such as for instance to a VSWR≤4 and preferably to a VSWR≤3.

A fine tuning circuit can comprise a single stage or a plurality of stages. In some examples, the fine tuning stage comprises at least one, at least two, at least three, at least four, at least five, at least six, at least seven, at least eight or more stages.

A stage comprises one or more circuit components (such as for example but not limited to inductors, capacitors, resistors, jumpers, short-circuits, switches, delay lines, resonators, or other reactive or resistive components). In some cases, a stage has a substantially inductive behavior in the frequency region of operation of the radiating system, while another stage has a substantially capacitive behavior in said frequency region, and yet a third one may have a substantially resistive behavior in said frequency region.

A stage can be connected in series or in parallel to other stages and/or to one of the at least one port of the radiofrequency system.

In some examples, the at least one fine tuning stage alternates stages connected in series (i.e., cascaded) with stages connected in parallel (i.e., shunted), forming a ladder structure. In some cases, a fine tuning stage comprising two stages forms an L-shaped structure (i.e., series—parallel or parallel—series). In some other cases, a fine tuning stage comprising three stages forms either a pi-shaped structure (i.e., parallel—series—parallel) or a T-shaped structure (i.e., series—parallel—series).

In some examples, the at least one fine tuning stage alternates stages having a substantially inductive behavior, with stages having a substantially capacitive behavior.

In an example, the fine tuning circuit and/or the delay module comprise at least one active circuit component (such as for instance, but not limited to, a transistor, a diode, a MEMS device, a relay, a phase shifter, or an amplifier).

In some embodiments, the combining system may further comprise a broadband matching circuit, said broadband matching circuit being preferably connected in cascade between the reactance cancellation circuit and the delay module.

In some embodiments, the combining system may further comprise a broadband matching circuit; said broadband matching circuit is operationally interconnected among the delay modules and the fine tuning circuit.

With a broadband matching circuit, the impedance bandwidth of the redundancy system may be advantageously further increased. This may be particularly interesting for those cases in which the relative bandwidth of the frequency region is large.

In a preferred embodiment, the broadband matching circuit comprises a stage that substantially behaves as a resonant circuit (preferably as a parallel LC resonant circuit or as a series LC resonant circuit) in the frequency region of operation of the radiating system.

In some examples, the combining system or at least one of the elements of the combining system may be integrated into an integrated circuit, such as for instance a CMOS integrated circuit or a hybrid integrated circuit.

Each radiation booster advantageously couples the electromagnetic energy from the combining system to the ground plane layer in transmission, and from the ground plane layer to the combining system in reception.

An aspect of the present invention relates to the use of the ground plane layer of the redundancy system as an efficient radiator to provide an enhanced radio-electric performance in the frequency region of operation of the wireless device, eliminating thus the need for a multiband antenna element having a complex geometry, a complicated mechanical design, and arduous integration within the wireless device. Different radiation modes of the ground plane layer can be advantageously excited when a dimension of said ground plane layer is on the order of, or even larger than, one half of the wavelength for a frequency of the frequency region of operation.

Therefore, in a wireless device comprising radiation boosters according to the present invention, the mode or modes excited in the ground plane have significant contribution to the radiation process.

An aspect of the present invention refers to an enhanced excitation of the radiation mode in the ground plane. The combination of at least two radiation boosters together with the placement of them in relation to the ground plane layer for the operation of the radiating system in a frequency region of the electromagnetic spectrum, improve the excitation of the radiation mode in the ground plane layer in relation to a solution with only one radiation booster. Furthermore, a substantially balanced power distribution among the radiation boosters of the radiating system ensures a better excitation of the radiation mode of the ground plane layer and also a more robust solution to the human loading compared to a solution with only one radiation booster.

In some embodiments, at least one, two, three, or even all, of said radiation modes occur at frequencies advantageously located within the frequency region of operation of the wireless device. In some other embodiments, the frequency of at least one radiation mode of said ground plane layer is above said frequency region. In some further embodiments, the frequency of at least one radiation mode of said ground plane layer is located below said frequency region.

In some embodiments, at least one, two, or three, radiation modes of the ground plane layer is/are advantageously located within the second frequency region of operation of the wireless device.

A ground plane rectangle is defined as being the minimum-sized rectangle that encompasses a ground plane layer of the redundancy system. That is, the ground plane rectangle is a rectangle whose sides are tangent to at least one point of said ground plane layer.

In some cases, the ratio between a side of the ground plane rectangle, preferably a long side of the ground plane rectangle, and the free-space wavelength corresponding to the lowest frequency of the lowest frequency region is advantageously larger than a minimum ratio. Some possible minimum ratios are 0.1, 0.16, 0.2, 0.3, 0.4, 0.5, 0.6, 0.8, 1, 1.2 and 1.4. Said ratio may additionally be smaller than a maximum ratio (i.e., said ratio may be larger than a minimum ratio but smaller than a maximum ratio). Some possible maximum ratios are 0.4, 0.5, 0.6, 0.8, 1, 1.2, 1.4, 1.6, 2, 3, 4, 5, 6, 8 and 10.

Setting a dimension of the ground plane rectangle, preferably the dimension of its long side, relative to said free-space wavelength within these ranges makes it possible for the ground plane layer to support one, two, three or more efficient radiation modes, in which the currents flowing on the ground plane layer are substantially aligned and contribute in phase to the radiation process.

A wireless device generally comprises one, two, three or more multilayer printed circuit boards (PCBs) on which to carry the electronics. In a preferred embodiment of a wireless device, the ground plane layer of the redundancy system is at least partially, or completely, contained in at least one of the layers of a multilayer PCB.

In some cases, a wireless device may comprise two, three, four or more ground plane layers. For example a clamshell, flip-type, swivel-type or slider-type wireless device may advantageously comprise two PCBs, each including a ground plane layer.

In some examples, each radiation booster has a maximum size smaller than $1/20$, $1/30$, $1/40$, $1/50$, $1/60$, $1/80$, $1/100$, $1/140$ or even $1/180$ times the free-space wavelength corresponding to the lowest frequency of the lowest frequency region of operation of the wireless handheld or portable device.

In some further examples, at least one (such as for instance, one, two, three or more) radiation booster has a maximum size smaller than $1/20$, $1/30$, $1/40$, $1/50$, $1/60$, $1/80$, $1/100$, $1/140$ or even $1/180$ times the free-space wavelength corresponding to the lowest frequency of the second frequency region of operation of said device.

Setting the dimensions of each radiation booster to such small values is advantageous because each radiation booster substantially behaves as a non-radiating element for all the frequencies of the frequency region, thus substantially reducing the loss of energy into free space due to undesired radiation effects of the radiation booster, and consequently enhancing the transfer of energy between the radiation booster and the ground plane layer. Therefore, the skilled-in-the-art person could not possibly regard each radiation booster as being an antenna element.

The maximum size of a radiation booster is preferably defined by the largest dimension of a booster box, respectively, that completely encloses said radiation booster, and in which the radiation booster is inscribed.

More specifically, a booster box for a radiation booster is defined as being the minimum-sized parallelepiped of square or rectangular faces that completely encloses the radiation booster, respectively, and wherein each one of the faces of said minimum-sized parallelepiped is tangent to at least a point of said radiation booster, respectively. Moreover, each possible pair of faces of said minimum-size parallelepiped sharing an edge forms an inner angle of 90°.

For some embodiments, the redundancy system comprises radiation boosters having a different booster box.

In some examples, one of the dimensions of a booster box can be substantially smaller than any of the other two dimensions, or even be close to zero. In such cases, said booster box collapses to a practically two-dimensional entity. The term dimension preferably refers to an edge between two faces of said parallelepiped.

Additionally, in some of these examples each radiation booster has a maximum size larger than $1/1400$, $1/700$, $1/350$, $1/250$, $1/180$, $1/140$ or $1/120$ times the free-space wavelength corresponding to the lowest frequency of the frequency region. Therefore, in some examples each radiation booster has a maximum size advantageously smaller than a first fraction of the free-space wavelength corresponding to the lowest frequency of the frequency region but larger than a second fraction of said free-space wavelength.

Furthermore, in some of these examples, the radiation boosters have a maximum size larger than $1/1400$, $1/700$, $1/350$, $1/175$, $1/120$, or $1/90$ times the free-space wavelength corresponding to the lowest frequency of the second frequency region of operation of the wireless device.

Setting the dimensions of a radiation booster to be above some certain minimum value is advantageous to obtain a higher level of the real part of the input impedance of the redundancy system (measured at the internal port of the redundancy system associated to said radiation booster when disconnected from the combining system) and in this way enhance the transfer of energy between said radiation booster and the ground plane layer.

In some other cases, preferably in combination with the above feature of an upper bound for the maximum size of a radiation booster although not always required, to reduce even further the losses in a radiation booster due to residual radiation effects.

In some examples the at least one radiation booster is substantially planar defining a two-dimensional structure, while in other cases the at least one radiation booster is a three-dimensional structure that occupies a volume. Radiation boosters being substantially planar are preferred for being integrated in ultra-slim wireless devices. Radiation boosters having a volumetric geometry may be advantageous to enhance the radio-electric performance of the radiating system, particularly in those cases in which the maximum size of the radiation booster is very small relative to the free-space wavelength corresponding to the lowest frequency of the frequency region of operation.

Therefore, in some redundancy systems in which the at least one of the radiation boosters has a volumetric geometry, it is preferred to set a ratio between the first resonant frequency associated to each internal port of the redundancy system when disconnected from the combining system and the lowest frequency of the frequency region above 2, 3.8, 4.8, or even above 5.4.

In some advantageous examples, the redundancy system includes a first radiation booster having a volumetric geometry and a second radiation booster being substantially planar. In such examples, said first and second radiation boosters excite a radiation mode on the ground plane layer responsible for the operation of the radiating system in the frequency region.

In some redundancy systems in which the at least one of the radiation boosters has a planar geometry, it is preferred to set a ratio between the first resonant frequency associated to each internal port of the redundancy system when disconnected from the combining system and the lowest frequency of the frequency region above 2, 3.8, 4.8, or even above 5.4.

In a preferred embodiment, the at least one of the radiation boosters comprises a conductive part. In some cases said conductive part may take the form of, for instance but not limited to, a conducting strip comprising one or more segments, a polygonal shape (including for instance triangles, squares, rectangles, hexagons, or even circles or ellipses as limit cases of polygons with a large number of edges), a polyhedral shape comprising a plurality of faces (including also cylinders or spheres as limit cases of polyhedrons with a large number of faces), or a combination thereof.

In another preferred example, the radiation booster may be further miniaturized by shaping at least a portion of conductive part as conducting strip comprising at least ten segments.

In some examples, the connection point of the at least one of the radiation boosters is advantageously located substantially close to an end, or to a corner, of said conductive part.

In another preferred example, the at least one of the radiation boosters comprises a gap (i.e., absence of conducting material) defined in the ground plane layer. Said gap is delimited by one or more segments defining a curve. The connection point of the radiation booster is located at a first point along said curve. The connection point of the ground plane layer is located at a second point along said curve, said second point being different from said first point.

The use of a redundancy system comprising two or more radiation boosters strategically arranged along a ground plane which supports an efficient radiation mode become preferable for reducing the space taken up within the wireless device and do not require customization. These facts allow and simplify the integration of other components and functionalities inside the wireless device In a preferred example of the present invention, a major portion of the at least one of the radiation boosters (such as at least a 50%, or a 60%, or a 70%, or an 80% of the surface of said radiation booster) is placed on one or more planes substantially parallel to the ground plane layer. In the context of this document, two surfaces are considered to be substantially parallel if the smallest angle between a first line normal to one of the two surfaces and a second line normal to the other of the two surfaces is not larger than 30°, and preferably not larger than 20°, or even more preferably not larger than 10°.

In some examples, said one or more planes substantially parallel to the ground plane layer and containing a major portion of a radiation booster of the redundancy structure are preferably at a height with respect to said ground plane layer not larger than a 2% of the free-space wavelength corresponding to the lowest frequency of the lowest frequency region of operation of the radiating system. In some cases, said height is smaller than 7 mm, preferably smaller than 5 mm, and more preferably smaller than 3 mm.

In some embodiments, the at least one of the radiation boosters are substantially coplanar to the ground plane layer. Furthermore, in some cases the at least one of the radiation booster is advantageously embedded in the same PCB as the one containing the ground plane layer, which results in a redundancy structure having a very low profile.

In some cases at least two, three, four, or even all, radiation boosters are substantially coplanar to each other, and preferably also substantially coplanar to the ground plane layer.

In some cases, two or more radiation boosters may be arranged one on top of another forming for example a stacked configuration. In other cases, at least one radiation booster is arranged or embedded within another radiation booster (i.e., the booster box of said at least one radiation booster is at least partially contained within the booster box of said another radiation booster). In such cases, even more compact solutions can be obtained such as a side-by-side configuration.

In some cases it is advantageous to protrude at least a portion of the orthogonal projection of a radiation booster beyond the ground plane layer, or alternatively remove ground plane from at least a portion of the projection of a radiation booster, in order to adjust the levels of impedance and to enhance the impedance bandwidth of the radiating system. This aspect is particularly suitable for those examples when the volume for the integration of the redundancy structure has a small height, as it is the case in particular for slim wireless devices.

In some examples, at least one, two, three, or even all, radiation boosters are preferably located substantially close to an edge of the ground plane layer, preferably said edge being in common with a side of the ground plane rectangle. In some examples, at least one of the radiation boosters is more preferably located substantially close to an end of said edge or to the middle point of said edge.

In some embodiments said edge is preferably an edge of a substantially rectangular or elongated ground plane layer.

In an example, a radiation booster is located preferably substantially close to a short side of the ground plane rectangle, and more preferably substantially close to an end of said short side or to the middle point of said short side. Such a placement for a radiation booster with respect to the ground plane layer is particularly advantageous when the redundancy structure features at the internal port associated to said radiation booster, when the combining system is disconnected, an input impedance having a capacitive component for the frequencies of the frequency region of operation.

In another example, a radiation booster is located preferably substantially close to a long side of the ground plane rectangle, and more preferably substantially close to an end of said long side or to the middle point of said long side. Such a placement for a radiation booster is particularly advantageous when the redundancy structure features at the internal port associated to said radiation booster, when the combining system is disconnected, an input impedance having an inductive component for the frequencies of said frequency region.

In some other examples, at least one of the radiation boosters is advantageously located substantially close to a corner of the ground plane layer, preferably said corner being in common with a corner of the ground plane rectangle.

In the context of this document, two points are substantially close to each other if the distance between them is less than 5% (more preferably less than 3%, 2%, 1% or 0.5%) of the free-space wavelength corresponding to the lowest frequency of operation of the radiating system. In the same way, two linear dimensions are substantially close to each other if they differ in less than 5% (more preferably less than 3%, 2%, 1% or 0.5%) of said free-space wavelength.

In some preferred embodiments, a first radiation booster is substantially close to a first corner of the ground plane layer and a second radiation booster is substantially close to a second corner of the ground plane layer (said second corner not being the same as said first corner). The first and second corners are preferably in common with two corners of the ground plane rectangle associated to said ground plane layer and, more preferably, said two corners are at opposite ends of a short side of the ground plane rectangle. Such location of the first and the second radiation boosters in relation to the ground plane layer favored an enhanced excitation of the radiation mode supported by the ground plane layer.

In another advantageous example, a first radiation booster is arranged substantially close to a first corner of the ground plane layer, the first corner being preferably in common with a corner of the ground plane rectangle, whereas a second radiation booster is arranged substantially close to a middle point of a large edge of the ground plane layer. In this example, preferably, the first radiation booster is such that the first internal port, when the combining system is disconnected, features an input impedance having a capacitive component for the frequencies of the frequency region, whereas the second radiation booster is such that the second internal port, also when the combining system is disconnected, features an input impedance having an inductive component for the frequencies of said frequency region. Such an election of the position of the first and second radiation boosters may be advantageous to enhance robustness to human loading effects.

In some examples, the at least one connection point of the ground plane layer is located advantageously close to the connection point of one of the radiation boosters to facilitate the interconnection of the combining system with the redundancy structure. Therefore, those locations specified above as being preferred for the placement of a radiation booster are also advantageous for the location of the at least one connection point of the ground plane layer. Therefore, in some examples said at least one connection point is located substantially close to an edge of the ground plane layer, preferably an edge in common with a side of the ground plane rectangle, or substantially close to a corner of the ground plane layer, preferably said corner being in common with a corner of the ground plane rectangle. Such an election of the position of the at least one connection point of the ground plane layer may be advantageous to provide a longer path to the electrical currents flowing on the ground plane layer, lowering the frequency of one or more radiation modes of the ground plane layer.

In some examples the ground plane associated to a redundancy structure is the ground plane layer of a mobile phone, or of a tablet device, or a phablet device, or of a laptop device, or of a navigator device, or of a point-of-sale device, or of a dongle device.

BRIEF DESCRIPTION OF THE DRAWINGS

Embodiments of the invention are shown in the enclosed figures.

DETAILED DESCRIPTION

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

Figure 1:
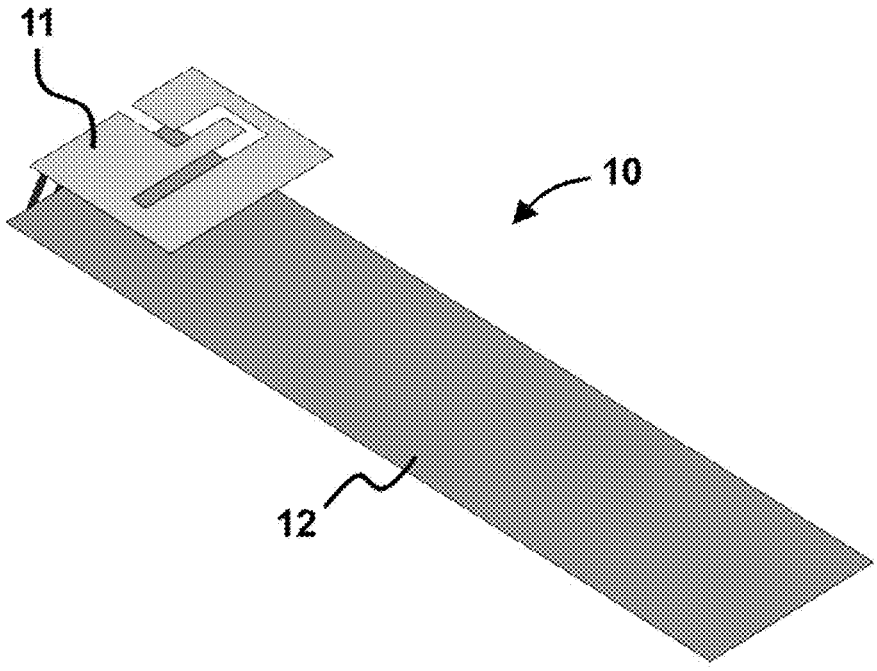
(PRIOR ART) FIG. 1
FIG. 1 shows a radiating structure of a typical wireless hand-held or portable device.

A prior-art radiating system for a wireless device typically includes a radiating structure comprising an antenna element which operates in combination with a ground plane layer providing a determined radio-electric performance in one or more frequency regions of the electromagnetic spectrum. FIG. 1 shows a prior-art radiating structure 10 comprising an antenna element 11 and a ground plane layer 12. Typically, the antenna element has a dimension close to an integer multiple of a quarter of the wavelength at a frequency of operation of the radiating structure, so that the antenna element is resonant at said frequency and a radiation mode is excited on said antenna element.

Furthermore, the prior-art radiating structure characterized by a resonant antenna element is typically sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the antenna element, and/or to the presence of the user of the wireless device.

Any of the above mentioned aspects may alter the current distribution and/or the electromagnetic field distribution of a radiation mode of the antenna element, which usually translates into detuning effects, degradation of the radio-electric performance of the radiating structure and/or the radio-electric performance wireless device, and/or greater interaction with the user (such as an increased level of SAR).

Figure 2A:
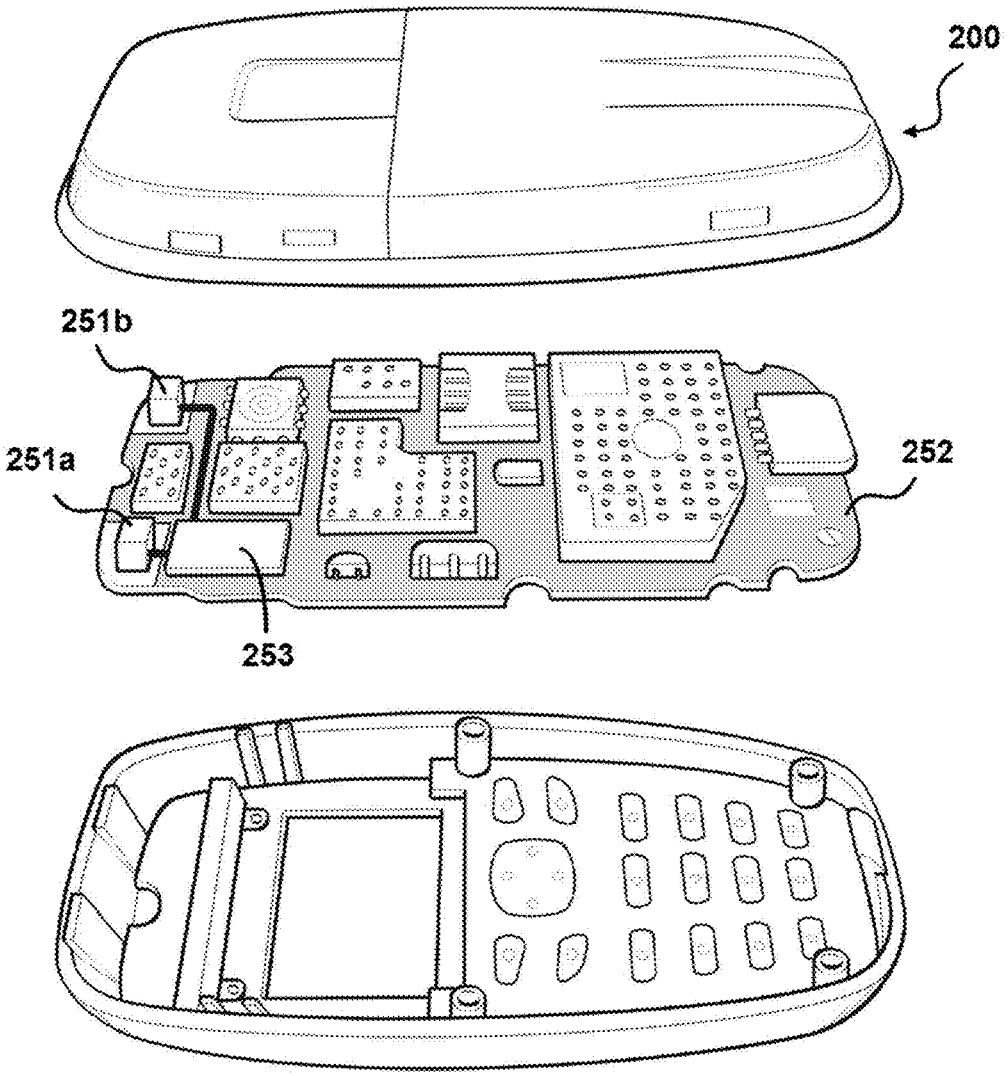
FIG. 2A shows an example of a wireless device including one radiating system according to the present invention.

FIG. 2A shows an illustrative example of a wireless device 200 configured to operate in one frequency region according to the present invention. In FIG. 2A, there is shown an exploded perspective view of the wireless device 200 comprising a redundancy system that includes a first radiation booster 251*a*, a second radiation booster 251*b* and a ground plane layer 252 (which could be included in a layer of a multilayer PCB). The wireless device 200 also comprises a combining system 253, which is interconnected to said redundancy system.

Figure 2B:
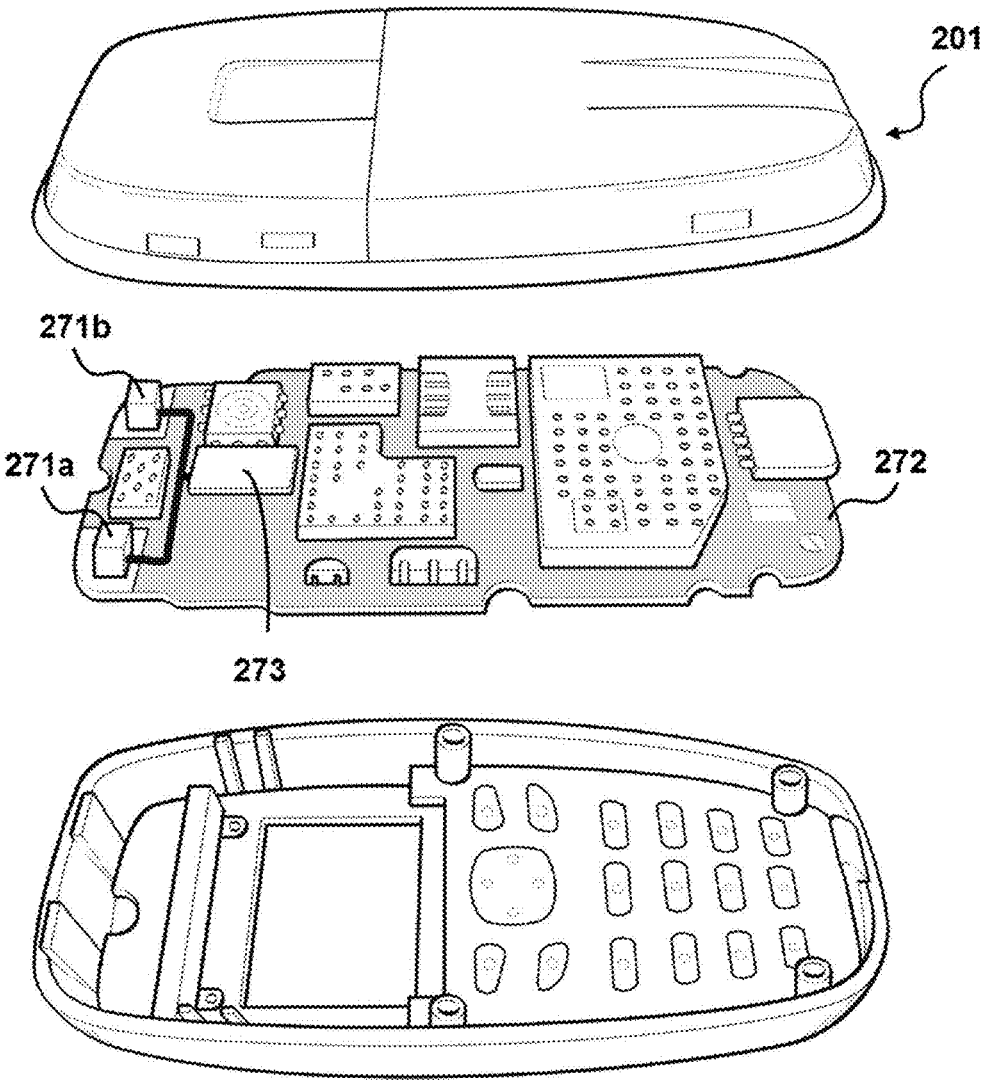
FIG. 2B shows an example of a wireless device including one radiating system according to the present invention.

FIG. 2B shows an illustrative example of a wireless device 201 configured to operate in one frequency region according to the present invention. In FIG. 2B, there is shown an exploded perspective view of the wireless device 201 comprising a redundancy system that includes a first radiation booster 271*a*, a second radiation booster 271*b* and a ground plane layer 272 (which could be included in a layer of a multilayer PCB). The wireless device 200 also comprises a combining system 273, which is interconnected to said redundancy system.

Figure 3A:
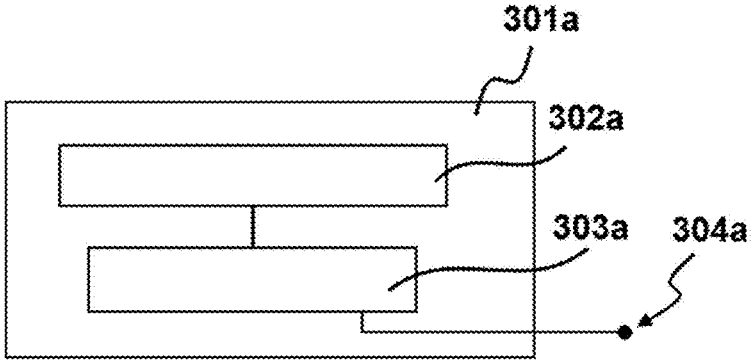
FIG. 3A shows a block diagram representation of a radiating system according to the present invention suitable for operation in one frequency region.

FIG. 3A illustrates a block diagram representation of a radiating system for a wireless device according to the present invention. The radiating system 301*a* is configured to operate in one frequency region of the electromagnetic spectrum. The radiating system 301*a* comprises a redundancy system 302*a*, a combining system 303*a*, and an external port 304*a*. The combining system is interconnected between the redundancy system and the external port.

Figure 3B:
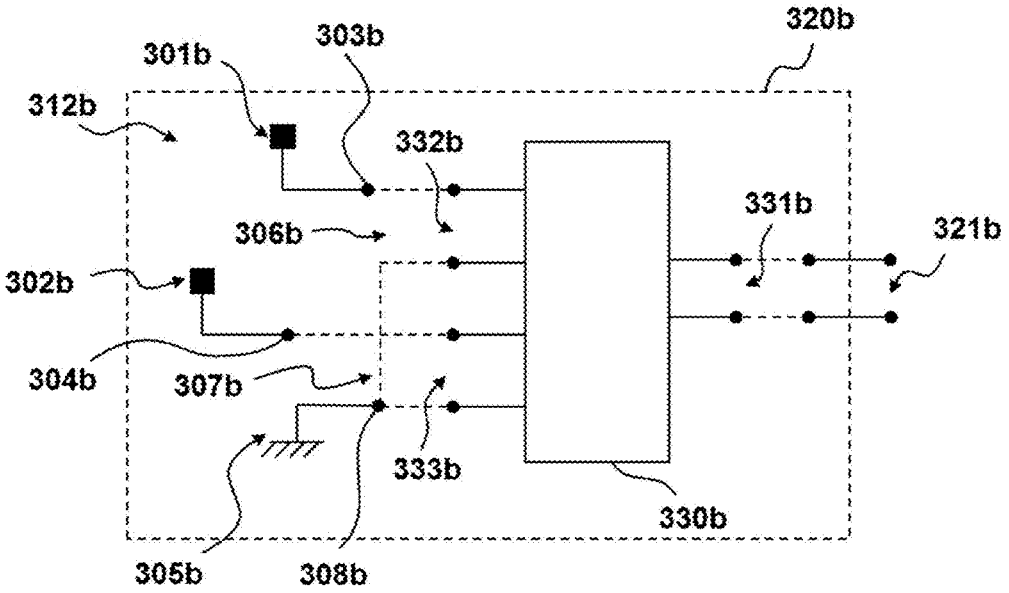
FIG. 3B shows a schematic representation of a radiating system comprising radiation boosters suitable for operation in one frequency region.

FIG. 3B shows a schematic representation of a radiating system for a wireless device according to the invention. The radiating system is configured to operate in one frequency region of the electromagnetic spectrum. In particular, the radiating system 320*b* comprises a redundancy system 312*b*, a combining system 330*b*, and an external port 321*b*. The redundancy system 312*b* comprises a ground plane layer 305*b*, said ground plane layer including a connection point 308*b* and two radiation boosters: a first radiation booster 301*b*, which includes a connection point 303*b*, and a second radiation booster 302*b*, which includes a connection point 304*b*. The redundancy system 312*b* further comprises a first internal port 306*b* defined between the connection point of the first radiation booster 303*b* and the connection point of the ground plane layer 308*b*; and a second internal port 307*b* defined between a connection point of the second radiation booster 304*b* and the same connection point of the ground plane layer 308*b*. In this particular example, the internal ports are defined between the connection points of each one of the radiation boosters and the connection point of the ground plane layer. However, in a preferred embodiment two different connection points of the ground plane layer can be used to define the two internal ports of the redundancy system, that is a first internal port is preferably defined between a first connection point of a first radiation booster and a first connection point of the ground plane layer and the second internal port is preferably defined between a second connection point of a second radiation booster and a second connection point of the ground plane layer. Furthermore, the combining system 330*b* comprises three ports: a first port 332*b* is connected to the first internal port of the redundancy system 306*b*, a second port 333*b* is connected to the second internal port of the redundancy system 307*b*; and a third port 331*b* is connected to the external port of the radiating system 321*b*. That is, the combining system 330*b* comprises a port connected to each of the at least one internal ports of the redundancy system 312*b*, and a port connected to the external port of the radiating system 321*b*.

Figure 4A:
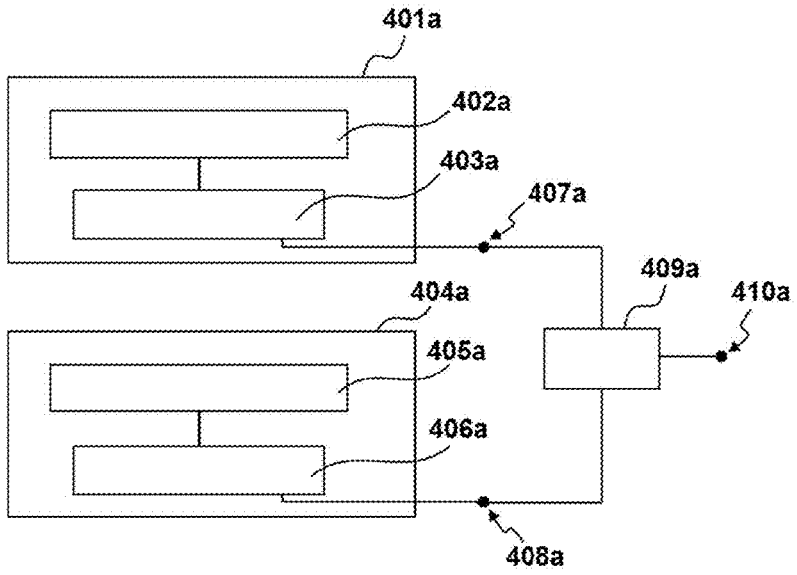
FIG. 4A shows a block diagram representation of a radiating system according to the present invention suitable for operation in two frequency regions.

FIG. 4A illustrates a block diagram representation of two radiating systems for a wireless device according to the present invention. The first radiating system 401*a* is configured to operate in a first frequency region of the electromagnetic spectrum, and the second radiating system 404*a* is configured to operate in second frequency region of the electromagnetic spectrum, wherein preferably the first frequency region and the second frequency region are non-overlapped frequency regions. The first radiating system 401*a* comprises a redundancy system 402*a*, a combining system 403*a*, and an external port 407*a*. The combining system 403*a* is interconnected between the redundancy system 402*a* and the external port 407*a*. The second radiating system 404*a* comprises a redundancy system 405*a*, a combining system 406*a*, and an external port 408*a*. The combining system 406*a* is interconnected between the redundancy system 405*a* and the external port 408*a*. A multiplexing system 409*a* is interconnected to the external port 407*a* of the first radiating system 401*a*, the external port of 408*a* of the second radiating system 404*a* and an external port 410*a*. However, in other embodiments the first and second radiating systems are not interconnected to the multiplexing system, that is, the wireless device does not require the multiplexing system interconnecting the first and the second radiating system, and the external port.

Figure 4B:
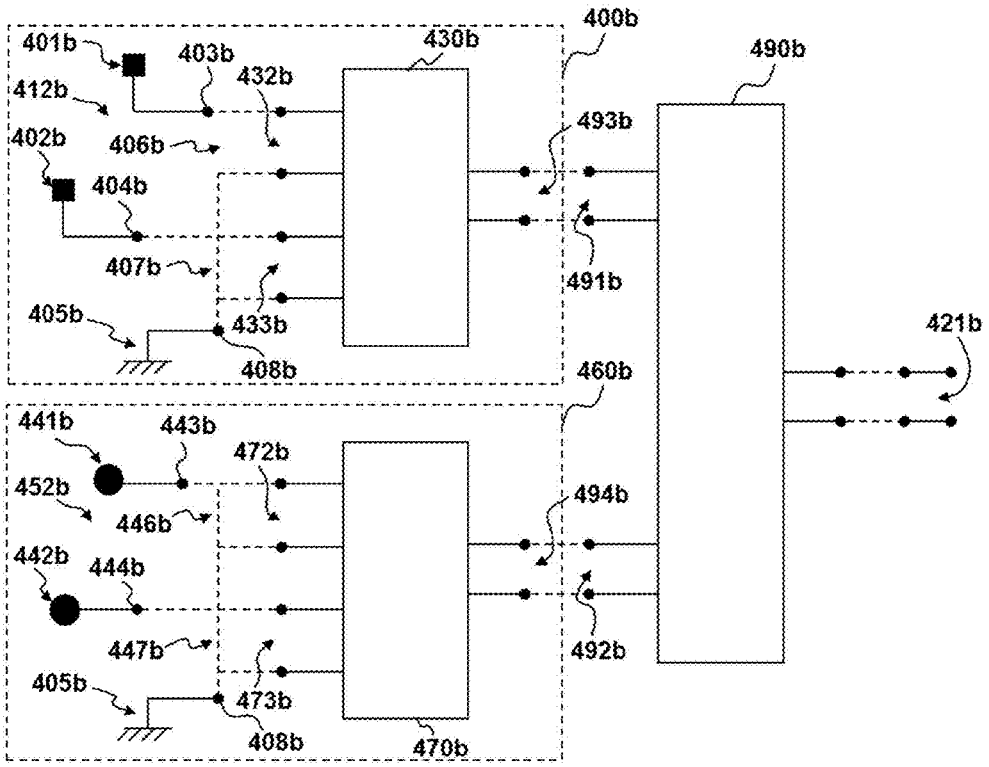
FIG. 4B shows a schematic representation of a radiating system according to the present invention suitable for operation in two frequency regions.

FIG. 4B shows a schematic representation of two radiating systems for a wireless device according to the invention. The first radiating system 400*b* is used for providing operation in a first frequency region of the electromagnetic spectrum, and the second radiating system 460*b* is used to provide operation in second frequency region of the electromagnetic spectrum, wherein preferably the first frequency region and the second frequency region are non-overlapped frequency regions. In particular, the first radiating system 400*b* comprises a redundancy system 412*b*, a combining system 430*b*, and an external port 491*b*. The redundancy system 412*b* comprises a ground plane layer 405*b*, said ground plane layer including a connection point 408*b* and two radiation boosters: a first radiation booster 401*b*, which includes a connection point 403*b*, and a second radiation booster 402*b*, which includes a connection point 404*b*. The redundancy system 412*b* further comprises a first internal port 406*b* defined between the connection point of the first radiation booster 403*b* and the connection point of the ground plane layer 408*a*; and a second internal port 407*b* defined between a connection point of the second radiation booster 404*b* and the a connection point of the ground plane layer 408*b*. Furthermore, the combining system 430*b* comprises three ports: a first port 432*b* is connected to the first internal port of the redundancy system 406*b*, a second port 433*b* is connected to the second internal port of the redundancy system 407*b*; and a third port 493*b* is connected to the external port of the first radiating system 491*b*. That is, the combining system 430*b* comprises a port connected to each of the at least one internal ports of the redundancy system 412*b*, and a port connected to the external port of the first radiating system 491*b*. In particular, the second radiating system 460*b* system comprises a redundancy system 452*b*, a combining system 470*b*, and an external port 492*b*. The redundancy system comprises a first radiation booster 441*b*, a second radiation booster 442*b*, and a ground plane layer 405*b*. In a similar manner as explained above for the first radiating system, a first internal port 446*b* is defined between a connection point of the first radiation booster 443*b* and a connection point of the ground plane layer 408*b*; and a second internal port 447*b* is defined between a connection point of the second radiation booster 444*b* and a connection point of the ground plane layer 408*b*. The first internal port 446*b* is connected to a first port of the combining system 472*b*, the second internal port is 447*b* is connected to a second port of the combining system 473*b*, and a third port of the combining system 494*b* is connected to the external port of the second radiating system 492*b*. In this particular example, the internal ports are defined between the connection points of each one of the radiation boosters and the connection point of the ground plane layer. It is important to emphasize that just for the sake of simplicity a single connection point of the ground plane layer is depicted.

However, according to the present invention the ground plane layer can present two or more connection points each one of them defining together with a connection point of a radiation booster an internal port of the redundancy system. The external port 491*b* of the first radiating system 400*b*, the external port 492*b* of the second radiating system 460*b* and an external port 421*b* are connected to a multiplexing system 490*b*. However, in other embodiments the first and second radiating systems are not interconnected to the multiplexing system, that is, the wireless device does not require the external port 421*b* and the multiplexing system interconnecting the first radiating system, the second radiating system, and the external port. Furthermore, in some cases the ground plane layer of the first redundancy system is different than the ground plane layer of the second redundancy system.

Figure 5:
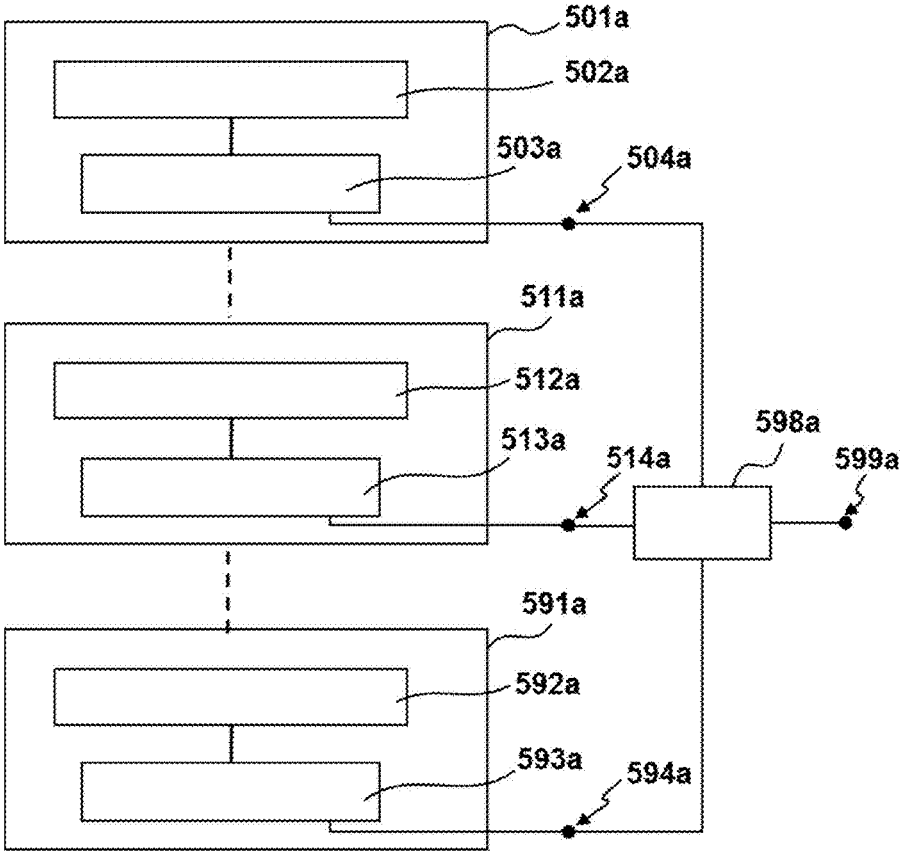
FIG. 5 shows a block diagram representation of a radiating system according to the present invention suitable for operation in at least three or more frequency regions.

FIG. 5 shows a block diagram representation of multiple radiating systems 501*a*, 511*a*, 591*a* for a wireless device operating in multiple frequency regions of the electromagnetic spectrum according to the present invention. Each radiating system is capable of operation in a frequency region of the electromagnetic spectrum; wherein preferably the multiple frequency regions are non-overlapped frequency regions. Each radiation system 501*a*, 511*a*, 591*a* comprises a redundancy system 502*a*, 512*a*, 592*a*, a combining system 503*a*, 513*a*, 593*a* and an external port, as described above for the radiating system 301*a* illustrated in FIG. 3A. Two or more external ports 504*a*, 514*a*, 594*a* of the multiple radiation systems 501*a*, 511*a*, 591*a* and an external port 559*a* are connected to a multiplexing system 598*a*. However, in other embodiments the multiple radiating systems are not interconnected to the multiplexing system, that is, the wireless device does not require the external port and the multiplexing system. Furthermore, in some cases two or more multiplexing system may be included in the wireless device. Each multiplexing system interconnected to two or more different external ports of the multiple radiating systems.

Figure 6:
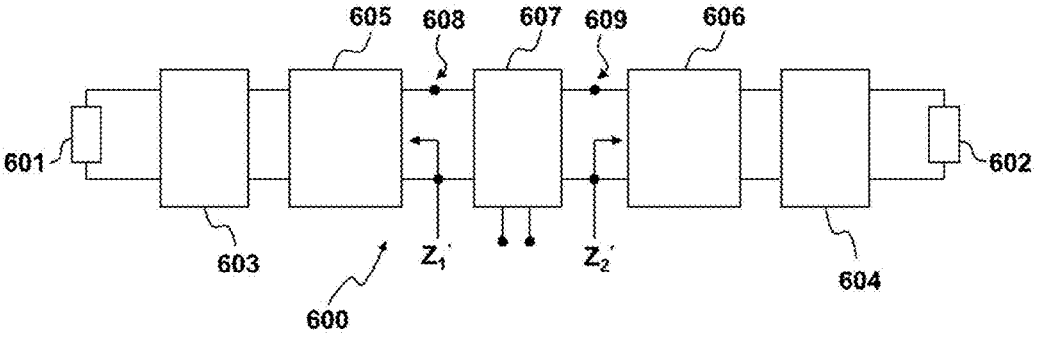
FIG. 6 illustrates a schematic representation of a radiating system according to the invention.
Figure 7A:
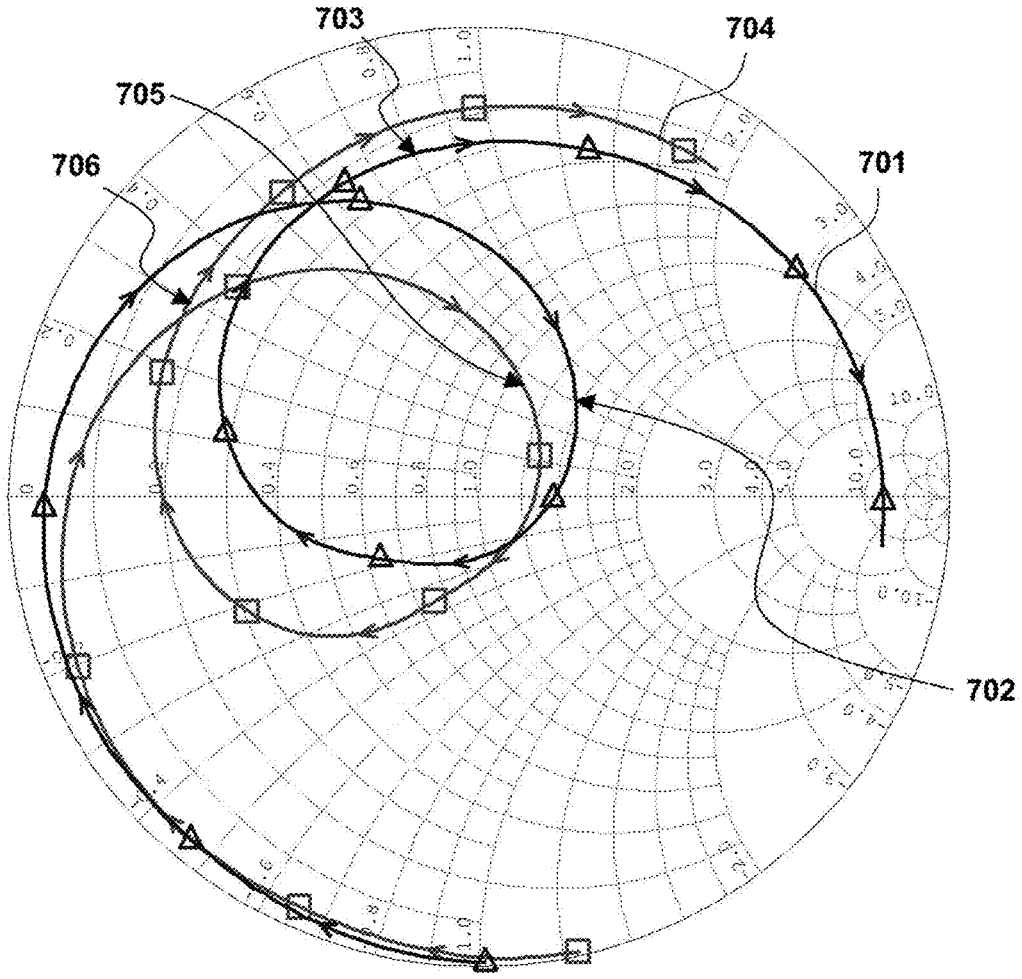
FIG. 7A shows a Smith chart illustrating in-phase impedances for an embodiment of the invention.
Figure 7B:
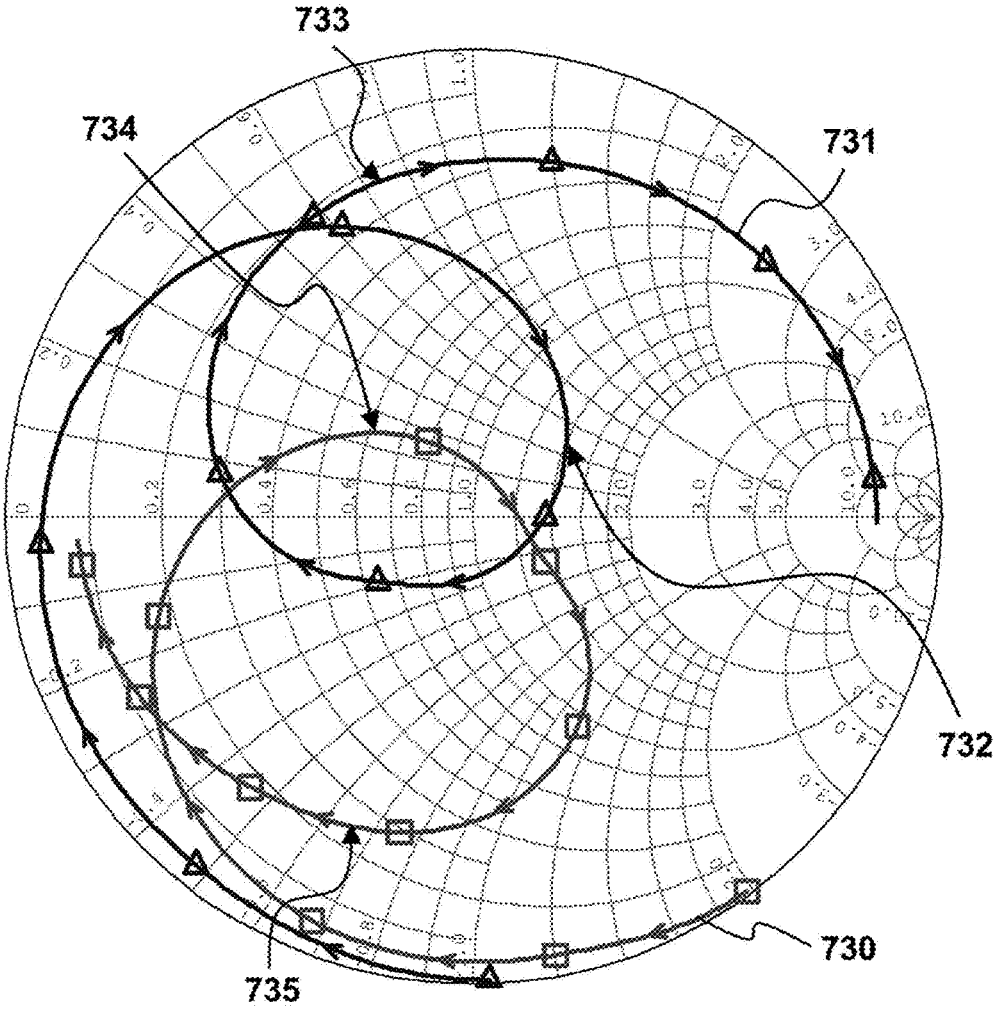
FIG. 7B shows a Smith chart illustrating out-of-phase impedances for an embodiment of the invention.

In order to illustrate the resulting impedance for an in-phase and out-of-phase feeding schemes, FIG. 6 illustrates another schematic representation of a radiating system 600 for a wireless device according to the invention and FIGS. 7A and 7B respectively illustrate an example of an impedance for in-phase feeding scheme and an example of an impedance for an out-of-phase feeding scheme. The radiating system is capable of operating in a frequency region of the electromagnetic spectrum. The first radiation booster is represented by a block 601; the second radiation booster is represented by a block 602. The combining system is represented by blocks 603, 604, 605, 606, and 607; the first stage being the block 603, the first delay module being the block 605, the second stage being the block 604, the second delay module being the block 606, and the third stage being the block 607. The first radiation booster 601 is connected to the first stage 603 of the combining system, and a first delay module 605 is connected to said first stage. The second radiation booster 602 is connected to a second stage 604 of the combining system, and a second delay module 606 is connected to said second stage of the combining system. A first impedance (Z1') is defined at a port 608 of the first delay module, and the second impedance (Z2') is measured at a port 609 of the second delay module. Thus, the first impedance (Z1') is mainly determined by the first radiation booster 601, the first stage 603 of the combining system and the first delay module 605; the second impedance (Z2') is mainly determined by the second radiation booster 602, the second stage 604 of the combining system and the second delay module 606. The first impedance (Z1') and the second impedance (Z2') are measured when the third stage 607 is not connected to the ports 608 and 609.

In the embodiments for an in-phase feeding scheme, the combining system provides a first impedance (Z1') being in-phase of the second impedance (Z2'). FIG. 7A illustrates an example of impedances for an in-phase feeding scheme of a radiating system according to the invention; a first impedance (Z1') 701 and a second impedance (Z2') 704 are represented in the Smith chart. The first impedance (Z1') 701 shows substantially the same phase than the second impedance (Z2') 704 across a frequency region of operation of the radiating system; the frequency region of operation is delimited by the points 702 and 703 for the first impedance, and by the points 705 and 706 for the second impedance. An average of a first refection coefficient has a modulus of 0.28 and a phase of 116° and an average of a second reflection coefficient has a modulus of 0.28 and a phase of 153°, being a phase different (absolute value) between the average of the first reflection coefficient and the average of the second reflection coefficient 37°. The first reflection coefficient is the reflection coefficient for the first impedance (Z1') 701 and the second reflection coefficient is the reflection coefficient for the second impedance (Z2') 704. Thus, an in-phase difference for the impedances of FIG. 7A is smaller than 45° as required in this document for the first impedance being in-phase of the second impedance.

Furthermore, an average resistance of the first impedance (Z1') 701 is 34Ω and an average resistance of the second impedance (Z2') 704 is 29Ω. In this case, the combining system is characterized by the average resistance of the first impedance differing from the average resistance of the second impedance by less than 30%.

In the embodiments for an in-phase feeding scheme, the delay modules are selected to minimize the reflection coefficient measured at the external port of the radiating system in the frequency region of operation when both impedances (Z1' and Z2') are combined into a single input/output port. As the first impedance (Z1') is substantially similar to the second impedance (Z2'), the combining system for an in-phase feeding scheme ensures a substantially balanced power distribution between the first and the second radiation boosters.

In some embodiments, a radiating system includes a redundancy system comprising three or more radiation boosters and an in-phase combing system; the in-phase combining system including three or more delay modules. In the present document an in-phase combining system refers to a combining system using an in-phase feeding scheme. The in-phase combining system enables in-phase impedances (Zi') at each port of the delay module; each port of the delay module is defined as the ports 608, 609 in FIG. 6 for the embodiment with two delay modules. As in-phase impedances (Zi') are achieved at each port of the delay module, the in-phase combing system enables a substantially balanced power distribution among the radiation boosters of the redundancy system.

In the embodiments for an out-of-phase feeding scheme, the combining system provides a first impedance (Z1') being out-of-phase of a second impedance (Z2'). FIG. 7B illustrates an example of impedances for an out-of-phase feeding scheme of a radiating system according to the invention; the first impedance (Z1') 731 and the second impedance (Z2') 730 are represented in the Smith chart.

A frequency region of operation for the first impedance and the second impedance is delimited by the points 732 and 733 for the first impedance (Z1') 731, and by the points 734 and 735 for the second impedance (Z2') 730. An average of a first refection coefficient has a modulus of 0.25 and a phase of 137° and an average of a second reflection coefficient has a modulus of 0.14 and a phase of −110°, being a phase different (absolute value) between the average of the first reflection coefficient and the average of the second reflection coefficient 247°. The first reflection coefficient is the reflection coefficient for the first impedance (Z1') 731 and the second reflection coefficient is the reflection coefficient for the second impedance (Z2') 730. Thus, an out-of-phase difference for the impedances of FIG. 7B is between 45° and 315° as required in this document for the first impedance being out-of-phase of the second impedance.

Furthermore, an average resistance of the first impedance (Z1') 731 is 42Ω and an average resistance of the second impedance (Z2') 730 is 37Ω. In this case, the combining system is characterized by the average resistance of the first impedance differing from the average resistance of the second impedance by less than 30%.

In the embodiment for an out-of-phase feeding scheme, the delay modules are selected to minimize the reflection coefficient measured at the external port of the radiating system in the frequency region of operation when both impedances (Z1' and Z2') are combined into a single input/output port, and to guaranty a substantially balanced power distribution between the first and second radiation boosters. As the first impedance (Z1') is out-of-phase of the second impedance (Z2'), the combining system guaranties a substantially balanced power distribution between the first and the second radiation boosters.

In some other embodiments, a radiating system includes a redundancy system comprising three or more radiation boosters, and an out-of-phase combining system; the out-of-phase combining system comprising two or more delay modules. In the present document an out-of-phase combining system refers to a combining system using an out-of-phase feeding system. The out-of-phase combining system enables out-of-phase impedances (Zi') at at least two ports of the at least two or more delay modules; a port of the delay module is defined as the ports 608 or 609 are defined in FIG. 6 for the embodiment with two delay modules. As out-of-phase impedances (Zi') are achieved at the at least two ports of the two or more delay modules, the combing system enables a substantially balanced power distribution among the radiation boosters of the redundancy system.

Figure 8A:
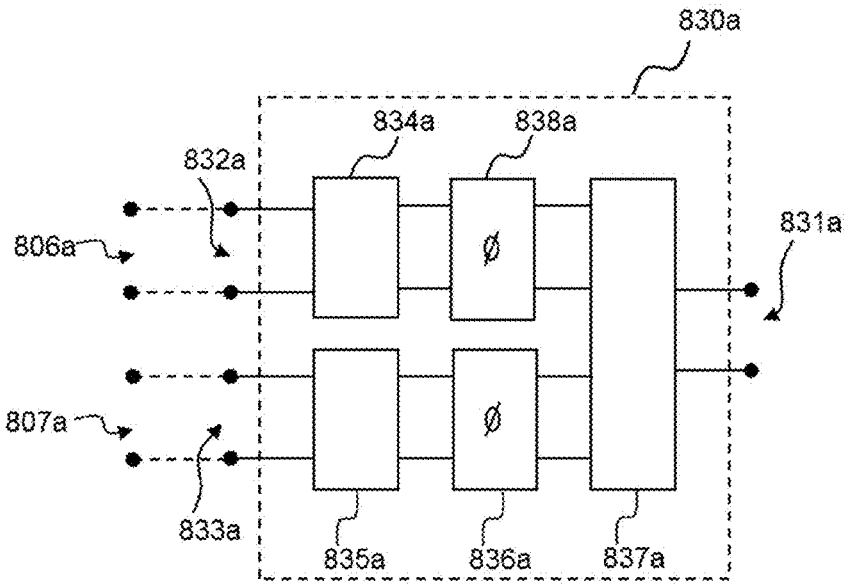
FIG. 8A shows a first schematic representation of a combining system used in a radiating system of the present invention; the combining system is for a redundancy system including two radiation boosters.
Figure 8B:
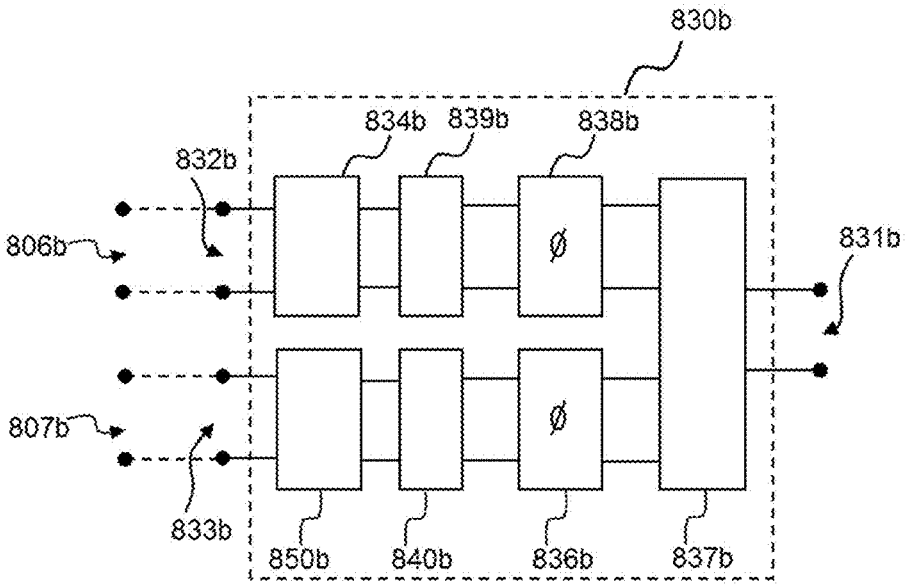
FIG. 8B shows a second schematic representation of a combining system used in a radiating system of the present invention; the combining system is for a redundancy system including two radiation boosters.
Figure 8C:
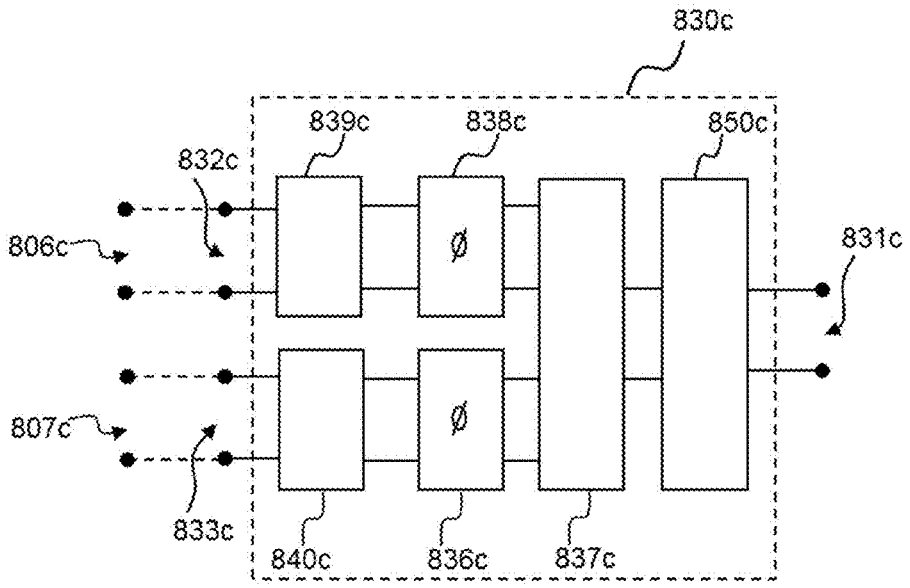
FIG. 8C shows a third schematic representation of a combining system used in a radiating system of the present invention; the combining system is for a redundancy system including two radiation boosters.

FIGS. 8A-8C respectively show the block diagrams of three preferred examples of combining systems according to the present invention.

In FIG. 8A the combining system 830*a* comprises a first port 832*a* connected to a first internal port 806*a* and a second port 833*a* connected to a second internal port 807*a*. The combining system further comprises a third port 831*a* connected to an external port of a radiating system. The first port 832*a* is connected to a first reactance cancellation element 834*a* which is connected to a first delay module 838*a*. The second port 833*a* is connected to a second reactance cancellation element 835*a* which is connected to a second delay module 836*a*. The first reactance cancellation element is intended for providing resonance in a frequency associated to a frequency region of operation, and the second reactance cancellation element is selected for providing resonance in a frequency allocated in the same frequency region of operation of the electromagnetic spectrum. The combining system 830*a* further comprises a fine tuning stage 837*a* interconnected between the first delay module 838*a*, the second delay module 836*a* and a third port 831*a*. In some embodiments, an in-phase feeding scheme is used for the combining system 830*a*; such combining systems are referred in this document as in-phase combining systems. Furthermore, in some embodiments, an out-of-phase feeding scheme is used for the combining system 830*a*; such combining system are referred in this document as out-of-phase combining systems.

In some other embodiments, a radiating system comprises a redundancy system including three or more radiation boosters and a combining system; the redundancy system further includes three or more internal ports. The combining system comprises three or more ports, each of such three or more ports being connected to an internal port of the redundancy system, and an additional port connected to an external port of the radiating system. The combining system further comprises three or more reactance cancellation elements, and two or more delay modules; the three or more reactance cancellation elements and the two or more delay modules are connected in a similar way as that shown in FIG. 8A for the embodiment with two radiation boosters including two reactance cancellation elements, and the two delay modules. Each reactance cancellation element is connected to a port of the combining system, and each delay module is connected to a reactance cancellation element as shown in FIG. 8A. The combining system may further comprise a fine tuning stage interconnected with each delay module, with the reactance cancellation elements not connected to a delay module, and with the additional port. In some embodiments, an in-phase feeding scheme is used for the combining system; such combining systems are referred in this document as in-phase combining systems. Furthermore, in some embodiments, an out-of-phase feeding scheme is used for the combining system; such combining system are referred in this document as out-of-phase combining systems.

Referring now to FIG. 8B, the combining system 830*b* comprises a first port 832*b* connected to a first internal port 806*b*, a second port 833*b* connected to a second internal port 807*b*, and a third port 831*b* connected to an external port of a radiating system. The combining system further comprises a first reactance cancellation element 834*b* connected to the first port 832*b*; a first broadband matching circuit 839*b* connected to the first reactance cancellation element; a first delay module 838*b* connected to the broadband matching circuit 839*b*; a second reactance cancellation element 850*b* connected to the second port 833*b*; a second broadband matching circuit 840*b* connected to the second reactance cancellation element; a second delay module 836*b* connected to the second broadband matching circuit. The combining system further comprises a fine tuning circuit 837*b* interconnected between the first delay module, the second delay module and the third port 831*b*. In some examples, an in-phase feeding scheme is used for the combining system 830*b*; while in some other examples an out-of-phase feeding scheme is used for the combining system 830*b*.

In some other embodiments, a radiating system comprises a redundancy system including three or more radiation boosters and a combining system; the redundancy system further includes three or more internal ports. The combining system comprises three or more ports, each of such three or more ports being connected to an internal port of the redundancy system, and an additional port connected to an external port of the radiating system. The combining system further comprises three or more reactance cancellation elements, three or more broadband matching circuits, and two or more delay modules; the three or more reactance cancellation elements, the three or more broadband matching circuits and the two or more delay modules are connected in a similar way as that shown in FIG. 8B for the two reactance cancellation elements, the two broadband matching circuits and the two delay modules of the embodiment with two radiation boosters. Each reactance cancellation element is connected to a port of the combining system, each broadband matching circuit is connected to a reactance cancellation element and each delay module is connected to a broadband matching circuit as shown in FIG. 8B. The combining system may further comprise a fine tuning stage interconnected with each delay module, with the broadband matching circuits not connected to the delay modules and with the additional port. In some embodiments, an in-phase feeding scheme is used for the combining system; such combining systems are referred in this document as in-phase combining systems. Furthermore, in some embodiments, an out-of-phase feeding scheme is used for the combining system; such combining system are referred in this document as out-of-phase combining systems.

FIG. 8C depicts a further example of a combining system according to the present invention. The combining system 830*c* comprises a first port 832*c* connected to a first internal port 806*c*; a second port 833*c* connected to a second internal port 807*c*; and a third port 831*c* connected to an external port of a radiating system. The combining system 830*c* further comprises a first reactance cancellation element 839*c* connected to the first port 832*c*; a first delay module 838*c* connected to the reactance cancellation element 839*c*; a second reactance cancellation element 840*c* connected to the second port 833*c*; a second delay module 836*c* connected to the second reactance cancellation element. The combining system further comprised a broadband matching circuit 837*c* and a fine tuning circuit 850*c*; the broadband matching circuit is interconnected to the fine tuning circuit and to the first and second delay modules. In some cases the fine tuning circuit is not required, and the broadband matching is interconnected to the first and second delay modules and to the third port 831*c*. In some cases, the broadband matching circuit is not required since the combining system without the broadband matching circuit enables compact impedance loops centered in a circle of VSWR≤4 of the Smith Chart. In some cases, the broadband matching circuit and the fine tuning circuit are not required to achieve compact impedance loops centered in a circle of VSWR≤4. In some examples, an in-phase feeding scheme is used for the combining system 830*c*; while in some other examples an out-of-phase feeding scheme is used for the combining system 830*c*.

In some other embodiments, a radiating system comprises a redundancy system including three or more radiation boosters and a combining system; the redundancy system further includes three or more internal ports. The combining system comprises three or more ports, each of such three or more ports being connected to an internal port of the redundancy system, and an additional port connected to an external port of the radiating system. The combining system further comprises three or more reactance cancellation elements, and two or more delay modules; the three or more reactance cancellation elements and the two or more delay modules are connected in a similar way as that shown in FIG. 8C for the two reactance cancellation elements, and the two delay modules of the embodiment with two radiation boosters. Each reactance cancellation element is connected to a port of the combining system, and each delay module is connected to a reactance cancellation element as shown in FIG. 8C. The combining system may further comprise a broadband matching circuit; the broadband matching circuit interconnected with each delay module, with the reactance cancellation elements not connected to the delay modules, and with the fine tuning stage. In some embodiments, an in-phase feeding scheme is used for the combining system; such combining systems are referred in this document as in-phase combining systems. Furthermore, in some embodiments, an out-of-phase feeding scheme is used for the combining system; such combining system are referred in this document as out-of-phase combining systems.

Figure 9A:
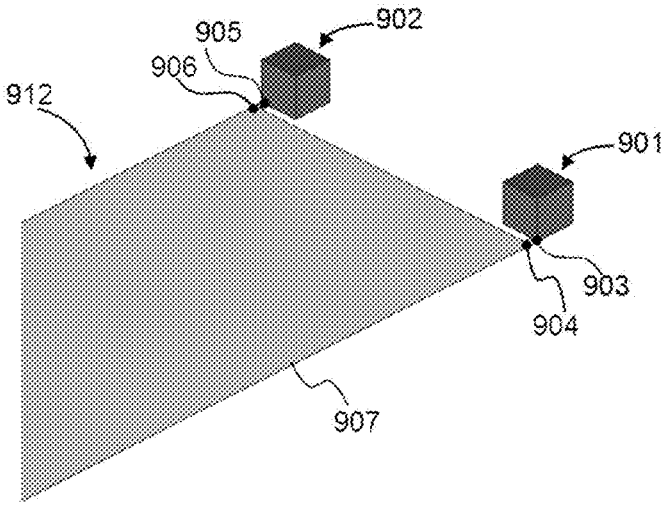
FIG. 9A shows a partial perspective view for an example of a redundancy system for a radiating system, the redundancy system including a first and a second radiation booster, each one comprising a conductive part.

FIG. 9A shows a preferred example of a redundancy system suitable for a radiating system operating in a frequency region of the electromagnetic spectrum between 690 MHz and 960 MHz. In this sense, the redundancy system operates in at least three frequency bands each one associated to a particular communication standard, namely LTE700, GSM850, and GSM900.

Figure 9B:
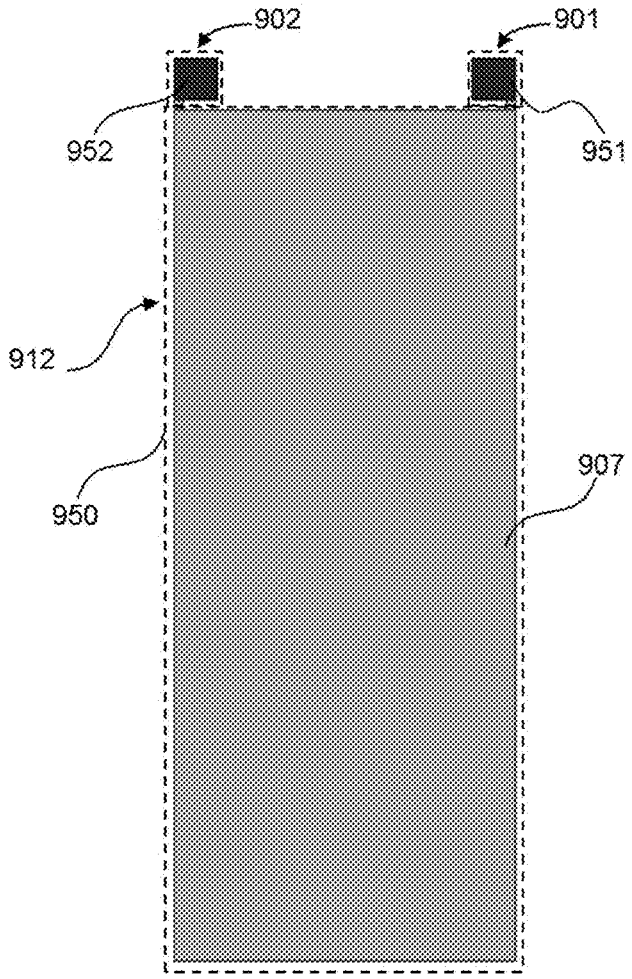
FIG. 9B is similar to FIG. 9A, but showing the redundancy system from a different perspective as compared to FIG. 9A.

The redundancy system 912 comprises a first radiation booster 901, a second radiation booster 902, and a ground plane layer 907. In FIG. 9B, there is shown in a top plan view the ground plane rectangle 950 associated to the ground plane layer 907. In this example, since the ground plane layer 907 has a substantially rectangular shape, its ground plane rectangle 950 is obtained as the rectangular perimeter of said ground plane layer 907.

The ground plane rectangle 950 has a long side of approximately 120 mm and a short side of approximately 50 mm. Therefore, in accordance with an aspect of the present invention, the ratio between the long side of the ground plane rectangle 950 and the free-space wavelength corresponding to the lowest frequency of the frequency region (i.e., 690 MHz) is advantageously larger than 0.2. Moreover, said ratio is advantageously also smaller than 2.0.

In this example, the first radiation booster 901 and the second radiation booster 902 are of the same type, shape and size. However, in other examples the radiation boosters 901, 902 could be of different types, shapes and/or sizes. Thus, in FIGS. 9A and 9B, each of the first and the second radiation boosters 901, 902 includes a conductive part featuring a polyhedral shape comprising six faces. Moreover, in this case said six faces are substantially square having an edge length of approximately 5 mm, which means that, said conductive part is a cube. In this case, the conductive part of each of the two radiation boosters 901, 902 is not connected to the ground plane layer 907. A first booster box 951 for the first radiation booster 901 coincides with the external area of said first radiation booster 901. Similarly, a second booster box 952 for the second radiation booster 902 coincides with the external area of said second radiation booster 902. In FIG. 9B, it is shown a top plan view of the redundancy system 912, in which the top face of the first booster box 951 and that of the second booster box 952 are observed.

In accordance with an aspect of the present invention, a maximum size of the first radiation booster 901 (said maximum size being a largest edge of the first booster box 951) is advantageously smaller than 1/50 times the free-space wavelength corresponding to the lowest frequency of the frequency region of operation of the redundancy system 912, and a maximum size of the second radiation booster 902 (said maximum size being a largest edge of the second booster box 952) is also advantageously smaller than 1/50 times said free-space wavelength. In particular, said maximum sizes of the first and second radiation boosters 901, 902 are also advantageously larger than 1/180 times said free-space wavelength.

In FIGS. 9A and 9B, the first and second radiation boosters 901, 902 are arranged with respect to the ground plane layer 907 so that the upper and bottom faces of the first radiation booster 901 and the upper and bottom faces of the second radiation booster 902 are substantially parallel to the ground plane layer 907. Moreover, the bottom face of the first radiation booster 901 is advantageously coplanar to the bottom face of the second radiation booster 902, and the bottom faces of both radiation boosters 901, 902 are also advantageously coplanar to the ground plane layer 907. With such an arrangement, the height of the radiation boosters 901, 902 with respect to the ground plane layer is not larger than 2% of the free-space wavelength corresponding to the lowest frequency of the frequency region.

In the redundancy system 912, the first radiation booster 901 and the second radiation booster 902 protrude beyond the ground plane layer 907, so that the orthogonal projection of the first 901 and second radiation boosters 902 on the plane containing the ground plane layer 907 is outside the ground plane rectangle 950. The first radiation booster 901 is located substantially close to a first corner of the ground plane layer 907, while the second radiation booster 902 is located substantially close to a second corner of said ground plane layer 907. In particular, said first and second corners are at opposite ends of a short edge of the substantially rectangular ground plane layer 907.

The first radiation booster 901 comprises a connection point 903 located on the bottom face of the first radiation booster 901. In turn, the ground plane layer 907 also comprises a first connection point 904 substantially on a corner of the ground plane layer 907. A first internal port of the redundancy system 912 is defined between said connection point 903 and said first connection point 904. Furthermore, the second radiation booster 902 comprises a connection point 905 located on the bottom face of the second radiation booster 902, and the ground plane layer 907 also comprises a second connection point 906 substantially on another corner of the ground plane layer 907. A second internal port of the redundancy system 912 is defined between said connection point 905 and said second connection point 906.

Due to the dimensions of the first and second radiation boosters 901, 902, the redundancy system 912 features at each internal port, when disconnected from the combining system, a first resonant frequency located above (i.e., higher than) the frequency region of operation of the radiating system. In this case, the ratio between the first resonant frequency of the redundancy system 912 at each internal port (when disconnected from the combining system) and the highest frequency of the frequency region of operation is advantageously larger than 4.

Being the first 901 and second radiation boosters 902 so small, and with the redundancy system including said first and second radiation boosters operating in a frequency much lower than the first resonant frequency at each internal port associated to each radiation booster, the input impedance of the redundancy system 912 (measured at each internal port when the combining system is disconnected) features an important reactive component within the range of frequencies of the frequency region of operation.

Furthermore, the embodiment of FIGS. 9A and 9B is also suitable for a radiating system operating in a frequency region of the electromagnetic spectrum between 1710 MHz and 2690 MHz. In this sense, the redundancy system operates in at least six frequency bands each one associated to a particular communication standard, namely GSM1800, GSM1900, UMTS, LTE2100, LTE2300, and LTE2500 or CDMA1800, CDMA1900, UMTS, LTE2100, LTE2300 and LTE2500.

In the embodiment associated to the 1710 MHz-2690 MHz frequency region, the first and second radiation boosters have each a maximum size smaller than 1/20 times the free-space wavelength corresponding to the lowest frequency of such frequency region of operation of the redundancy system 912, but advantageously larger than 1/120 times said free-space wavelength. Furthermore, the first resonance frequency at each of the first and second internal ports of the redundancy system 912 when disconnected from the combining system is also at a frequency much higher than the frequencies of the frequency region between 1710 MHz and 2690 MHz, that is, an input impedance at each of the internal ports of the redundancy system when disconnected from the combining system is non-resonant across the frequency region between 1710 MHz and 2690 MHz.

Figure 10:
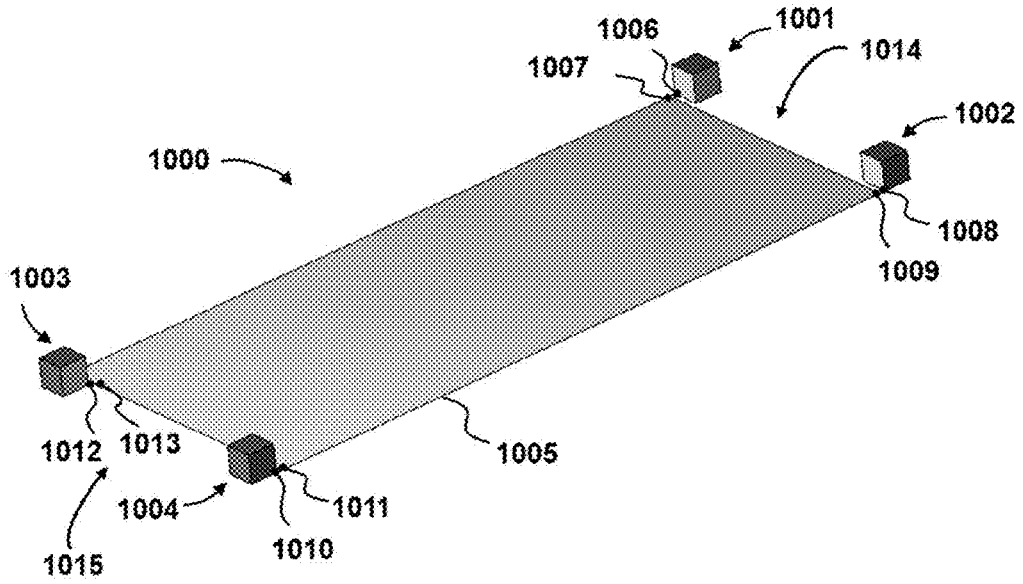
FIG. 10 shows an example of two redundancy systems for two radiating systems, the first redundancy system including two radiation boosters, the second redundancy system including two radiation boosters, and each radiation booster comprising a conductive part.

FIG. 10 shows a preferred embodiment of two redundancy systems for two radiating systems of a wireless device according to the present invention. Each redundancy system is capable of operating in a frequency region of the electromagnetic spectrum. In the embodiment 1000, if the first redundancy system 1014 provides operation in a first frequency region of the electromagnetic spectrum, the second redundancy system 1015 provides operation in a second frequency region of the electromagnetic spectrum; and if the first redundancy system 1014 provides operation in the second frequency region of the electromagnetic spectrum, the second redundancy system 1015 provides operation in the first frequency region of the electromagnetic spectrum. The first frequency region is located between 690 MHz and 960 MHz, and the second frequency region is located between 1710 MHz and 2690 MHz. In this sense, the embodiment 1000 is suitable for operating in at least nine frequency bands each one associated to a particular communication standard, namely LTE700, GSM850, WCDMA850, GSM900, WCDMA900, WCDMA1700, GSM1800, WCDMA1900, GSM1900, UMTS, LTE2100, LTE2300, and LTE2500.

The embodiment 1000 comprises two redundancy systems; a first redundancy system 1014 and a second redundancy system 1015. The first redundancy system comprises two radiation boosters 1001 and 1002, and the second redundancy system comprises two radiation boosters 1003 and 1004. The four radiation boosters are located on a substantially rectangular ground plane layer 1005. The radiation boosters 1001, 1002, 1003, and 1004 include a conductive part featuring a polyhedral shape comprising six faces. This example is based on FIGS. 9A and 9B, further including a replica of the first and second radiation boosters 901 and 902 at a different edge of the ground plane layer.

In the case of the first redundancy system 1014, the first radiation booster 1001 comprises a connection point 1006, and the ground plane layer 1005 comprises a first connection point 1007 substantially on a corner of the ground plane layer. A first internal port of the first redundancy system 1014 is defined between said connection point 1006 and said first connection point 1007. Furthermore, the second radiation booster 1002 comprises a connection point 1008, and the ground plane layer 1005 comprises a second connection point 1009 substantially on another corner of the ground plane layer 1005. A second internal port of the first redundancy system 1014 is defined between said connection point 1008 and said second connection point 1009. Each internal port of the first redundancy system 1014 is connected to a port of a combining system; the first internal port defined by the connection points 1006 and 1007 is connected to a port of the combining system, and the second internal port defined by the connection points 1008 and 1009 is connected to another port of the combining system.

In the case of the second redundancy system 1015, a first radiation booster 1003 comprises a connection point 1012, and the ground plane layer 1005 comprises a first connection point 1013 substantially on a corner of the ground plane layer 1005. A first internal port of the second redundancy system 1015 is defined between said connection point 1012 and said first connection point 1013. Furthermore, the second radiation booster 1004 comprises a connection point 1010, and the ground plane layer 1005 comprises a second connection point 1011 substantially on another corner of the ground plane layer 1005. A second internal port of the second redundancy system 1015 is defined between said connection point 1010 and said second connection point 1011. Each internal port of the second redundancy system 1015 is connected to a port of a combining system; the first internal port defined by the connection points 1012 and 1013 is connected to a port of the combining system, and the second internal port defined by the connection points 1010 and 1011 is connected to another port of the combining system.

Figure 11:
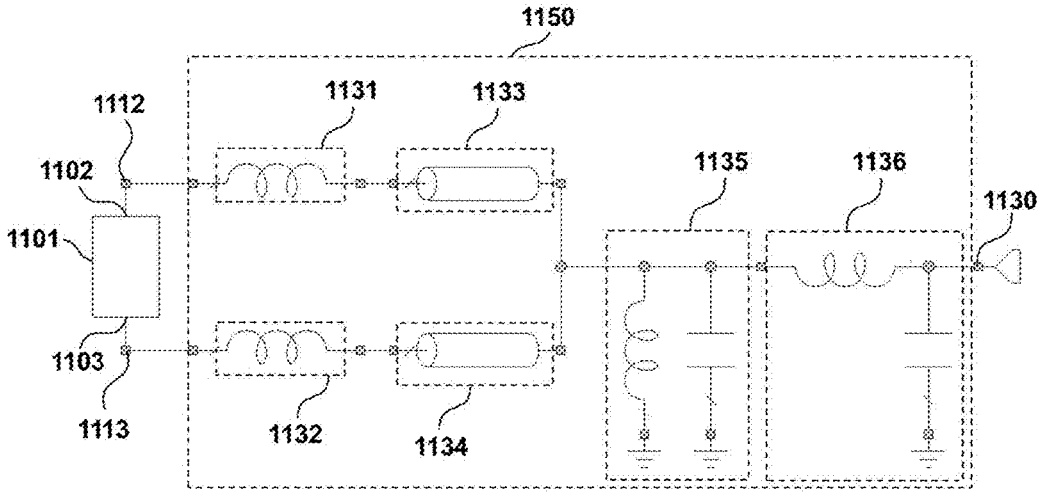
FIG. 11 shows a schematic representation of an in-phase combining system for a radiating system whose redundancy system is shown in FIGS. 9A and 9B.

FIG. 11 shows a schematic representation of an in-phase combining system 1150 connected to the two internal ports 1102, 1103 of the redundancy system 1101. Furthermore, said in-phase combining system may be also connected to the two internal ports of the redundancy system 912, or the two internal ports of the first redundancy system 1014, or to the two internal ports of the second redundancy system 1015, or other redundancy system comprising two internal ports. The combining system comprises two ports 1112, 1113 connected respectively to the first 1002 and second internal ports 1003 of the redundancy system 1101, and a third port 1130 connected to an external port of the radiating system. The combining system also comprises a first reactance cancellation element 1131 connected to the port 1112, a second reactance cancellation element 1132 connected to the port 1113, a first delay module 1133 connected to the first reactance cancellation element, a second delay module 1134 connected to the second reactance cancellation element, a broadband matching circuit 1135 connected to the first and second delay modules, and a fine tuning stage 1136 interconnected between the broadband matching circuit and the external port of the radiating system. The reactance cancellation element comprises a series inductor; the delay module comprises a transmission line; the broadband matching circuit comprises a Pi-shaped matching network formed by a parallel inductor and a parallel capacitor; the fine tuning stage comprises and L-shaped matching network formed by a series inductor and a parallel capacitor.

Figure 12A:
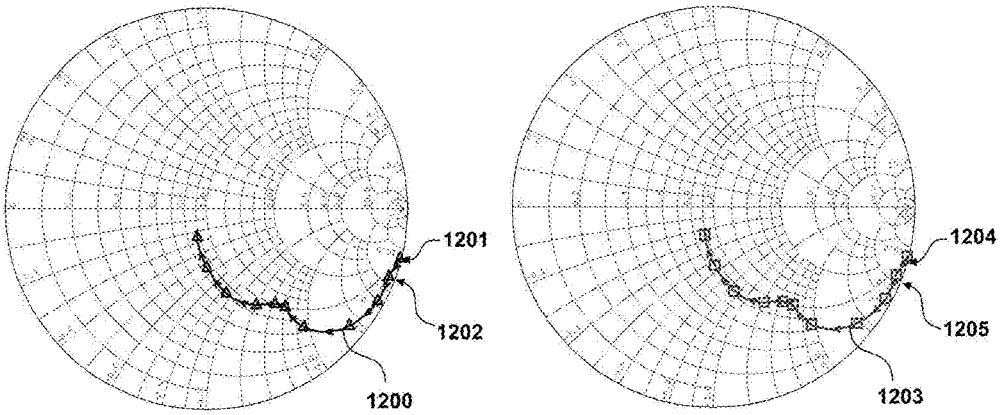
FIG. 12A illustrates the input impedance at the first internal port and at the second internal port of the redundancy system of FIGS. 9A and 9B when disconnected from the in-phase combining system of FIG. 11.

The in-phase combining system transforms the input impedance of the redundancy system 1101, providing impedance matching to the radiating system in the frequency region of operation. In order to show the impedance transformation provided by the in-phase combining system of FIG. 11 to the redundancy system 1101, FIGS. 12A to 12E represent the impedance transformation step by step. FIG. 12A illustrates a Smith chart representation for the input impedance at the first internal port and the second internal port of the redundancy system when it is disconnected from the in-phase combing system of FIG. 11. In this representation, the redundancy system 1101 corresponds to the redundancy system 912 of FIGS. 9A and 9B. Curve 1200 represents the input impedance at the first internal port 1102 of the redundancy system 1101, point 1201 corresponds to the input impedance at the lowest frequency of the frequency region of operation, and point 1202 corresponds to the input impedance at the highest frequency of the frequency region of operation. Curve 1203 represents the input impedance at the second internal port of the redundancy system 1101, point 1204 corresponds to the input impedance at the lowest frequency of the frequency region of operation, and point 1205 corresponds to the input impedance at the highest frequency of the frequency region of operation. As curves 1200 and 1203 are located on the lower half of the Smith chart, the input impedance at the first and second internal ports of the redundancy system has a capacitive component (i.e., the imaginary part of the input impedance is negative) for the frequencies of the frequency region of operation (i.e., between point 1201-1202 and between points 1204-1205). In this case, the input impedance associated to the first and second internal ports within the frequency region of operation are substantially similar. According to the present invention, the input impedance at the internal ports of the redundancy system may be different, such as for example, if different radiation boosters are used to excite the ground plane radiation mode.

Figure 12B:
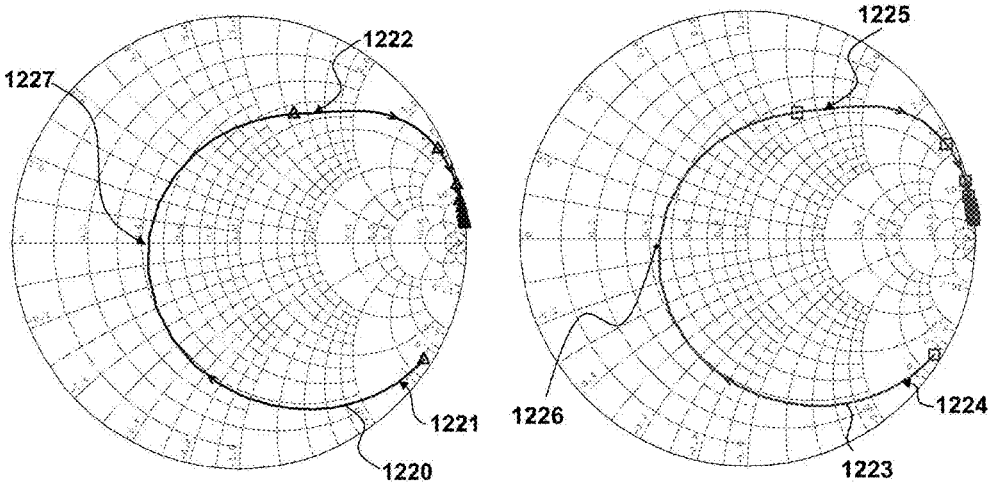
FIG. 12B illustrates the typical impedance transformation caused by the in-phase combining system illustrated in FIG. 11 on the input impedance of the redundancy system of FIGS. 9A and 9B; the input impedance is illustrated after the connection of a reactance cancellation element to each internal port of the two radiation boosters.

FIG. 12B illustrates the impedance 1220 measured after the addition of a first reactance cancellation element 1131 to the port 1112 of the combining system when no delay modules, no broadband matching circuit and no tuning circuit are connected. As a result of the first reactance cancellation element, the input impedance 1220 has an imaginary part substantially close to zero in the frequency region of operation. The impedance 1220 crosses the horizontal axis of the Smith Chart at a point 1227 located between point 1221 and point 1222, which means that the impedance 1220 has an imaginary part equal to zero for a frequency advantageously between the lowest 1221 and highest 1222 frequencies of the frequency region of operation. The impedance after the addition of the first reactance cancellation element 1131 shows a resonance at a frequency located within the frequency region of operation. FIG. 12B also illustrates the impedance 1223 measured after the addition of a second reactance cancellation element 1132 to the port 1113 of the combining system when no delay modules, no broadband matching circuit and no tuning circuit are connected. As a result of the second reactance cancellation element, the input impedance 1223 has an imaginary part substantially close to zero in the frequency region of operation. The impedance 1223 crosses the horizontal axis of the Smith Chart at a point 1226 located between point 1224 and point 1225, which means that the impedance 1223 has an imaginary part equal to zero for a frequency advantageously between the lowest 1224 and highest 1225 frequencies of the frequency region of operation. The impedance after the addition of the second reactance cancellation element 1132 shows a resonance behavior at a frequency allocated within the frequency region of operation.

Figure 12C:
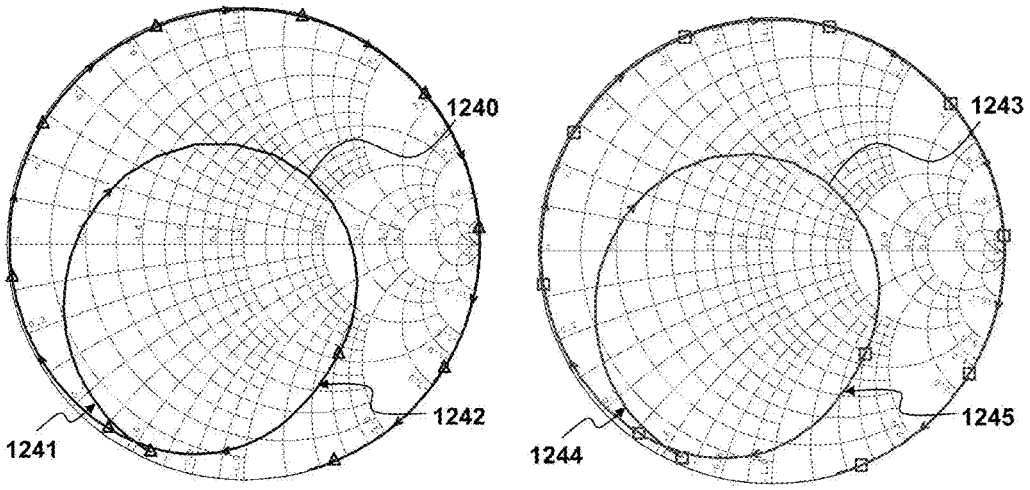
FIG. 12C illustrates the typical impedance transformation caused by the in-phase combining system illustrated in FIG. 11 on the input impedance of the redundancy system of FIGS. 9A and 9B; the input impedance is illustrated after the connection of a delay module to each reactance cancellation element.

FIG. 12C illustrates the first impedance 1240 measured after the connection of the first delay module 1133 to the first reactance cancellation element 1131 when no broadband matching circuit and no tuning circuit are connected. The first delay module enables the apparition of a first impedance loop 1240 at the frequency region of operation; points 1241 and 1242 stand respectively for the lowest and highest frequencies of the frequency region of operation. FIG. 12C also illustrates the second impedance 1243 measured after the connection of the second delay module 1134 to the second reactance cancellation element 1132 when no broadband matching circuit and no tuning circuit are connected. The second delay module enables the apparition of a second impedance loop 1243 at the frequency region of operation; points 1244 and 1245 stand respectively for the lowest and highest frequencies of the frequency region of operation.

According to the first impedance 1240 and the second impedance 1243 plotted in FIG. 12C, an in-phase feeding scheme is used by the combining system of FIG. 11. The phase of the first impedance 1240 measured after the first delay module is in-phase of the second impedance 1243 measured after the second delay module; the in-phase difference (absolute value) is 1.3° that is smaller than 45°.

In this embodiment, an average resistance of the first impedance 1240 differs from an average resistance of the second impedance 1243 by 2.9%; being such difference smaller than 30%.

The first delay means comprises a transmission line featuring a characteristic impedance of 50 ohms, and the second delay means also comprises a transmission line featuring a characteristic impedance of 50 ohms. The length of the transmission lines is configured to ensure that the first impedance 1240 is in-phase with the second impedance 1243.

Figure 12D:
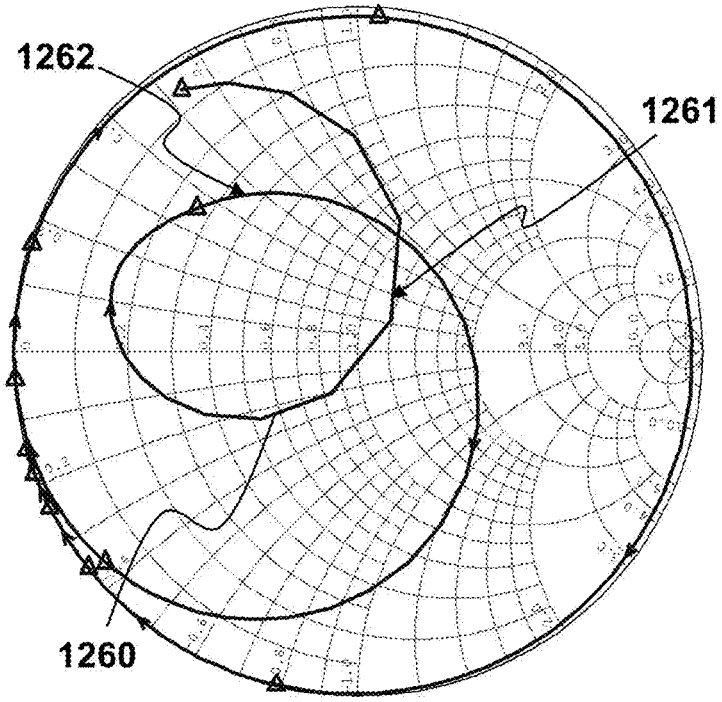
FIG. 12D illustrates the typical impedance transformation caused by the in-phase combining system illustrated in FIG. 11 on the input impedance of the redundancy system of FIGS. 9A and 9B; the input impedance is illustrated after the connection of a broadband matching circuit to the delay module.

FIG. 12D illustrates the impedance 1260 after the addition of the broadband matching circuit 1135 when no fine tuning circuit is connected; at this stage the first impedance 1240 and the second impedance 1243 impedance are combined into a single port. The broadband matching circuit enables a more compact impedance loop 1260 than the impedance loops 1240 and 1243 in FIG. 12C. Points 1261 and 1262 stand respectively for the lowest and highest frequencies of the frequency region of operation.

Figure 12E:
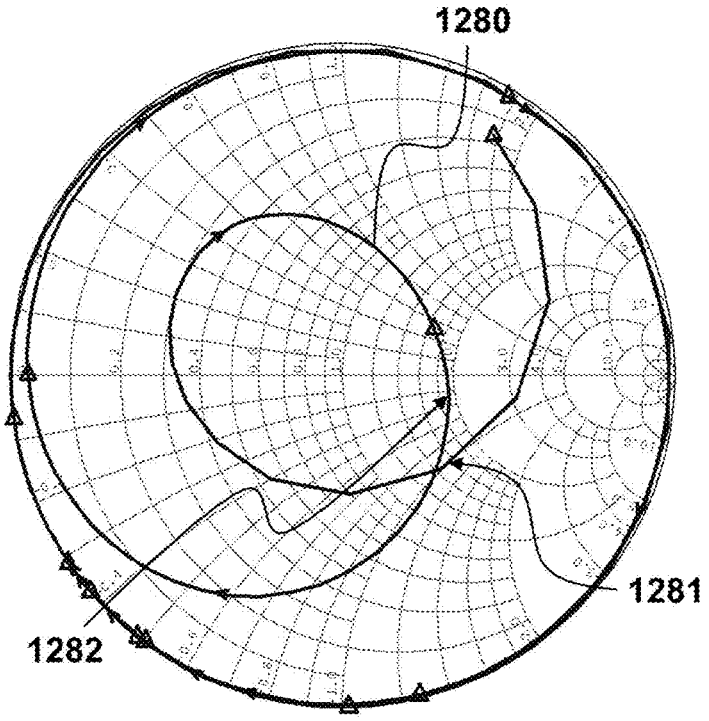
FIG. 12E illustrates the typical impedance transformation caused by the in-phase combining system illustrated in FIG. 11 on the input impedance of the redundancy system of FIGS. 9A and 9B; the input impedance is illustrated after the connection of a fine tuning circuit to the broadband matching circuit, being the input impedance measured at the external port of the radiating system.

Finally, FIG. 12E illustrates the impedance 1280 after the addition of the fine tuning circuit 1136; such impedance 1280 is measured at the external port of the radiating system. The fine tuning stage 1136 places the impedance loop 1280 at the center of the Smith chart inscribed in a circle of VSWR≤3, referred to a reference impedance of 50 Ohms. Points 1281 and 1282 stand respectively for the lowest and highest frequencies of the frequency region of operation.

Figure 12F:
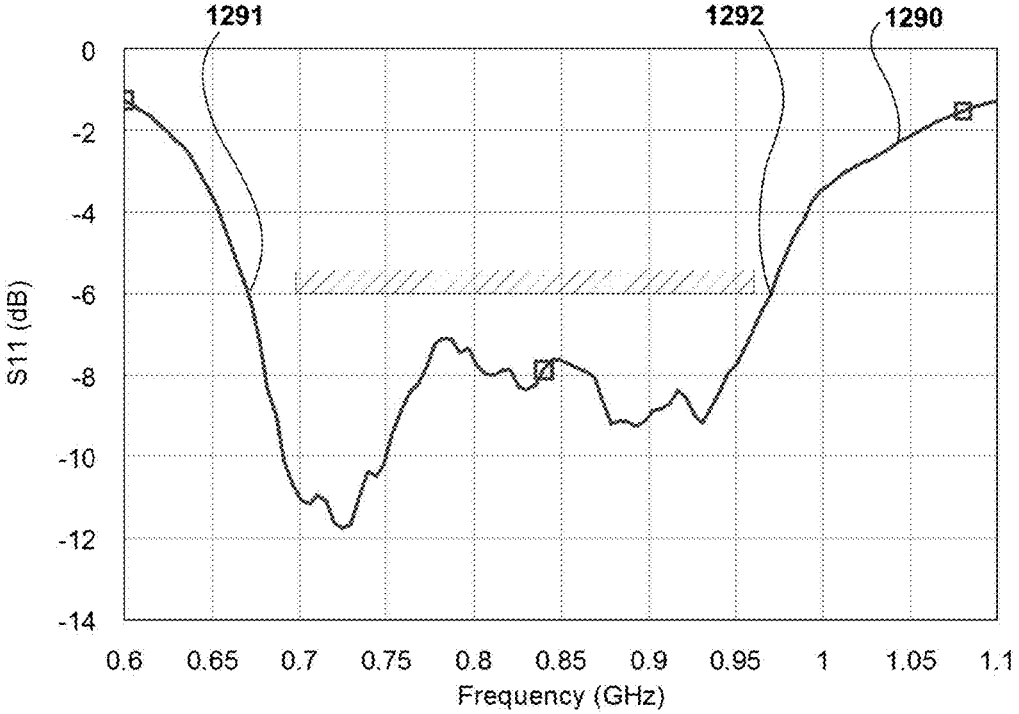
FIG. 12F illustrates the reflection coefficient measured at the external port of the radiating system resulting from the interconnection of the in-phase combining system of FIG. 11 to the redundancy system of FIGS. 9A and 9B.

The frequency response of the radiating system resulting from the interconnection of the combining system of FIG. 11 to the redundancy system of FIGS. 9A and 9B is shown in FIG. 12F. The curve 1290 represents the reflection coefficient measured at the external port of the radiating system. The reflection coefficient 1290 is below −6 dB in the frequency region of operation; the frequency region of operation being delimited by the points 1291 and 1292. The radiating system is configured to operate in a frequency region between 690 MHz and 960 MHz, which is delimited in the FIG. 12F by a reference line at −6 dB; the point 1291 corresponds to the lowest frequency and the point 1292 corresponds to the highest frequency with a reflection coefficient below −6 dB. The radiating system is suitable for operating in the cellular communication standards LTE700, GSM850 and GSM900. In this sense, such radiating system operates in at least three frequency bands allocated in the frequency region of operation; being the first frequency band between 690-787 MHz, the second frequency band between 824-894 MHz, and the third frequency band between 890 MHz-960 MHz.

Figure 13:
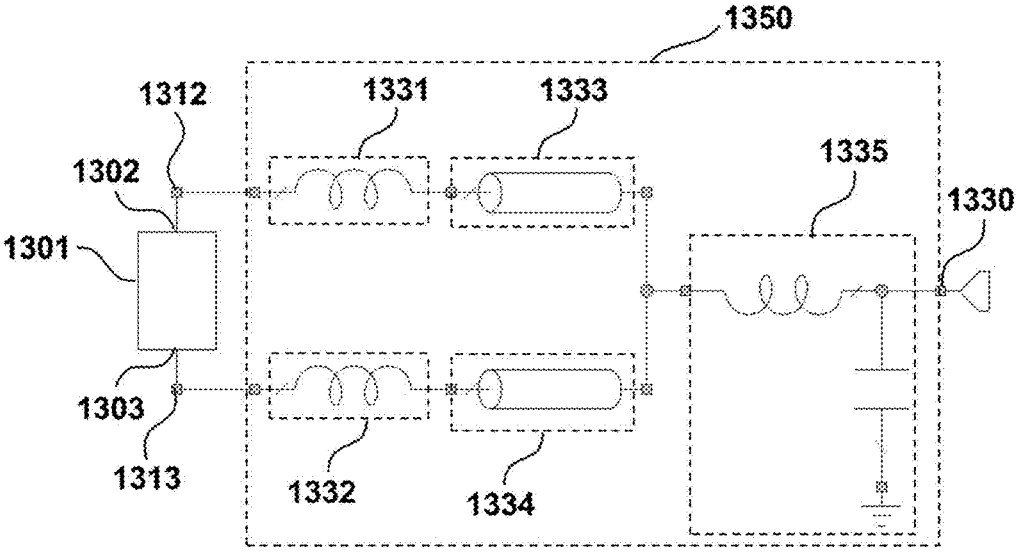
FIG. 13 shows a schematic representation of an out-of-phase combining system for a radiating system whose redundancy system is illustrated in FIGS. 9A and 9B.

FIG. 13 shows a schematic representation of an out-of-phase combining system 1350 connected to the two internal ports 1302, 1303 of the redundancy system 1301. Furthermore, said out-of-phase combining system may be also connected to the two internal ports of the redundancy system 912, or to the two internal ports of the first redundancy system 1014, or to the two internal ports of the second redundancy system 1015, or to other redundancy system comprising two internal ports. The combining system comprises two ports 1312, 1313 connected respectively to the first 1302 and second 1303 internal ports of the redundancy system 1301, and a third port 1330 connected to an external port of the radiating system. The combining system also comprises a first reactance cancellation element 1331 connected to the port 1312, a second reactance cancellation element 1332 connected to the port 1313, a first delay module 1333 connected to the first reactance cancellation element, a second delay module 1334 connected to the second reactance cancellation element, a fine tuning circuit 1135 connected to the first and second delay modules, and to the external port of the radiating system. The reactance cancellation elements comprises a series inductor; the delay modules comprises a transmission line; and the fine tuning stage comprises and L-shaped matching network formed by a series inductor and a parallel capacitor.

Figure 14A:
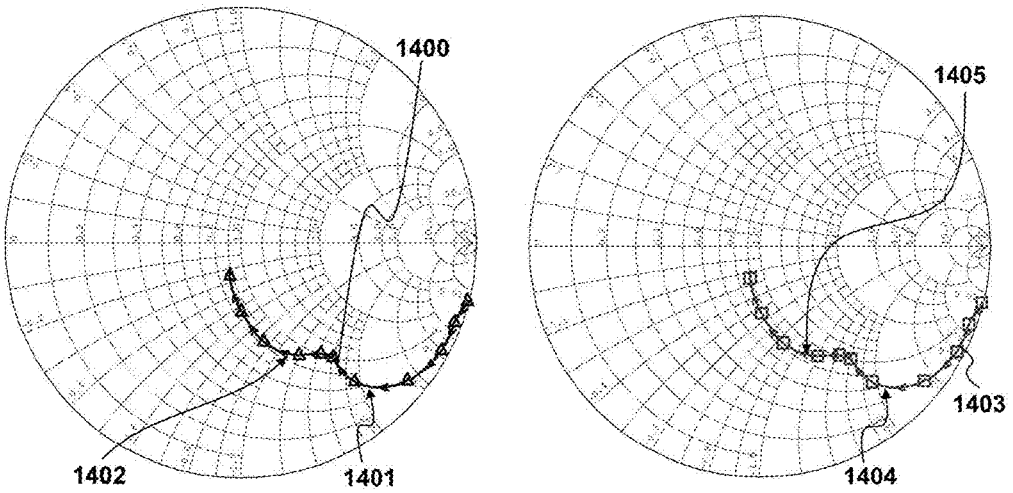
FIG. 14A illustrates the input impedance at the first internal port and the second internal port of the redundancy system of FIGS. 9A and 9B when disconnected from the out-of-phase combining system of FIG. 13.

The out-of-phase combining system transforms the input impedance of the redundancy system 1301, providing impedance matching to the radiating system in a frequency region of operation. In order to show the impedance transformation provided by the out-of-phase combining system of FIG. 13 to the redundancy system 1301, FIGS. 14A-14D represent the impedance transformation step by step. FIG. 14A illustrates a Smith chart representation for the input impedance at the first internal port and the second internal port of the redundancy system when it is disconnected from the out-of-phase combing system of FIG. 13. In this representation, the redundancy system 1301 corresponds to the redundancy system 1015 of FIG. 10. Curve 1400 represents the input impedance at the first internal port 1302 of the redundancy system 1301, point 1401 corresponds to the input impedance at the lowest frequency of the frequency region of operation, and point 1402 corresponds to the input impedance at the highest frequency of the frequency region of operation. Curve 1403 represents the input impedance at the second internal port 1303 of the redundancy system 1301, point 1404 corresponds to the input impedance at the lowest frequency of the frequency region of operation, and point 1405 corresponds to the input impedance at the highest frequency of the frequency region of operation. As curves 1400 and 1403 are located on the lower half of the Smith chart, the input impedance at the first and second internal ports of the redundancy system has a reactive component, in particular a capacitive component (i.e., the imaginary part of the input impedance is negative) for the frequencies of the frequency region of operation (i.e., between point 1401-1402 and between points 1404-1405). In this case, the input impedance associated to the first and second internal ports within the frequency region of operation are substantially similar. According to the present invention, the input impedance at the internal ports of the redundancy system may be different, such as for example, if different radiation boosters are used to excite the ground plane radiation mode. The points 1401 and 1402 correspond respectively to 1710 MHz and 2690 MHz; and the points 1404 and 1405 correspond respectively to 1710 MHz and 2690 MHz.

Figure 14B:
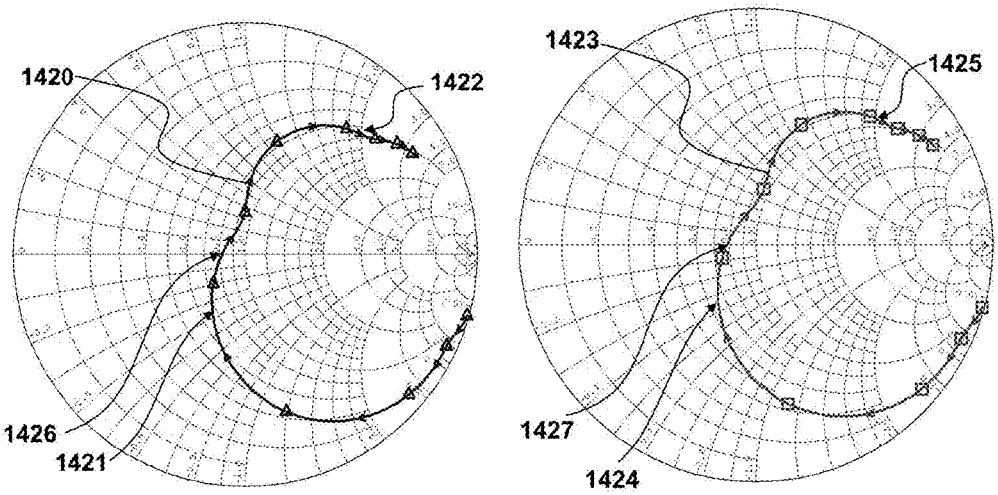
FIG. 14B illustrates the typical impedance transformation caused by the out-of-phase combining system illustrated in FIG. 13 on the input impedance of the redundancy system of FIGS. 9A and 9B; the input impedance is illustrated after the connection of a reactance cancellation element to each internal port of the two radiation boosters.

FIG. 14B illustrates the impedance 1420 measured after the addition of a first reactance cancellation element 1331 to the port 1312 of the combining system when no delay modules, and no tuning circuit are connected. As a result of the first reactance cancellation element, the input impedance 1420 has an imaginary part substantially close to zero in the frequency region of operation. The impedance 1420 crosses the horizontal axis of the Smith Chart at a point 1426 located between point 1421 and point 1422, which means that the impedance 1420 has an imaginary part equal to zero for a frequency advantageously between the lowest 1421 and highest 1422 frequencies of the frequency region of operation. The impedance after the addition of the first reactance cancellation element 1331 shows a resonance at a frequency located within the frequency region of operation. FIG. 14B also illustrates the impedance 1423 measured after the addition of a second reactance cancellation element 1332 to the port 1313 of the combining system when no delay modules, and no tuning circuit are connected. As a result of the second reactance cancellation element, the input impedance 1423 has an imaginary part substantially close to zero in the frequency region of operation. The impedance 1423 crosses the horizontal axis of the Smith Chart at a point 1427 located between point 1424 and point 1425, which means that the impedance 1423 has an imaginary part equal to zero for a frequency advantageously between the lowest 1424 and highest 1425 frequencies of the frequency region of operation. The impedance after the addition of the second reactance cancellation element 1332 shows a resonance behavior at a frequency located within the frequency region of operation.

Figure 14C:
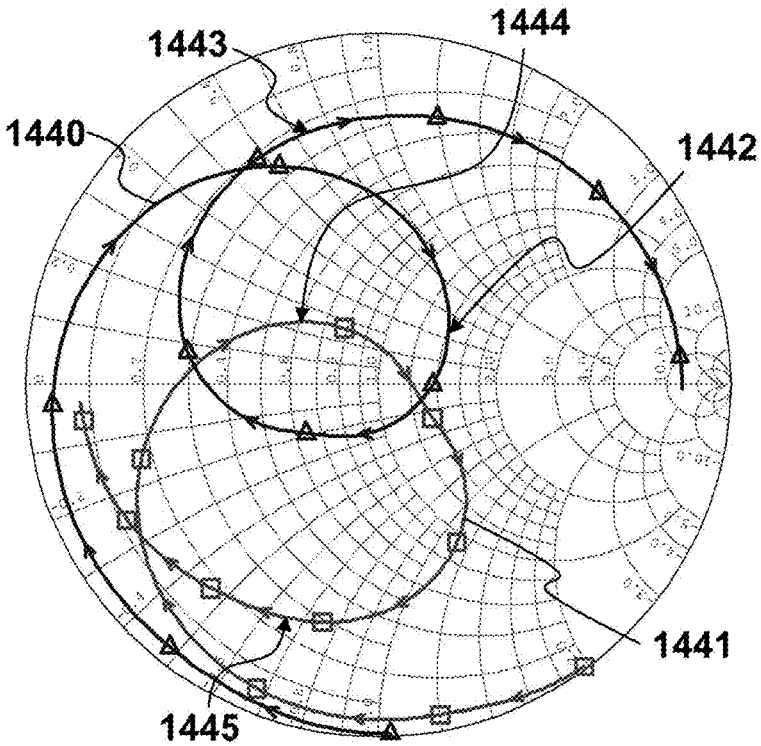
FIG. 14C illustrates the typical impedance transformation caused by the out-of-phase combining system illustrated in FIG. 13 on the input impedance of the redundancy system of FIGS. 9A and 9B; the input impedance is illustrated after the connection of a delay module to each reactance cancellation element.

FIG. 14C illustrates the first impedance 1440 measured after the connection of the first delay module 1333 to the first reactance cancellation element 1331 when no tuning circuit is connected. The first delay module enables the apparition of a first impedance loop 1440 at the frequency region of operation; points 1442 and 1443 stand respectively for the lowest and highest frequencies of the frequency region of operation. FIG. 14C also illustrates the second impedance 1441 measured after the connection of the second delay module 1334 to the second reactance cancellation element 1332 when no tuning circuit is connected. The second delay module enables the apparition of a second impedance loop 1441 at the frequency region of operation; points 1444 and 1445 stand respectively for the lowest and highest frequencies of the frequency region of operation. According to the first impedance 1440 and the second impedance 1441 plotted in FIG. 14C, an out-of-phase feeding scheme is used by the combining system of FIG. 13. The first impedance 1440 measured after the first delay module is out-of-phase with the second impedance 1441 measured after the second delay module since the out-of-phase difference (absolute value) is 247°. That is, such phase difference is between 45° and 315° as required in the present document for the first impedance to be out-of-phase of the second impedance.

In this embodiment, an average resistance of the first impedance 1440 differs from an average resistance of the second impedance 1441 by 14.7%; being such difference smaller than 30%.

The first delay module enables a first compact impedance loop 1440, and the second delay module enables a second compact impedance loop 1441. The first delay means comprises a transmission line featuring a characteristic impedance of 50 ohms and the second delay means also comprises a transmission line featuring a characteristic impedance of 50 ohms. The length of the transmission lines is configured to ensure that the first impedance 1440 is out-of-phase with the second impedance 1441. Thus, the impedance and length of the transmission lines are selected to enable compact impedance loops at the first and second impedances as shown in FIG. 14C.

Figure 14D:
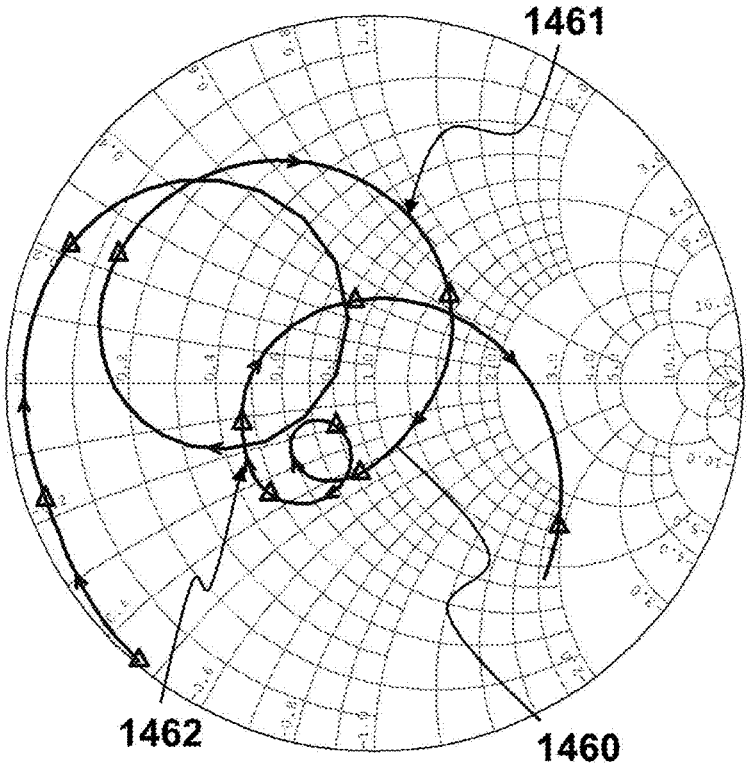
FIG. 14D illustrates the typical impedance transformation caused by the out-of-phase combining system illustrated in FIG. 13 on the input impedance of the redundancy system of FIGS. 9A and 9B; the input impedance is illustrated after the connection of a fine tuning circuit to the delay module, being the input impedance measured at the external port of the radiating system.

FIG. 14D illustrates the impedance 1460 after the addition of the fine tuning circuit 1335; such impedance 1460 is measure at the external port of the radiating system. At this stage, the first impedance 1440 and the second impedance 1441 are combined into a single port. The fine tuning circuit enables a more compact impedance loop 1460 than the impedance loops 1440 and 1441 in FIG. 14C. Points 1461 and 1462 stand respectively for the lowest and highest frequencies of the frequency region of operation. The fine tuning stage 1335 places the impedance loop 1460 at the center of the Smith chart inscribed in a circle of VSWR≤3, referred to a reference impedance of 50 Ohms.

Figure 15:
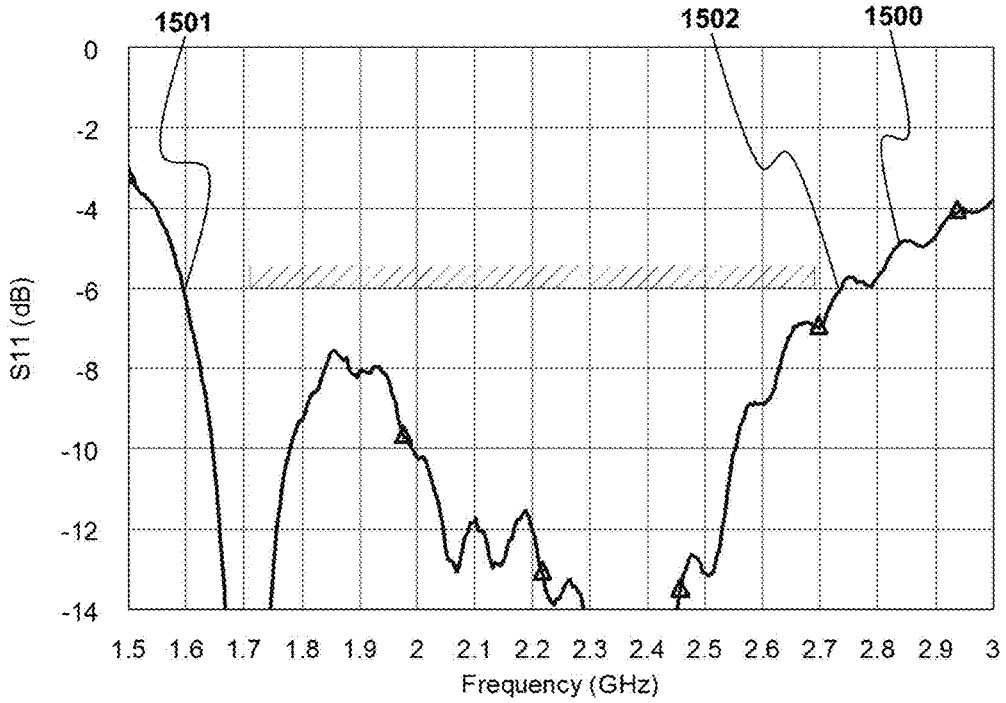
FIG. 15 illustrates the reflection coefficient measured at the external port of the radiating system resulting from the interconnection of the out-of-phase combining system of FIG. 13 to the redundancy system of FIGS. 9A and 9B.

The frequency response of the radiating system resulting from the interconnection of the combining system of FIG. 13 to the redundancy system 1015 of FIG. 10 is shown in FIG. 15. The curve 1500 represents the reflection coefficient measured at the external port of the radiating system. The reflection coefficient 1500 is below −6 dB in the frequency region of operation; the frequency region of operation being delimited by the points 1501 and 1502. Such radiating system is configured to operate in a frequency region between 1710 MHz and 2690 MHz; which is delimited in FIG. 15 by a reference line at −6 dB. The radiating system is suitable for operating in the cellular communication standards GSM1800, CDMA1900, UMTS, LTE2100, LTE2300, and LTE2500. In this sense, such radiating system operates in at least six frequency bands allocated in the frequency region of operation; being the first frequency band between 1710 MHz and 1880 MHz, the second frequency band between 1850 MHz and 1990 MHz, the third frequency band between 1920 MHz and 2100 MHz, the fourth frequency band between 1920 MHz and 2170 MHz, the five frequency band between 2300 MHz and 2400 MHz, and the sixth frequency band 2500 MHz and 2690 MHz.

The radiation patterns associated to the proposed radiating systems are mainly determined by the ground plane modes. In the case of the radiating system operating in the frequency region between 690 MHz and 960 MHz, the radiation pattern is substantially omni-directional. Furthermore, the radiating system operating in the frequency region between 1710 MHz and 2690 MHz, the radiation pattern is substantially omni-directional.

The radiating system resulting from the interconnection of the combining system 1150 of FIG. 11 to the redundancy system 912 of FIGS. 9A and 9B uses two radiation boosters to provide service in the frequency region of operation between 690 MHz and 960 MHz; in this document said radiating system is referred as LFR radiating system. As two radiation boosters are used to provide operation in the frequency region of operation, the LFR radiating system is more robust to human loading effects than a radiating system using a single radiation booster to provide service in the frequency region of operation.

In order to illustrate the robustness to human loading effects of the present invention, the electromagnetic behavior of the LFR radiating system is compared with the electromagnetic behavior of a radiating system that uses a single radiation booster to provide operation in the frequency region of operation. In this document, said radiation system that uses a single radiation booster is referred as SB radiating system, and its radiating structure is referred as SB radiating structure.

Figure 16A:
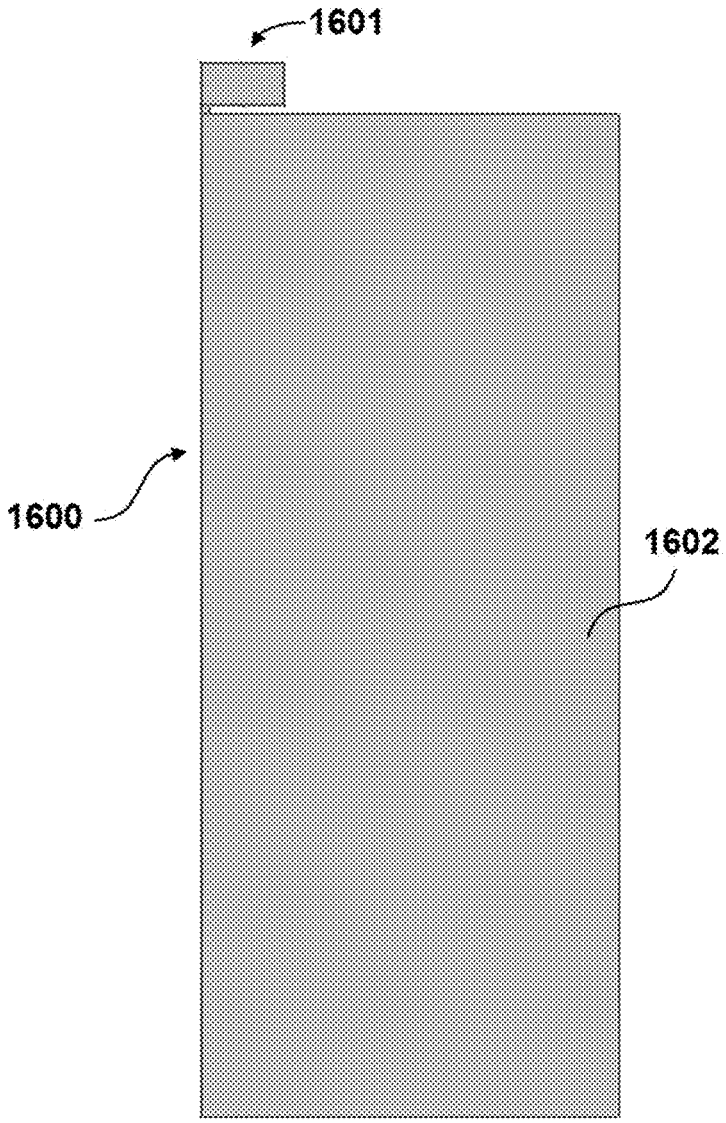
FIG. 16A shows a planar view of a prior-art radiating structure for a radiating system; the radiating structure having a single radiation booster.
Figure 16B:
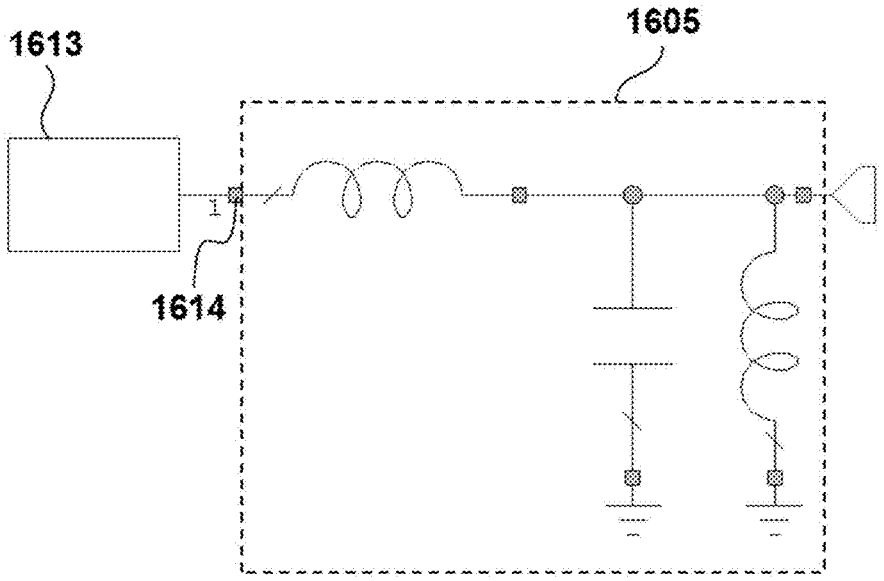
FIG. 16B shows a schematic representation of a radiofrequency system for the radiating structure illustrated in FIG. 16A.

FIG. 16A shows an example of a SB radiating structure; the SB radiating structure 1600 comprises only one radiation booster 1601 and a ground plane layer 1602. FIG. 16B shows a schematic representation of a radiofrequency system 1605 connected to the internal port 1614 of the SB radiating structure 1613; the SB radiating structure 1613 corresponds to the SB radiating structure 1600 of FIG. 16A. A SB radiating system results from the interconnection of the SB radiating structure 1600, 1613 with the radiofrequency system 1605.

Figure 17:
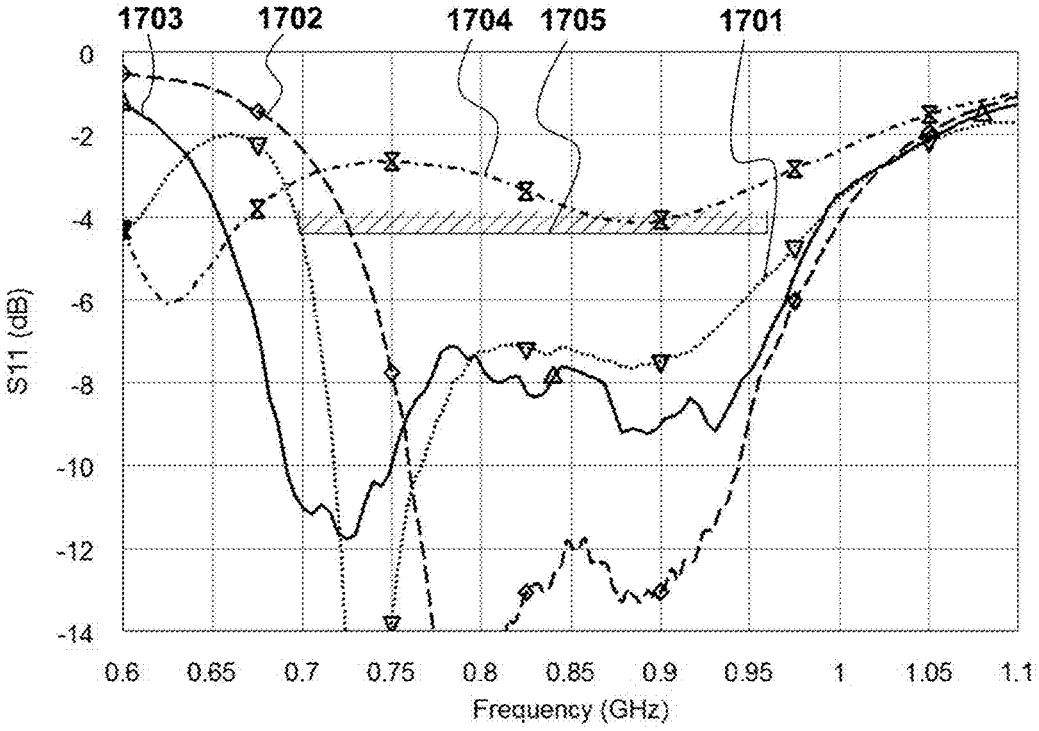
FIG. 17 illustrates the impact on the reflection coefficient of the human loading effects for the radiating system resulting from the interconnection of the in-phase combining system of FIG. 11 to the redundancy system of FIGS. 9A and 9B, and for the prior-art radiating system of FIGS. 16A and 16B. The reflection coefficient is measured at the external port of the radiating system in free-space and in the presence of human loading effect.

FIG. 17 illustrates the reflection coefficient of the LFR radiating system and the reflection coefficient of the SB radiating system considering the human loading effects. The curve 1702 represents the measured reflection coefficient for the SB radiating system in free space, and curve 1704 represents the measured reflection coefficient for the SB radiating system in the presence of human loading effects. Furthermore, curve 1703 represents the measured reflection coefficient for the LFR radiating system in free space, and curve 1701 represents the measured reflection coefficient for the LFR radiating system in the presence of human loading effects. In this example, the frequency region of operation is between 690 MHz and 960 MHz, the frequency region is delimited by the reference line 1705 in FIG. 17. In the case of the LFR radiating system, the human loading effect consists on blocking one of the radiation boosters with the hand. And in the case of the SB radiating system, the human loafing effect consists on blocking the radiation booster with the hand. As the SB radiating system only uses one radiation booster for providing operation in the frequency region of operation, the reflection coefficient 1704 is significantly modified by the presence of the human loading effect. As the LFR radiating system uses two radiation boosters for providing operation in the frequency region of operation, the reflection coefficient 1701 is not substantially modified by the presence of the human loading effect. When considering the human loading effects, the level of the reflection coefficient for the LFR radiating system in the frequency region of operation allow the operation of the wireless device in the frequency region of operation, but the level of the reflection coefficient for SB radiating system in the frequency region of operation does not enable a suitable operation of the wireless device in the frequency region of operation.

Figure 18:
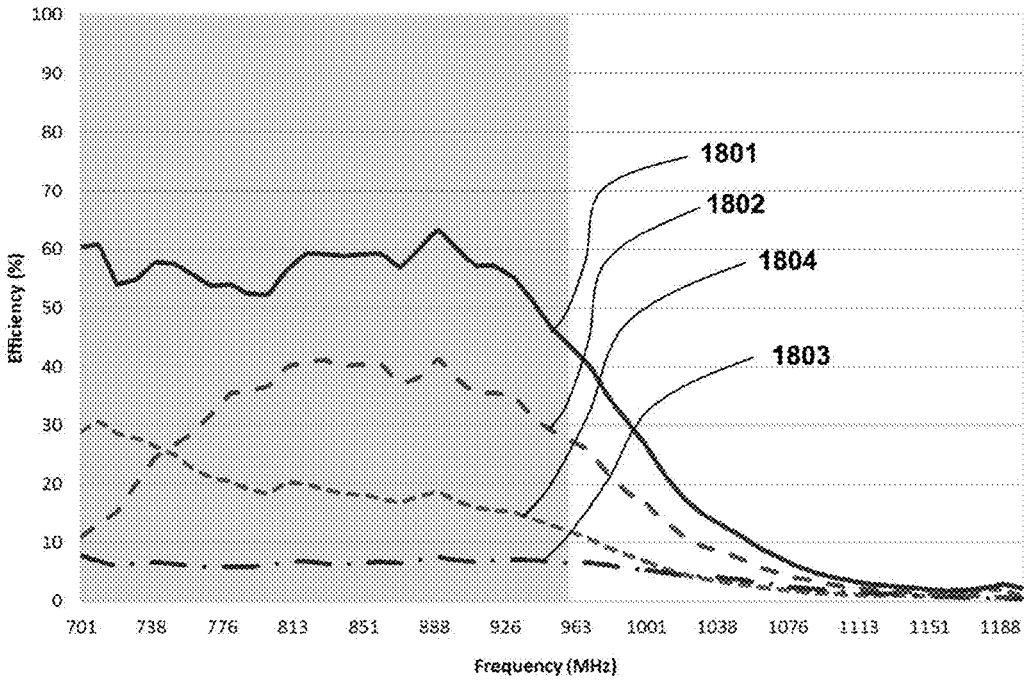
FIG. 18 illustrates the impact on the efficiency of the human loading effects for the radiating system resulting from the interconnection of the in-phase combining system of FIG. 11 to the redundancy system of FIGS. 9A and 9B, and for the prior-art radiating system of FIGS. 16A and 16B. The efficiency is measured at the external port of the radiating system in free-space and in the presence of human loading effect.

FIG. 18 illustrate the efficiency of the LFR radiating system and the efficiency of the SB radiating system considering the human loading effects. The curve 1802 represents the measured efficiency for the SB radiating system in free space, and curve 1803 represents the measured efficiency for the SB radiating system when considering the human loading effects. Furthermore, curve 1801 represents the measured efficiency for the LFR radiating system in free space, and curve 1804 represents the measured efficiency for the LFR radiating system when considering the human loading effects. In this example, the frequency region of operation is between 690 MHz and 960 MHz, the frequency region is delimited by the grey region in FIG. 18. The efficiency represented in FIG. 18 corresponds to the antenna efficiency ($\eta_a$) which takes into account the radiation efficiency ($\eta_r$) and mismatch losses ($1-|S_{11}|^2$), that is, $\eta_a=\eta_r\cdot(1-|S_{11}|^2)$. In the case of the LFR radiating system, the human loading effect consists on blocking one of the radiation boosters with the hand. And in the case of the SB radiating system, the human loading effect consists on blocking the radiation booster with the hand. As the SB radiating system uses only one radiation booster for providing operation in the frequency region of operation, the efficiency 1803 is significantly modified by the presence of the human loading effect. Due to the fact that the LFR radiating system uses two radiation boosters for providing operation in the frequency region of operation, the efficiency 1804 is more robust to human loading effects. The efficiency of the LFR radiating system across the frequency region of operation is larger than the efficiency of the SB radiating system across the frequency region of operation; being the LFR radiating system more robust to human loading effects.

When considering the human loading effects on the behavior of the wireless device, the LFR radiating system provides reflection coefficient levels and efficiency levels across the frequency region of operation which enable the operation of the wireless device across the frequency region of operation.

As a result of using a combining system with an in-phase feeding scheme, also referred in the present document as an in-phase combining system, the phase of the first impedance (Z1', 1240) and the phase of the second impedance (Z2', 1243) are substantially similar; being the first impedance and the second impedance represented in FIG. 12C. Such phase similarity guaranties a substantially balanced power distribution between the first radiation booster 901 and the second radiation booster 902 of the redundancy system 912 of FIG. 9A.

Figure 19:
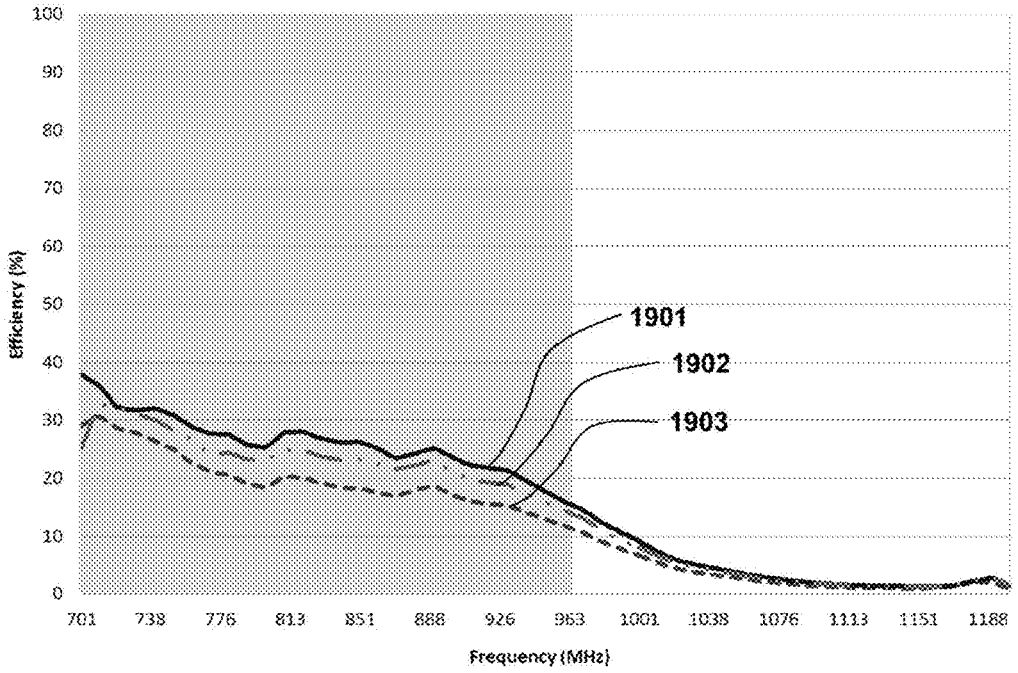
FIG. 19 illustrates the effect on the efficiency of a substantially balanced power distribution enabled by the in-phase combining system of FIG. 11.

In order to illustrate the technical effects derived from a substantially balanced power distribution provided by the combining system to the radiation boosters, FIG. 19 represents the efficiency of the LFR radiating system when considering the human loading effects. The efficiency of the LFR radiating system is represented for three different ways of human loading. The curve 1903 represents the efficiency when the first radiation booster 901 is blocked by the hand; the 1902 represents the efficiency when the second radiation booster 902 is blocked by the hand; the curve 1901 represents the efficiency when the hand is placed between the first and the second radiation boosters. As the first impedance 1240 is in-phase of the phase of the second impedance 1243, the in-phase combining system enables a substantially balanced power distribution between the first radiation booster 901 and the second radiation booster 902. As a result of such substantially balanced power distribution between the first and the second radiation booster, the efficiency of the LFR radiating system in the frequency region of operation is not significantly affected by the manner that the human loading is produced in the wireless device. In case of having a non-balanced power distribution among the radiation boosters, the efficiency of the radiating system would be significantly affected by the manner that the human loading is produced in the wireless device.

Figure 20:
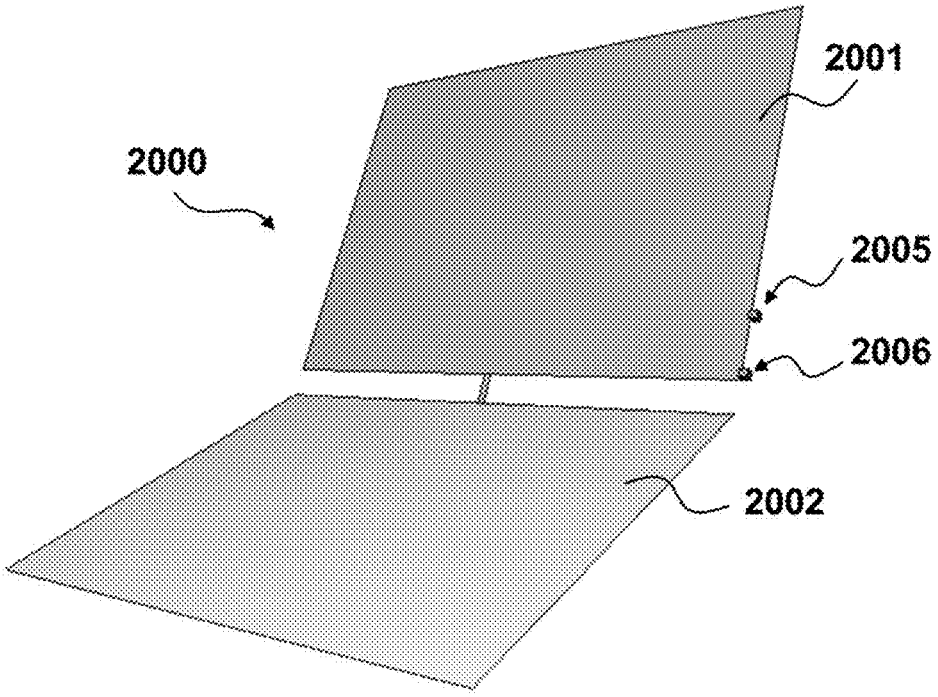
FIG. 20 illustrates another embodiment of a redundancy system representative of a laptop computer.

FIG. 20 shows an example of a redundancy system representative of a laptop computer. The redundancy system 2000 comprises two radiation boosters 2005 and 2006 and a ground plane layer 2001; the ground plane layer 2001 having dimensions and topology representative of a laptop computer. For this particular example, the radiation boosters 2005 and 2006 are arranged in the ground plane layer 2001; although in other example the radiation boosters could have been arranged in the ground plane layer 2002. In this example, the radiation boosters 2005 and 2006 are located along a short edge of the ground plane layer; although in other example the radiation boosters may be located along a long edge of the ground plane layer.

In this example, the radiation boosters 2005 and 2006 include a conductive part featuring a polyhedral shape comprising six faces, although in other example the radiation boosters may have different shape.

According to the invention, each one of the internal ports of the redundancy system could be connected to an in-phase combining system or to an out-of-phase combing system as those illustrated in FIGS. 8A-8C.

In this example the redundancy system includes two radiation boosters, although in other example the redundancy system could include three or more radiation boosters.

Figure 21:
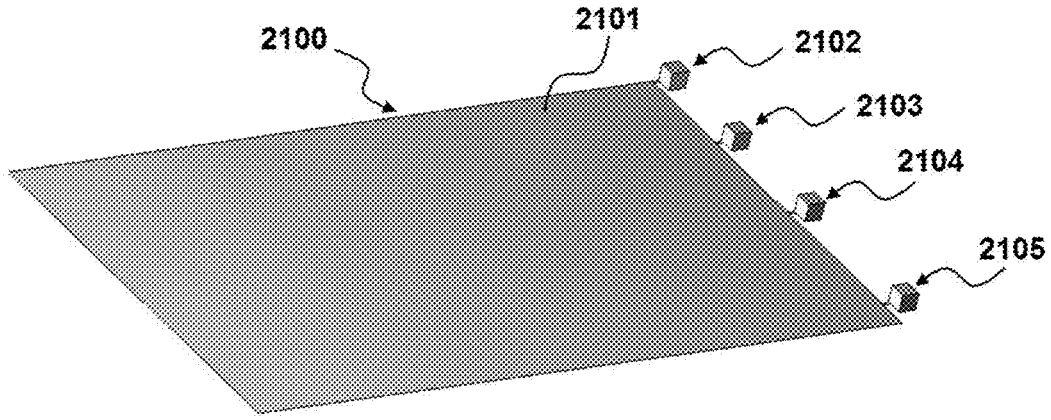
FIG. 21 illustrates another embodiment of a redundancy system representative of a tablet device.

FIG. 21 illustrates an example of a redundancy system representative of a tablet, e-book or similar device. The redundancy system 2100 comprises four radiation boosters 2102, 2103, 2104 and 2105 and a ground plane layer 2101. The four radiation boosters are arranged in a short edge of a substantially rectangular ground plane layer 2101.

In this example, the radiation boosters 2102, 2103, 2104, and 2105 comprise a conductive part featuring a polyhedral shape comprising six faces having a polygonal shape (in this example a square shape). Each radiation booster comprises a connection point located substantially on the perimeter of the conducting part; each connection point defines together with a connection point of the ground plane layer (not shown in the figure) an internal port of the redundancy system. In other examples, the radiation booster may have different shapes. According to the invention, each one of the internal ports of the redundancy system could be connected to an in-phase combining system or to an out-of-phase combing system.

Figure 22A:
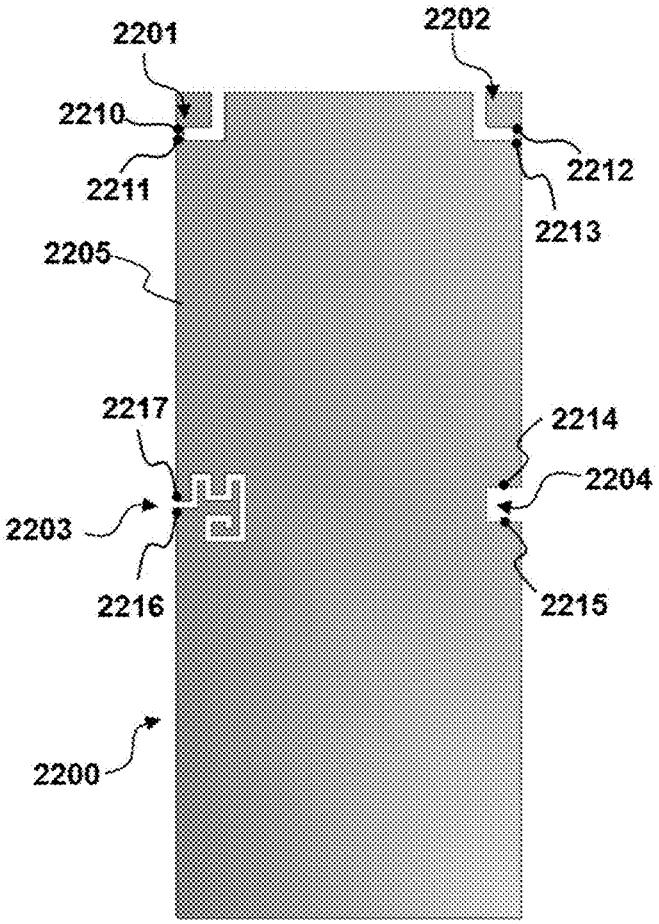
FIGS. 22A-22D illustrate further embodiments for redundancy systems according to the invention.

FIG. 22A shows an embodiment comprising radiation boosters with different shapes; the embodiment comprises four radiation boosters 2201, 2202, 2203 and 2204 and ground plane layer 2205.

The first radiation booster 2201 and the second radiation booster 2202 comprise a conductive part featuring a substantially volumetric shape comprising six faces.

The first radiation booster 2201 comprises a connection point 2210, and the ground plane layer 2205 comprises a connection point 2211 substantially on a corner of the ground plane layer 2205. An internal port is defined between the connection point 2210 and the connection point 2211. In the case of the second radiation booster 2205, an internal port is defined between the connection point 2212 of the radiation booster 2202 and the connection point 2213 of the ground plane layer 2205.

The first and second radiation boosters 2201 and 2202 are located at two different corners of the ground plane layer 2205.

The third radiation booster 2203 comprises a gap defined in a ground plane layer; wherein said radiation booster 2203 features a gap comprising at least ten segments. Such shaping of the radiation booster 2203 is suitable for reducing the value of a reactance cancellation element of a combining system. In this example, the reactance cancellation element required by the radiation booster 2203 is a capacitor. As a capacitor with low capacitance generally provides a higher quality factor than a capacitor with high capacitance, a capacitor with low capacitances is preferred. The elements with high quality factors have fewer losses than the elements having smaller quality factors, and the high quality factor elements contribute to the reduction of the losses of the combining system. In the case of the third radiation booster 2203, an internal port is defined between the connection point 2217 of the radiation booster 2203 and the connection point 2216 of the ground plane layer 2005.

The fourth radiation booster 2204 comprises a gap defined in the ground plane layer 2205, and a connection point 2215. The ground plane layer 2205 comprises a connection point 2214 which is substantially on the middle of the long edge of the ground plane layer 2205. An internal port of the redundancy system 2200 is defined between the connection point 2214 of the ground plane layer and the connection point 2215 of the radiation booster.

The radiation booster 2203 and 2204 are located substantially at the middle of the long edge of the ground plane layer 2205. Said location is preferred when an efficient radiation mode featuring a longitudinal current distribution in the ground plane layer 2205 is desired.

In some situations, the embodiment 2200 may be used to include a first redundancy system and a second redundancy system; the first redundancy system comprising two radiations boosters (2201 together with 2202 or 2201 together with 2203), and the second redundancy system comprising two radiation boosters (2203 together with 2204 or 2202 together with 2204). The first redundancy system providing operation a first frequency region, and the second redundancy system providing operation in a second frequency region.

In other situations, the embodiment 2200 may be used to include a redundancy system comprising four radiation boosters 2201, 2202, 2203 and 2204.

Figure 22B:
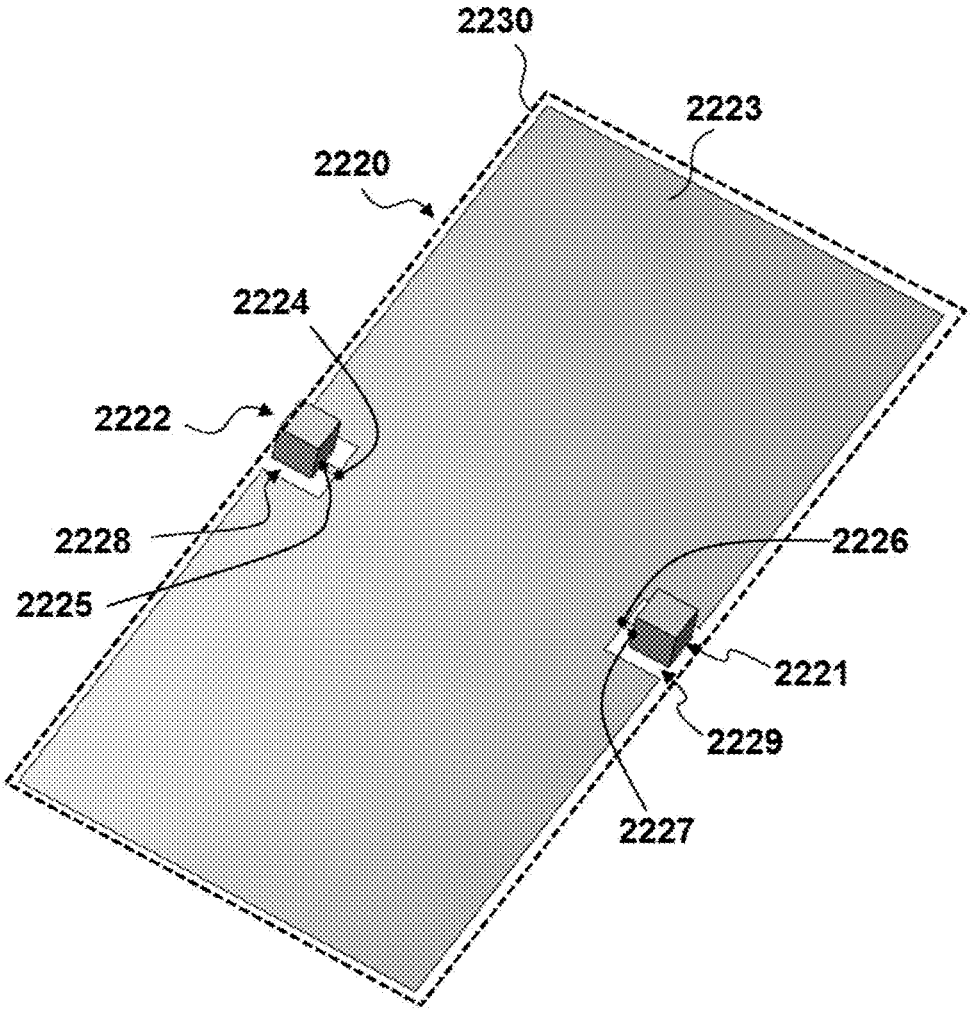

FIG. 22B illustrates a redundancy system 2220 comprising two radiation boosters 2221 and 2222 and a ground plane layer 2223. The first radiation booster 2222 and the second radiation booster 2221 comprise a conductive part featuring a substantially volumetric shape. The first radiation booster 2222 comprises a connection point 2225, and the ground plane layer 2223 comprises a first connection point 2224; a first internal port is defined between the connection point 2225 and the first connection point 2224. In the case of the second radiation booster 2221, a second internal port is defined between a connection point 2227 of the radiation booster 2221 and a second connection point 2226 of the ground plane layer 2223. The radiation boosters 2221 and 2222 are located substantially at the middle of the long edge of the ground plane layer 2223. Said location is preferred when an efficient radiation mode featuring a longitudinal current distribution in the ground plane layer 2223 is desired.

The ground plane layer 2223 includes two cut-out portions in which the metal has been removed from the ground plane layer 2223. A first cut-out portion 2228 and a second cut-out portion 2229 have been provided in the ground plane layer 2223. Despite the fact that the ground plane layer 2223 is irregularly shaped (compared to, for instance, the rectangular ground plane layer 907), it has a ground plane rectangle 2230 enclosing the ground plane layer 2223 equal to that associated to the ground plane layer 907.

The first radiation booster 2222 can now be provided on the first cut-out portion 2228, while the second radiation booster 2221 can be provided on the second cut-out portion 2229. That is, the radiation boosters 2221, 2222 have been receded towards the inside of the ground plane rectangle 2229, so that the orthogonal projection of the first and second radiation booster 2221, 2222 on the plane containing the ground plane layer 2223 is completely inside the perimeter of the ground plane rectangle 2230. Such a ground plane and arrangement of the radiation boosters with respect to the ground plane layer are advantageous to facilitate the integration of the redundancy system within a particular handheld or portable wireless device.

However, in another example one of the first or the second radiation booster could not have been arranged on a cut-out portion of the ground plane layer, and one radiation booster is completely outside the perimeter of the ground plane rectangle associated to the ground plane layer of the redundancy system. And yet in another example, both the first and the second radiation boosters could have been arranged at least partially, or even completely, protruding beyond a side of said ground plane rectangle.

Figure 22C:
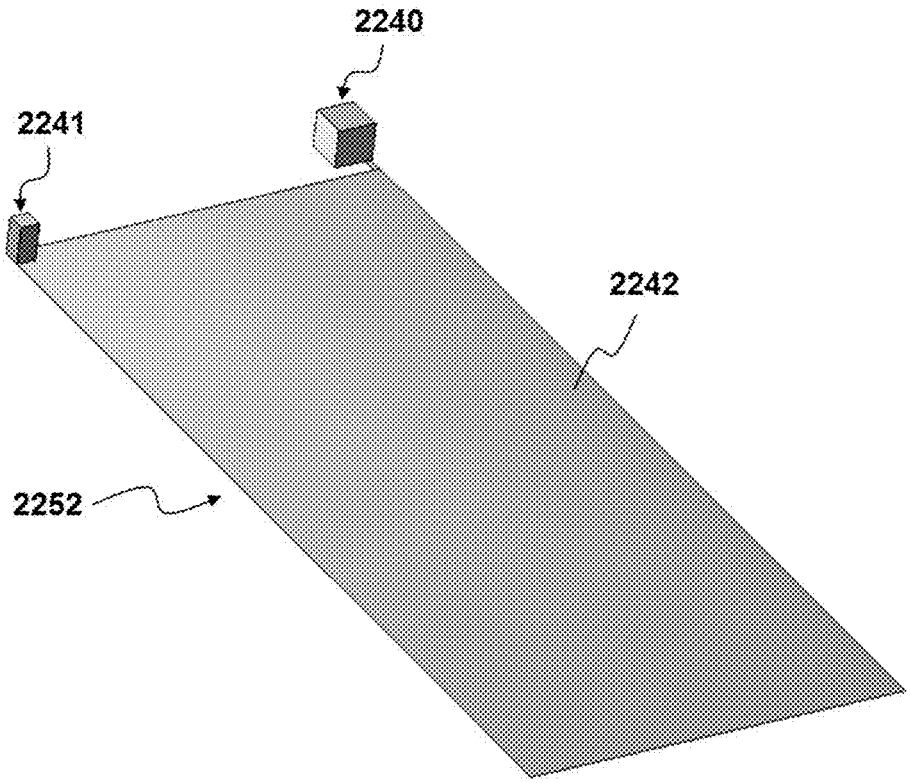

FIG. 22C illustrates a redundancy system 2252 comprising two radiation boosters 2240 and 2241 and a ground plane layer 2242; each of the two radiation booster comprising a conductive part featuring a polyhedral shape comprising six faces; and the radiation boosters have different sizes. The radiation boosters 2240 and 2241 are located substantially at the corner of the short edge of the ground plane layer 2242. In this example, the conductive part takes the form of a parallelepiped having substantially a square top face, a bottom face and four substantially rectangular lateral faces. However, other shapes for the top and bottom faces are also possible (such as for instance, but not limited to, triangle, pentagon, hexagon, octagon, circle, or ellipse) and/or for the lateral faces. Furthermore, the conductive part of the radiation booster could also have been shaped as a cylinder having circular or elliptical top and bottom faces.

The placement of the radiation booster 2240 with respect to the ground plane layer 2242 is different from the placement of the radiation booster 2241 with respect to the ground plane layer 2242. While the radiation booster 2240 protrudes beyond the ground plane layer 2242; in the radiation booster 2241, the projection of the radiation booster 2241 onto the plane containing the ground plane layer 2242 overlaps completely the ground plane layer 2242. Despite the radiation booster 2241 is located above the ground plane layer 2242; the radiation booster 2241 is not connected to the ground plane layer 2242. An internal port of the redundancy system 2252 is defined between a connection point of the radiation booster 2241 and a connection point of the ground plane layer 2242.

Figure 22D:
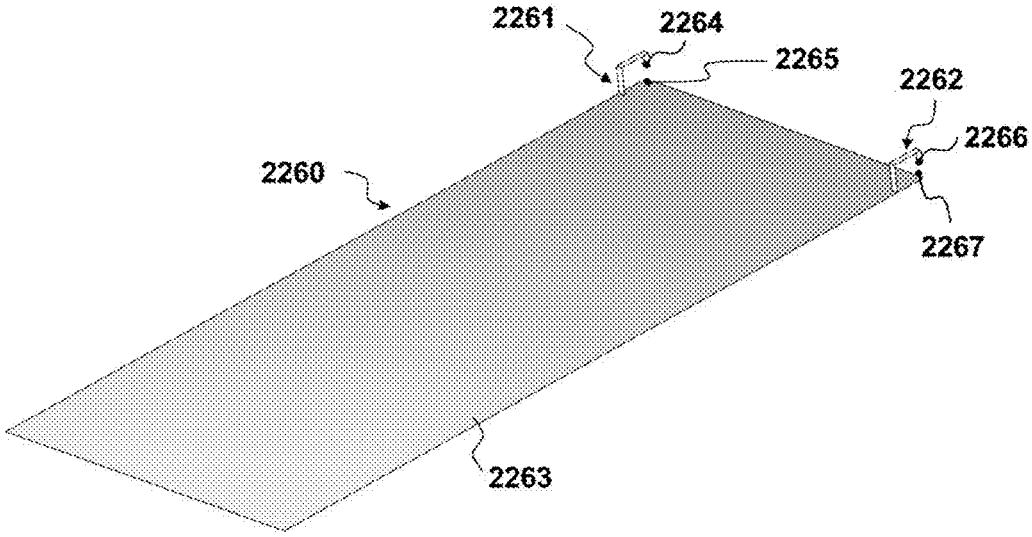

Other example of the radiation booster is illustrated in FIG. 22D; the embodiment 2260 illustrates a redundancy system 2260 comprising two radiation boosters 2261 and 2262 and a ground plane layer 2263. The first radiation booster 2261 comprises a connection point 2264, and the ground plane layer 2260 comprises a first connection point 2265 substantially on a corner of the ground plane layer 2263. A first internal port is defined between the connection point 2264 and the first connection point 2265. In the case of the second radiation booster 2262, a second internal port is defined between the connection point 2266 of the radiation booster 2262 and the second connection point 2267 of the ground plane layer 2263.

The first radiation booster 2261 and the second radiation booster 2262 include a conductive part comprising a plurality of conductive strips. In this example, the conductive part comprises three conductive strips, although in other examples the conductive part may comprise more or fewer than three conductive strips. As depicted in FIG. 22D, a first conductive strip and a third conductive strip are arranged substantially perpendicular to a ground plane layer 2263. A second strip is arranged substantially parallel to the ground plane layer 2263 and connected to the other two conductive strips, so that a first end of the second conductive strip is connected to a first end of the first conductive strip and a second end of the second conductive strip is connected to a first end of the third conductive strip. Such shape for the radiation booster may be advantageous when it is desired to have a redundancy system that features an input impedance at the internal port (in absence of a combining system) having a positive imaginary part for all the frequencies of the frequency region of operation (i.e., said imaginary part being an inductive component).

In accordance with the present invention, a radiating system includes a redundancy system 2260 and a combining system (830*a*, 830*b*, 830*c*); each internal port of the redundancy system 2260 is connected to a port of the combining system (830*a*, 830*b*, 830*c*).

Figure 23:
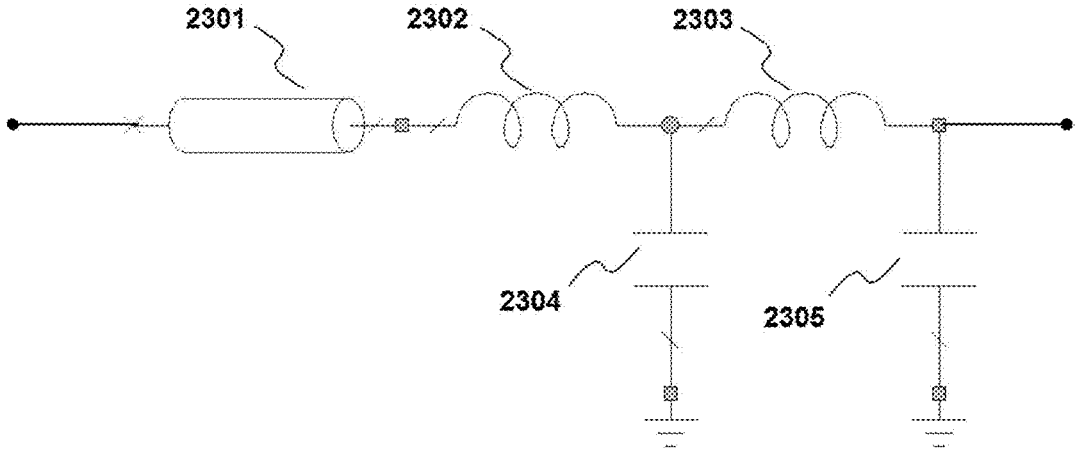
FIG. 23 illustrates an example of a delay module comprising a transmission line and lumped components (inductors and capacitors).

FIG. 23 shows an example of a delay module comprising a transmission line 2301, two series inductors 2302 and 2303 and two shunt capacitors 2304 and 2305. In an example, the delay module of FIG. 23 substitutes the delay modules 1133 and/or 1134 in FIG. 11.

The use of reactive elements (2302, 2303, 2304, and 2305) provides an additional degree of freedom to design a characteristic impedance of a delay module. The square root of the ratio of the inductance of the inductor 2302 over the capacitance of the capacitor 2304 determines a first equivalent characteristic impedance. Furthermore, the square root of the ratio of the inductance of the inductor 2303 over the capacitance of the capacitor 2305 determines a second equivalent characteristic impedance. The values of the characteristic impedance of the transmission line 2301, the first equivalent characteristic impedance, and the second equivalent characteristic impedance are optimized to enhance the impedance bandwidth of a redundancy system using such delay module.

In yet another example, the delay module comprises a transmission line 2301 and only one stage 2302 and 2304. In a further example, the delay module comprises a transmission line and more than two stages 2302 and 2304. In yet another example, the delay module comprises several transmission lines cascaded with stages 2302 and 2304. In yet another example, the reactive components can be further optimized so as the delay module comprises a transmission line, a series inductor 2302 and 2303 and a shunt capacitor 2304. In yet another example, the stage comprises a series capacitor and a shunt inductor. All these examples add flexibility to optimize the delay module for impedance bandwidth enhancement.

Even though that in the illustrative examples described above in connection with the figures some particular designs of radiation boosters have been used, many other designs of radiation boosters having for example different shape and/or dimensions could have been equally used in the redundancy system.

In the same way, despite the fact some radiation boosters have been chosen to be equal in topology (i.e., a planar versus a volumetric geometry), shape and size, they could have been selected to have different topology, shape and/or size, while preserving for example the relative location of the radiation boosters with respect to each other and with respect to the ground plane.

What is claimed is:

1. A wireless device comprising:

a radiating system included within the wireless device and configured to operate in a frequency region, the radiating system comprising:

an external port;

a redundancy system comprising: first and second radiation boosters each having a resonant frequency above a highest frequency of the frequency region, the first and second radiation boosters being substantially non-radiating for frequencies within the frequency region and being configured to contribute to the operation of the radiating system in the frequency region; a first internal port coupled to the first radiation booster, the first radiation booster featuring at the first internal port a first input impedance having a reactive component within the frequency region; a second internal port coupled to the second radiation booster, the second radiation booster featuring at the second internal port a second input impedance having a reactive component within the frequency region; and a ground plane layer; and a combining system comprising: a first port connected to the first internal port of the redundancy system; a second port connected to the second internal port of the redundancy system; a third port connected to the external port of the radiating system; a first reactance cancellation element connected to the first port and configured to provide an impedance having an imaginary part substantially close to zero for a frequency within the frequency region; a second reactance cancellation element connected to the second port and configured to provide an impedance having an imaginary part substantially close to zero for a frequency within the frequency region; a first delay module configured to transform the first input impedance into a first impedance within the frequency region; and a second delay module configured to transform the second input impedance into a second impedance within the frequency region, the combining system combining the first and second input impedances into a combined impedance at the external port to produce a substantially balanced power distribution between the first and second radiation boosters, wherein the first impedance is out-of-phase with the second impedance by between 45° and 315° and an average resistance of the first impedance differs from an average resistance of the second impedance by less than 30%.

2. The apparatus of claim 1, wherein the combining system further comprises a fine tuning circuit connected to the external port of the radiating system.

3. The apparatus of claim 1, wherein the first radiation booster and the second radiation booster protrude beyond the ground plane layer.

4. The apparatus of claim 3, wherein each of the first and second radiation boosters is located at a distance from a short edge of the ground plane layer that is less than 5% of the free-space wavelength corresponding to the lowest frequency of the frequency region.

5. The apparatus of claim 4, wherein the first and second radiation boosters are located in opposite corners of a short edge of the ground plane layer.

6. The apparatus of claim 5, wherein each of the first and second radiation boosters features a polyhedral shape comprising six faces.

* * * * *